US006655783B2

(12) United States Patent
Otsuki

(10) Patent No.: US 6,655,783 B2
(45) Date of Patent: Dec. 2, 2003

(54) PRINTING BY SWITCHING SUB-SCANNING FEED BETWEEN MONOCHROMATIC AREAS AND COLOR AREAS

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/151,706

(22) Filed: May 21, 2002

(65) Prior Publication Data

US 2002/0175971 A1 Nov. 28, 2002

(30) Foreign Application Priority Data

May 23, 2001 (JP) ..... 2001-154107

(51) Int. Cl.[7] ..... B41J 2/25
(52) U.S. Cl. ..... 347/43; 347/41
(58) Field of Search ..... 347/41, 43, 40, 347/12, 16, 14, 15

(56) References Cited

U.S. PATENT DOCUMENTS 5,692,843 A 12/1997 Furuya
6,209,987 B1 4/2001 Katayama
6,213,584 B1 * 4/2001 Noyes et al. ..... 347/40
6,302,520 B1 * 10/2001 Akiyama et al. ..... 347/43

FOREIGN PATENT DOCUMENTS

| | | |
|---|---|---|
| EP | 0 901 097 A2 | 3/1999 |
| EP | 1 085 457 A1 | 3/2001 |
| JP | 8-238805 | 9/1996 |
| JP | 8-244256 | 9/1996 |
| JP | 10-337892 | 12/1998 |

* cited by examiner

*Primary Examiner*—Lamson Nguyen
(74) *Attorney, Agent, or Firm*—Sughrue Mion, PLLC

(57) ABSTRACT

Efficient printing of data including two types of areas in the sub-scanning direction, a color area and a monochromatic area, are present. During monochromatic mode printing, in the event that (1) the lowermost main scan lines of the achromatic unit band enter the color areas, assuming that J iterations of the color mode sub-scan (feed quantum Sc<Sm) are to be executed instead of the color mode sub-scan (feed amount Sm); and also (2) the lowermost main scan lines of the achromatic unit band do not enter the color areas, assuming that (J−1) iterations of the color mode sub-scan are to be executed next; a specific positioning feed is executed and dots are formed in the monochromatic areas by executing one unit scan operation. Subsequently a transition is made to color mode printing. The feed amount of the positioning feed is the product of (J−1) multiplied by the color mode sub-scan feed amount Sc.

60 Claims, 38 Drawing Sheets

Fig.4

| MAIN SCAN LINE COUNT | | | PASS COUNT 1 | 2 | 3 | 4 |
|---|---|---|---|---|---|---|
| 1 | K | (Y) | #1 | | | |
| 2 | | | | #1 | | |
| 3 | | | | | #1 | |
| 4 | | | | | | #1 |
| 5 | K | (Y) | #2 | | | |
| 6 | | | | #2 | | |
| 7 | | | | | #2 | |
| 8 | | | | | | #2 |
| 9 | K | (M) | #3 | | | |
| 10 | | | | #3 | | |
| 11 | | | | | #3 | |
| 12 | | | | | | #3 |
| 13 | K | (M) | #4 | | | |
| 14 | | | | #4 | | |
| 15 | | | | | #4 | |
| 16 | | | | | | #4 |
| 17 | K0 | (C) | #5 | | | |
| 18 | | | | #5 | | |
| 19 | | | | | #5 | |
| 20 | | | | | | #5 |
| 21 | K0 | (C) | #6 | | | |
| 22 | | | | #6 | | |
| 23 | | | | | #6 | |
| 24 | | | | | | #6 |

L1

Fig.5

| MAIN SCAN LINE COUNT | | | PASS COUNT 1 | 2 | 3 | 4 | |
|---|---|---|---|---|---|---|---|
| 1 | (K) | Y | #1 | | | | |
| 2 | | | | #1 | | | |
| 3 | | | | | #1 | | |
| 4 | | | | | | #1 | |
| 5 | (K) | Y | #2 | | | | L2(Y) |
| 6 | | | | #2 | | | |
| 7 | | | | | #2 | | |
| 8 | | | | | | #2 | |
| 9 | (K) | M | #1 | | | | |
| 10 | | | | #1 | | | |
| 11 | | | | | #1 | | |
| 12 | | | | | | #1 | |
| 13 | (K) | M | #2 | | | | L2(M) |
| 14 | | | | #2 | | | |
| 15 | | | | | #2 | | |
| 16 | | | | | | #2 | |
| 17 | K0 | C | #1 | | | | |
| 18 | | | | #1 | | | |
| 19 | | | | | #1 | | |
| 20 | | | | | | #1 | |
| 21 | K0 | C | #2 | | | | L2(C,K) |
| 22 | | | | #2 | | | |
| 23 | | | | | #2 | | |
| 24 | | | | | | #2 | |

Fig. 17

| MAIN SCAN LINE COUNT | PASS COUNT | | 1 | 2 | 3 | 4 |
|---|---|---|---|---|---|---|
| 1 | K | (Y) | #1 | | | |
| 2 | | | | | | |
| 3 | | | | | | |
| 4 | | | | #1 | | |
| 5 | K | (Y) | #2 | | | |
| 6 | | | | | | |
| 7 | | | | | #1 | |
| 8 | | | | #2 | | |
| 9 | K | (Y) | #3 | | | |
| 10 | | | | | | #1 |
| 11 | | | | | #2 | |
| 12 | | | | #3 | | |
| 13 | K | (Y) | #4 | | | |
| 14 | | | | | | #2 |
| 15 | | | | | #3 | |
| 16 | | | | #4 | | |
| 17 | K | (Y) | #5 | | | |
| 18 | | | | | | #3 |
| 19 | | | | | #4 | |
| 20 | | | | #5 | | |
| 21 | K | (M) | #6 | | | |
| 22 | | | | | | #4 |
| 23 | | | | | #5 | |
| 24 | | | | #6 | | |
| 25 | K | (M) | #7 | | | |
| 26 | | | | | | #5 |
| 27 | | | | | #6 | |
| 28 | | | | #7 | | |
| 29 | K | (M) | #8 | | | |
| 30 | | | | | | #6 |
| 31 | | | | | #7 | |
| 32 | | | | #8 | | |
| 33 | K | (M) | #9 | | | |
| 34 | | | | | | #7 |
| 35 | | | | | #8 | |
| 36 | | | | #9 | | |
| 37 | K | (M) | #10 | | | |
| 38 | | | | | | #8 |
| 39 | | | | | #9 | |
| 40 | | | | #10 | | |
| 41 | K0 | (C) | #11 | | | |
| 42 | | | | | | #9 |
| 43 | | | | | #10 | |
| 44 | | | | #11 | | |
| 45 | K0 | (C) | #12 | | | |
| 46 | | | | | | #10 |
| 47 | | | | | #11 | |
| 48 | | | | #12 | | |
| 49 | K0 | (C) | #13 | | | |
| 50 | | | | | | #11 |
| 51 | | | | | #12 | |
| 52 | | | | #13 | | |
| 53 | K0 | (C) | #14 | | | |
| 54 | | | | | | #12 |
| 55 | | | | | #13 | |
| 56 | | | | #14 | | |
| 57 | K0 | (C) | #15 | | | |
| 58 | | | | | | #13 |
| 59 | | | | | #14 | |
| 60 | | | | #15 | | |
| 61 | | | | | | |
| 62 | | | | | | #14 |
| 63 | | | | | #15 | |
| 64 | | | | | | |
| 65 | | | | | | |
| 66 | | | | | | #15 |
| 67 | | | | | | |

L1

Fig. 18

| MAIN SCAN LINE COUNT | PASS COUNT | | 1 | 2 | 3 | 4 | |
|---|---|---|---|---|---|---|---|
| 1 | (K) | Y | #1 | | | | |
| 2 | | | | | | | |
| 3 | | | | | | | |
| 4 | | | | #1 | | | |
| 5 | (K) | Y | #2 | | | | |
| 6 | | | | | | | |
| 7 | | | | | #1 | | |
| 8 | | | | #2 | | | |
| 9 | (K) | Y | #3 | | | | |
| 10 | | | | | | #1 | |
| 11 | | | | | #2 | | L2(Y) |
| 12 | | | | #3 | | | |
| 13 | (K) | Y | #4 | | | | |
| 14 | | | | | | #2 | |
| 15 | | | | | #3 | | |
| 16 | | | | #4 | | | |
| 17 | (K) | Y | #5 | | | | |
| 18 | | | | | | #3 | |
| 19 | | | | | #4 | | |
| 20 | | | | #5 | | | |
| 21 | (K) | M | #1 | | | | |
| 22 | | | | | | #4 | |
| 23 | | | | | #5 | | |
| 24 | | | | #1 | | | |
| 25 | (K) | M | #2 | | | | |
| 26 | | | | | | #5 | |
| 27 | | | | | #1 | | |
| 28 | | | | #2 | | | |
| 29 | (K) | M | #3 | | | | |
| 30 | | | | | | #1 | |
| 31 | | | | | #2 | | L2(M) |
| 32 | | | | #3 | | | |
| 33 | (K) | M | #4 | | | | |
| 34 | | | | | | #2 | |
| 35 | | | | | #3 | | |
| 36 | | | | #4 | | | |
| 37 | (K) | M | #5 | | | | |
| 38 | | | | | | #3 | |
| 39 | | | | | #4 | | |
| 40 | | | | #5 | | | |
| 41 | K0 | C | #1 | | | | |
| 42 | | | | | | #4 | |
| 43 | | | | | #5 | | |
| 44 | | | | #1 | | | |
| 45 | K0 | C | #2 | | | | |
| 46 | | | | | | #5 | |
| 47 | | | | | #1 | | |
| 48 | | | | #2 | | | |
| 49 | K0 | C | #3 | | | | |
| 50 | | | | | | #1 | |
| 51 | | | | | #2 | | |
| 52 | | | | #3 | | | L2(C, K) |
| 53 | K0 | C | #4 | | | | |
| 54 | | | | | | #2 | |
| 55 | | | | | #3 | | |
| 56 | | | | #4 | | | |
| 57 | K0 | C | #5 | | | | |
| 58 | | | | | | #3 | |
| 59 | | | | | #4 | | |
| 60 | | | | #5 | | | |
| 61 | | | | | | | |
| 62 | | | | | | #4 | |
| 63 | | | | | #5 | | |
| 64 | | | | | | | |
| 65 | | | | | | | |
| 66 | | | | | | #5 | |
| 67 | | | | | | | |

MAIN SCAN LINE COUNT
PASS COUNT
COLOR AREA
MONOCHROMATIC AREA
Sc1
Sc
UNIT BAND AFTER POSITIONING FEED (FEED AMOUNT OF Sc1)

Fig.23

| MAIN SCAN LINE COUNT | | | PASS COUNT 1 | 2 | 3 | 4 |
|---|---|---|---|---|---|---|
| 1 | K | (Y) | #1 | | | |
| 2 | | | | #1 | | |
| 3 | | | | | #1 | |
| 4 | | | | | | #1 |
| 5 | K | (Y) | #2 | | | |
| 6 | | | | #2 | | |
| 7 | | | | | #2 | |
| 8 | | | | | | #2 |
| 9 | K | (Y) | #3 | | | |
| 10 | | | | #3 | | |
| 11 | | | | | #3 | |
| 12 | | | | | | #3 |
| 13 | K | (Y) | #4 | | | |
| 14 | | | | #4 | | |
| 15 | | | | | #4 | |
| 16 | | | | | | #4 |
| 17 | K | (Y) | #5 | | | |
| 18 | | | | #5 | | |
| 19 | | | | | #5 | |
| 20 | | | | | | #5 |
| 21 | K | (M) | #6 | | | |
| 22 | | | | #6 | | |
| 23 | | | | | #6 | |
| 24 | | | | | | #6 |
| 25 | K | (M) | #7 | | | |
| 26 | | | | #7 | | |
| 27 | | | | | #7 | |
| 28 | | | | | | #7 |
| 29 | K | (M) | #8 | | | |
| 30 | | | | #8 | | |
| 31 | | | | | #8 | |
| 32 | | | | | | #8 |
| 33 | K | (M) | #9 | | | |
| 34 | | | | #9 | | |
| 35 | | | | | #9 | |
| 36 | | | | | | #9 |
| 37 | K | (M) | #10 | | | |
| 38 | | | | #10 | | |
| 39 | | | | | #10 | |
| 40 | | | | | | #10 |
| 41 | K0 | (C) | #11 | | | |
| 42 | | | | #11 | | |
| 43 | | | | | #11 | |
| 44 | | | | | | #11 |
| 45 | K0 | (C) | #12 | | | |
| 46 | | | | #12 | | |
| 47 | | | | | #12 | |
| 48 | | | | | | #12 |
| 49 | K0 | (C) | #13 | | | |
| 50 | | | | #13 | | |
| 51 | | | | | #13 | |
| 52 | | | | | | #13 |
| 53 | K0 | (C) | #14 | | | |
| 54 | | | | #14 | | |
| 55 | | | | | #14 | |
| 56 | | | | | | #14 |
| 57 | K0 | (C) | #15 | | | |
| 58 | | | | #15 | | |
| 59 | | | | | #15 | |
| 60 | | | | | | #15 |
| 61 | | | | | | |

L1

Fig.24

| MAIN SCAN LINE COUNT | PASS COUNT | | 1 | 2 | 3 | 4 | |
|---|---|---|---|---|---|---|---|
| 1 | (K) | Y | #1 | | | | |
| 2 | | | | #1 | | | |
| 3 | | | | | #1 | | |
| 4 | | | | | | #1 | |
| 5 | (K) | Y | #2 | | | | |
| 6 | | | | #2 | | | |
| 7 | | | | | #2 | | |
| 8 | | | | | | #2 | |
| 9 | (K) | Y | #3 | | | | |
| 10 | | | | #3 | | | |
| 11 | | | | | #3 | | L2(Y) |
| 12 | | | | | | #3 | |
| 13 | (K) | Y | #4 | | | | |
| 14 | | | | #4 | | | |
| 15 | | | | | #4 | | |
| 16 | | | | | | #4 | |
| 17 | (K) | Y | #5 | | | | |
| 18 | | | | #5 | | | |
| 19 | | | | | #5 | | |
| 20 | | | | | | #5 | |
| 21 | (K) | M | #1 | | | | |
| 22 | | | | #1 | | | |
| 23 | | | | | #1 | | |
| 24 | | | | | | #1 | |
| 25 | (K) | M | #2 | | | | |
| 26 | | | | #2 | | | |
| 27 | | | | | #2 | | |
| 28 | | | | | | #2 | |
| 29 | (K) | M | #3 | | | | |
| 30 | | | | #3 | | | |
| 31 | | | | | #3 | | L2(M) |
| 32 | | | | | | #3 | |
| 33 | (K) | M | #4 | | | | |
| 34 | | | | #4 | | | |
| 35 | | | | | #4 | | |
| 36 | | | | | | #4 | |
| 37 | (K) | M | #5 | | | | |
| 38 | | | | #5 | | | |
| 39 | | | | | #5 | | |
| 40 | | | | | | #5 | |
| 41 | K0 | C | #1 | | | | |
| 42 | | | | #1 | | | |
| 43 | | | | | #1 | | |
| 44 | | | | | | #1 | |
| 45 | K0 | C | #2 | | | | |
| 46 | | | | #2 | | | |
| 47 | | | | | #2 | | |
| 48 | | | | | | #2 | |
| 49 | K0 | C | #3 | | | | |
| 50 | | | | #3 | | | |
| 51 | | | | | #3 | | L2(C, K) |
| 52 | | | | | | #3 | |
| 53 | K0 | C | #4 | | | | |
| 54 | | | | #4 | | | |
| 55 | | | | | #4 | | |
| 56 | | | | | | #4 | |
| 57 | K0 | C | #5 | | | | |
| 58 | | | | #5 | | | |
| 59 | | | | | #5 | | |
| 60 | | | | | | #5 | |
| 61 | | | | | | | |

PRINTING BY SWITCHING SUB-SCANNING FEED BETWEEN MONOCHROMATIC AREAS AND COLOR AREAS

BACKGROUND OF THE INVENTION

1. Field of the Invention

The present invention relates to technology for printing by forming dots on a printing medium while performing a main scan, and specifically relates to technology for printing images for which there are two types of areas, color areas and monochromatic areas, in the sub-scan direction.

2. Description of the Related Art

In recent years, as computer output devices, there has been a broad popularization of color printers of the type that eject several colors of ink from a head. Among this type of color printer, there are printers that print an image by forming dots on a printing medium by ejecting ink drops from a nozzle while performing a main scan.

Also, there are printing devices that are equipped with a higher number of nozzles that eject only black ink than those for other colored inks. For that kind of printing device, when printing color data, color printing is done using the same number of nozzles for each color. Only the same number of nozzles as the number of nozzles for each color is used for the black nozzles. Then, when printing data that is monochromatic only, the monochromatic printing is performed at high speed using all of the black nozzles.

However, with the printing device noted above, when within the printed image there are two types of areas, monochromatic areas that use only black ink, and color areas, there is the problem that printing cannot be performed efficiently.

SUMMARY OF THE INVENTION

Accordingly, an object of the present invention is to efficiently print images for which two types of areas, color areas and monochromatic areas, exist in the sub-scan direction.

To attain at least part of the above and other related objects of the present invention, there is provided a printing apparatus that prints images in a monochromatic area on a printing medium with an achromatic ink alone, and in a color area with chromatic inks, by ejecting ink drops from a nozzle to deposit the ink drops on the printing medium to form dots.

This printing apparatus comprises a printing head having a plurality of single chromatic nozzle groups and an achromatic nozzle group, a main scan drive unit that moves at least one of the printing head and the printing medium to perform main scanning, a sub-scan drive unit that moves at least one of the printing head and the printing medium in a direction that intersects a main scanning direction to perform sub-scanning, and a control unit that controls each of these units (the printing head, the main scan drive unit and the sub-scan drive unit). Each of the plurality of single chromatic nozzle groups consists of plurality of nozzles that are arranged at nozzle pitch k×D where k is an integer of at least 2 and D is a pitch of main scan lines. The plurality of single chromatic nozzle groups are configured to eject mutually different chromatic inks. The achromatic nozzle group for ejecting achromatic ink consists of a greater number of nozzles that are arranged at nozzle pitch k×D than each of the single chromatic nozzle groups.

It is preferable that the plurality of single chromatic nozzle groups each consists of mutually equal numbers of nozzles. It is also preferable that the specific achromatic nozzle group includes a same number of nozzles as each of the single chromatic nozzle groups.

In that apparatus, monochromatic mode printing is also executed by repeating a unit scan operation using all the nozzles of the achromatic nozzle group but without using the single chromatic nozzle groups. The unit scan operation consists of k main scans and (k−1) sub-scans of a first feed amount. The unit scan operation in the monochromatic mode printing may be performed such that all dot positions in an achromatic unit band consisting of plural main scan lines without any gap therebetween are serviced by the achromatic nozzle group. A monochromatic mode sub-scan of a second feed amount is performed in each interval between each unit scan operations.

In that apparatus, color mode printing is executed by repeating the unit scan operation using a specific achromatic nozzle group and the plurality of single chromatic nozzle groups while a color mode sub-scan of a third feed amount less than the second feed amount is performed in each interval between each unit scan operations. The specific achromatic nozzle group is part of the achromatic nozzle group.

In specific case in the monochromatic mode printing, specific process is executed. The case is when a lowermost main scan line of a second achromatic unit band comes to be positioned within the color area when it is assumed that a set of the color mode sub-scan and the unit scan operation is performed J times (where J is an integer of two or greater). The second achromatic unit band consists of plural main scan lines without any gap therebetween for which the specific achromatic nozzle group services with a single unit scan operation.

In above specific case, a sub-scan whose feed amount is equal to a sum of (J−1) times the third feed amount and (J−2) times a total feed amount of sub-scans performed in one unit scan operation is performed. The printing process proceeds to the color mode printing. Such an embodiment makes it possible to efficiently execute monochromatic printing when an attempt is made to transition to color mode printing.

It should be preferred that the printing process proceeds to the color mode printing, in a case that a lowermost main scan line of the first achromatic unit band comes to be positioned within the color area when it is assumed that the monochromatic mode sub-scan of the second feed amount and the unit scan operation are performed. Such an embodiment makes it possible, based on simple decision criteria, to execute the transition process from monochromatic mode printing to color mode printing.

The printing mode transitioning procedure may be as follows. The case the specific procedure to be performed may include three conditions all to be qualified. (i) A lowermost main scan line of the first achromatic unit band comes to be positioned within the color area when it is assumed that the monochromatic mode sub-scan and the unit scan operation are performed next. (ii) A lowermost main scan line of a second achromatic unit band comes to be positioned within the color area when it is assumed that a set of the color mode sub-scan and the unit scan operation is performed J times (where J is an integer of two or greater). (iii) A lowermost main scan line of the second achromatic unit band comes to be positioned within the monochromatic area when it is assumed that the set of the color mode sub-scan and the unit scan operation is performed (J−1) times. The second achromatic unit band consists of plural main scan lines without any gap therebetween for which the specific achromatic nozzle group services with a single unit scan operation.

If above conditions are all fulfilled, then a sub-scan whose feed amount is equal to a sum of (J−1) times the third feed amount and (J−2) times a total feed amount of sub-scans performed in one unit scan operation is performed; The unit scan operation is performed once, while forming dots in the monochromatic area using the achromatic nozzle group; The printing procedure proceeds to the color mode printing. Such an embodiment also makes it possible to efficiently execute monochromatic printing when an attempt is made to transition to color mode printing.

It is preferable that the printing procedure proceeds to the color mode printing in a case that a lowermost main scan line of the second achromatic unit band comes to be positioned within the color area when it is assumed that the color mode sub-scan and the unit scan operation are performed next. Such an embodiment makes it possible to efficiently transition from monochromatic mode printing to color mode printing when the distance from the lower tip of the print head to the color area and boundary is smaller than a prescribed value.

In a case that main scan line count Lr1 of a remaining monochromatic area is (i) smaller than main scan line count L1 of the first achromatic unit band, (ii) equal to or larger than main scan line count of (J−1) times of main scan line count L2, and (iii) smaller than main scan line count of J times of main scan line count L2, it is preferable the procedure as follows to be performed. A sub-scan whose feed amount is equal to a sum of (J−1) times the third feed amount and (J−2) times a total feed amount of sub-scans performed in one unit scan operation is performed; The unit scan operation is performed once, while forming dots in the monochromatic area using the achromatic nozzle group; and The printing procedure proceeds to the color mode printing. The main scan line count L2 is a main scan line count of a second achromatic unit band. The second achromatic unit band consists of plural main scan lines without any gap therebetween for which the specific achromatic nozzle group services with a single unit scan operation. Such an embodiment makes it possible, based on simple decision criteria, to execute the transition process from monochromatic mode printing to color mode printing.

In a case that main scan line count Lr1 of the remaining monochromatic area is smaller than main scan line count L2, the printing procedure preferably proceeds to the color mode printing. Such an embodiment makes it possible to execute the shifting process from monochromatic mode printing to color mode printing, based on simple decision criteria, when the distance from the bottom edge of the printing head to the border of the color area is smaller than a prescribed value, while recording dots in the monochromatic area and after the main scan has finished.

If (i) the plurality of single chromatic nozzle groups includes C nozzle rows, where C is an integer of at least 2, (ii) each of single chromatic nozzle group includes N nozzles, where N is an integer of at least 2, arranged in the sub-scan direction at the nozzle pitch k×D and also (iii) the achromatic nozzle group includes a nozzle row consisting of N×C nozzles arranged in the sub-scan direction at the nozzle pitch k×D, then it is preferable that the first feed amount is equal to D, the second feed amount is equal to N×C×k×D, and the third feed amount is equal to N×k×D. If such an embodiment is used, the main scan lines recorded by the unit scan operation will touch each other. This makes it easy to execute the transition process between the modes of color mode printing and monochromatic mode printing.

The first feed amount may be equal to m×D (where m is an integer of 2 or greater that disjoints with k). In such case, it is preferable that the second feed amount is determined such that a sub-scan by the second feed amount will put an upper end nozzle of the achromatic nozzle group at a position of a main scan line immediately below a lower edge of the bundle of main scan lines recorded by the immediately prior unit scan operation without any gap therebetween. It is also preferable that the third feed amount is determined such that a sub-scan by the third feed amount will put a nozzle positioned at the very top of the nozzles of the plurality of single chromatic nozzle groups at a position of a main scan line immediately below a lower edge of a bundle of main scan lines without any gap therebetween for which recording is completed by the immediately prior unit scan operation. In such an embodiment partial interlace printing is executed, so the quality of printing is better.

In a case all conditions described below are fulfilled if the color mode sub-scan and the unit scan operation are performed next, it is preferable that the color mode sub-scan is performed and the unit scan operation is performed, while not forming dots in the monochromatic area by the specific achromatic nozzle group but forming dots in the color area using the single chromatic nozzle groups. The conditions are as follows. (i) A lowermost main scan line of specific achromatic unit lines comes to be positioned within the monochromatic area. The specific achromatic unit lines consists of plural main scan lines for which the specific achromatic nozzle group services with a single unit scan operation. (ii) The uppermost main scan line of color unit lines comes to be positioned within the color area. The color unit lines consists of plural main scan lines for which an uppermost single chromatic nozzle group services with a single unit scan operation.

In a case that all main scan lines of the color unit lines come to be positioned within the monochromatic area when it is assumed that the color mode sub-scan and the unit scan operation are performed next, it is preferable that specific procedure as follows are performed. A sub-scan of a specific feed amount is performed so that the uppermost main scan line of an achromatic unit band comes to an upper edge of the monochromatic area. The achromatic unit band consists of plural main scan lines without any gap therebetween for which the achromatic nozzle group services with a single unit scan operation. The printing procedure proceeds to the monochromatic mode printing. Such an embodiment makes it possible to efficiently execute printing of monochromatic areas when switching from color mode printing to monochromatic mode printing.

In a case that all main scan lines of the color unit lines come to be positioned within the monochromatic area when it is assumed that the color mode sub-scan and the unit scan operation are performed next, the following procedures may be performed. (i) A sub-scan of a specific feed amount is performed so that the uppermost main scan line of an achromatic unit band comes to an upper edge of the monochromatic area. The achromatic unit band consists of plural main scan lines without any gap therebetween for which the achromatic nozzle group services with a single unit scan operation. (ii) The unit scan operation is performed once, while forming dots in the monochromatic area using the achromatic nozzle group. (iii) The printing procedure proceeds to the monochromatic mode printing. Such an embodiment makes it possible to efficiently execute printing of monochromatic areas when switching from color mode printing to monochromatic mode printing.

In color mode printing, as described above, unit scan operations may be performed while dots being formed on the main scan line of the color area using a single chromatic nozzle group, without conducting recording onto the monochromatic area main scan line by a special group of achromatic nozzles. After the unit scan operations, the following may also be done.

In a case that a lowermost main scan line of a color unit band comes to be positioned within the monochromatic area when it is assumed that the color mode sub-scan and the unit scan operation are performed next, specific procedures are preferably performed. The color unit band consists of plural main scan lines without any gap therebetween for which the uppermost single chromatic nozzle group services with a single unit scan operation. The specific procedures are as follows. (i) A sub-scan of a specific feed amount is performed so that the lowermost main scan line of the color unit band comes to a lower edge of the color area when it is assumed that the unit scan operation are performed. (ii) A sub-scan of a specific feed amount is performed so that the uppermost main scan line of an achromatic unit band comes to an upper edge of the monochromatic area, the achromatic unit band consisting of plural main scan lines without any gap therebetween for which the achromatic nozzle group services with a single unit scan operation. (iii) The printing procedure proceeds to the monochromatic mode printing.

In a case that a lowermost main scan line of a color unit band comes to be positioned within the monochromatic area when it is assumed that the color mode sub-scan and the unit scan operation are performed next, specific procedure may be performed. The color unit band consists of plural main scan lines without any gap therebetween for which the uppermost single chromatic nozzle group services with a single unit scan operation. The procedure is as follows. (i) A sub-scan of a specific feed amount is performed so that the lowermost main scan line of the color unit band comes to a lower edge of the color area when it is assumed that the unit scan operation are performed. (ii) The unit scan operation is performed once, while not forming dots in the monochromatic area by the specific achromatic nozzle group but forming dots in the color area using the single chromatic nozzle groups. (iii) A sub-scan of a specific feed amount is performed so that the uppermost main scan line of an achromatic unit band comes to an upper edge of the monochromatic area. The achromatic unit band consists of plural main scan lines without any gap therebetween for which the achromatic nozzle group services with a single unit scan operation. (iv) The unit scan operation is performed once, while forming dots in the monochromatic area using the achromatic nozzle group. (v) The printing procedure proceeds to the monochromatic mode printing. Even in this type of mode, it is possible to efficiently execute printing of the monochromatic area when an attempt is made to transition from color mode printing to monochromatic mode printing.

Furthermore, in color mode printing, when the following conditions are satisfied, assuming that there will next be executed a sub-scan for the color mode, it is preferable that after the color mode sub-scan has been executed, a unit scan operation is executed while dots are being formed on the main scan line of the color area using a single chromatic nozzle group, without any recording onto the monochromatic area main scan line by the special group of achromatic nozzles. The conditions to be satisfied are as follows. (i) A lowermost main scan line of specific achromatic unit lines comes to be positioned within the monochromatic area when it is assumed that the color mode sub-scan and the unit scan operation are performed next. (ii) Main scan line count Lr2 of a remaining color area is equal to or larger than main scan line count L2 of a single chromatic unit band. The remaining color area is an area of the color area comprising main scan lines not yet been recorded. The single chromatic unit band consists of plural main scan lines without any gap therebetween for which a one of the single chromatic nozzle groups services with a single unit scan operation.

In a case that main scan line count Lr2 of the remaining color area is smaller than main scan line count L2 of the single chromatic unit band, it is preferable that the following procedure to be performed. (i) A sub-scan of a specific feed amount is performed so that the lowermost main scan line of a color unit band comes to a lower edge of the remaining color area. (ii) The unit scan operation is performed once, while not forming dots in the monochromatic area by the specific achromatic nozzle group but forming dots in the color area using the single chromatic nozzle groups. (iii) A sub-scan of a specific feed amount is performed so that the uppermost main scan line of a achromatic unit band comes to an upper edge of the monochromatic area. The achromatic unit band consists of plural main scan lines without any gap therebetween for which the achromatic nozzle group services with a single unit scan operation. (iv) The unit scan operation is performed once, while forming dots in the monochromatic area using the achromatic nozzle group. (v) The printing procedure proceeds to the monochromatic mode printing. Such an embodiment makes it possible to execute the transition process from color mode printing to monochromatic mode printing, based on simple decision criteria.

The printing apparatus may comprise a printing head, a main scan drive unit, a sub-scan drive unit and a control unit. The printing head may have a plurality of single chromatic nozzle groups and an achromatic nozzle group. The plurality of single chromatic nozzle groups each may consist of plurality of nozzles that are arranged at nozzle pitch D where D is a pitch of main scan lines. The plurality of single chromatic nozzle groups is configured to eject mutually different chromatic inks. The achromatic nozzle group may be a nozzle group for ejecting achromatic ink and consist of a greater number of nozzles that are arranged at nozzle pitch D than each of the single chromatic nozzle groups. The main scan drive unit may move at least one of the printing head and the printing medium to perform main scanning. The sub-scan drive unit may move at least one of the printing head and the printing medium in a direction that intersects a main scanning direction to perform sub-scanning. The control unit may control each of the printing head, the main scan drive unit and the sub-scan drive unit.

With that printing apparatus, monochromatic mode printing may be executed by repeating a main scan using all the nozzles of the achromatic nozzle group but without using the single chromatic nozzle groups. In the monochromatic mode printing, a monochromatic mode sub-scan of a first feed amount is performed in each interval between each main scans.

With that printing apparatus, color mode printing may be executed by repeating the main scan using a specific achromatic nozzle group and the plurality of single chromatic nozzle groups while a color mode sub-scan of a second feed amount less than the first feed amount is performed in each interval between each main scans. The specific achromatic nozzle group is part of the achromatic nozzle group.

In the monochromatic mode printing, if the conditions are all satisfied, specific procedure is preferably performed. The conditions are as follows. (i) A lowermost nozzle of the achromatic nozzle group comes to be positioned over the color area when it is assumed that the monochromatic mode sub-scan is performed next. (ii) A lowermost nozzle of the specific achromatic nozzle group comes to be positioned over the color area when it is assumed that a sub-scan of a feed amount J times (where J is an integer of two or greater) the second feed amount of the color mode sub-scan is performed. (iii) A lowermost nozzle of the specific achromatic nozzle group comes to be positioned over the monochromatic area when it is assumed that a sub-scan of a feed amount (J−1) times the second feed amount of the color mode sub-scan is performed.

The specific procedure is as follows. (i) A sub-scan of a feed amount (J−1) times the second feed amount of the color mode sub-scan is performed. (ii) The main scan is performed once, while forming dots in the monochromatic area using the achromatic nozzle group. (iii) The printing procedure proceeds to the color mode printing. Such an embodiment makes it possible to efficiently execute monochromatic mode printing when an attempt is made to transition to color mode printing.

In a case that a lowermost nozzle of the specific achromatic nozzle group comes to be positioned over the color area when it is assumed that the color mode sub-scan is performed next, it is preferable that the printing procedure proceeds to the color mode printing. Such an embodiment makes it possible to efficiently transition to color mode printing when the distance from the lower tip of the print head to the color area and boundary is less than a prescribed value, after a main scan has been completed while recording dots in the monochromatic areas.

The sub-scan of a feed amount (J−1) times the second feed amount of the color mode sub-scan may be performed in a case that main scan line count Lr1 of a remaining monochromatic area is (i) smaller than a nozzle number N1 (where N1 is an integer of two or greater) of the achromatic nozzle group, (ii) equal to or larger than a number of (J−1) times (where J is an integer of two or greater) a nozzle number N2 (where N2 is an integer of two or greater) of the specific achromatic nozzle group, and (iii) smaller than a number of J times the nozzle number N2. The main scan then may be performed once, while forming dots in the monochromatic area using the achromatic nozzle group. The printing procedure may proceed to the color mode printing. Such an embodiment makes it possible to execute transition processing from monochromatic mode printing to color mode printing based on simple decision criteria.

In a case that main scan line count Lr1 of the remaining monochromatic area is smaller than the nozzle number N2, it is preferable that the printing procedure proceeds to the color mode printing. Such an embodiment makes it possible to execute transition processing from monochromatic mode printing to color mode printing based on simple decision criteria when the distance from the lower tip of the print head to the color area and boundary is less than a prescribed value, after a main scan has been completed while recording dots in the monochromatic areas.

In case that (i) the plurality of single chromatic nozzle groups includes C nozzle rows, where C is an integer of at least 2, (ii) each of the plurality of single chromatic nozzle groups includes N nozzles, where N is an integer of at least 2, arranged in the sub-scan direction at the nozzle pitch D, and also (iii) the achromatic nozzle group includes a nozzle row consisting of N×C nozzles arranged in the sub-scan direction at the nozzle pitch D, then the first feed amount is preferably equal to N×C×D, and the second feed amount is preferably equal to N×D. Such an embodiment makes it possible to efficiently execute printing without gaps, for the monochromatic areas and the color areas respectively.

In a case that when it is assumed that the color mode sub-scan is performed next, (i) a lowermost nozzle of specific achromatic nozzle group comes to be positioned over the monochromatic area, and also (ii) a nozzle positioned at the very top of the nozzles of the plurality of single chromatic nozzle groups comes to be positioned over the color area, the procedures as follows is preferably performed. The color mode sub-scan is performed. The main scan is performed, while not forming dots in the monochromatic area by the specific achromatic nozzle group but forming dots in the color area using the single chromatic nozzle groups.

In a case that all nozzles of the plurality of single chromatic nozzle groups come to be positioned within the monochromatic area when it is assumed that the color mode sub-scan is performed next, the procedures as follows is preferably performed. A sub-scan of a specific feed amount is performed so that an uppermost nozzle of the achromatic nozzle group comes over an upper edge of the monochromatic area. The main scan is performed once, while forming dots in the monochromatic area using the achromatic nozzle group. The printing procedure proceeds to the monochromatic mode printing. Such an embodiment makes it possible to efficiently execute printing of the monochromatic areas when transitioning from color mode printing to monochromatic mode printing.

In color mode printing, as described above, main scans may be performed while dots being formed on the main scan line of the color area using a single chromatic nozzle group, without conducting recording onto the monochromatic area main scan line by a special group of achromatic nozzles. After the main scans, the following may also be done.

In a case that a lowermost nozzle of an uppermost single chromatic nozzle group comes to be positioned within the monochromatic area when it is assumed that the color mode sub-scan is performed next, the procedures as follows may be performed. (i) A sub-scan of a specific feed amount is performed so that the lowermost nozzle of the uppermost single chromatic nozzle group comes to a lower edge of the color area. (ii) The main scan is performed once, while not forming dots in the monochromatic area by the specific achromatic nozzle group but forming dots in the color area using the single chromatic nozzle groups. (iii) A sub-scan of a specific feed amount is performed so that an uppermost nozzle of the achromatic nozzle group comes over an upper edge of the monochromatic area. (iv) The main scan is performed once, while forming dots in the monochromatic area using the achromatic nozzle group. (v) The printing procedure proceeds to the monochromatic mode printing. Such an embodiment makes it possible to efficiently execute monochromatic areas printing when an attempt is made to transition from color mode printing to monochromatic mode printing.

In a case that (i) a lowermost nozzle of specific achromatic nozzle group comes to be positioned over the monochromatic area when it is assumed that the color mode sub-scan is performed next, and (ii) main scan line count Lr2 of a remaining color area is equal to or larger than a nozzle number N2 of the single achromatic nozzle group, the procedures as follows are preferably performed. The remaining color area is an area of the color area comprising main scan lines not yet been recorded. (i) The color mode sub-scan is performed. (ii) The main scan is performed, while not forming dots in the monochromatic area by the specific achromatic nozzle group but forming dots in the color area using the single chromatic nozzle groups.

In a case that main scan line count Lr2 of the remaining color area is smaller than the nozzle number N2 of the single achromatic nozzle group, it is preferable that the procedure as follows are performed. (i) A sub-scan of a specific feed amount is performed so that a lowermost nozzle of an uppermost single chromatic nozzle group comes over a lower edge of the remaining color area. (ii) The main scan is performed once, while not forming dots in the monochromatic area by the specific achromatic nozzle group but forming dots in the color area using the single chromatic nozzle groups. (iii) A sub-scan of a specific feed amount is performed so that the uppermost nozzle of the achromatic nozzle group comes to an upper edge of the monochromatic area. (iv) The main scan is performed once, while forming dots in the monochromatic area using the achromatic nozzle group. (v) The printing procedure proceeds to the monochromatic mode printing. Such an embodiment makes it possible to execute transition processing from color mode printing to monochromatic mode printing based on simple decision criteria.

The present invention can be realized in a variety of embodiments such as those shown below.

(1) Printing method and printing control method (2) Printing apparatus and printing control apparatus (3) A computer program for realizing the aforementioned device or method (4) A recording medium on which is recorded a computer program for realizing the aforementioned device or method (5) Data signals implemented within carrier waves including a computer program for realizing the aforementioned device or method These and other objects, features, aspects, and advantages of the present invention will become more apparent from the following detailed description of the preferred embodiments with the accompanying drawings.

BRIEF DESCRIPTION OF THE DRAWINGS

FIG. 4 is an explanatory diagram showing recording of the main scan line by a unit scan operation during monochromatic mode printing;

FIG. 5 is an explanatory diagram showing recording of the main scan line by a unit scan operation during color mode printing;

FIG. 17 is an explanatory diagram for Second working example showing disposition of printer nozzles and main scan line recording by a unit scan operation;

FIG. 18 is an explanatory diagram for Second working example showing disposition of printer nozzles and main scan line recording by a unit scan operation;

FIG. 23 is an explanatory diagram showing another structure for the nozzle and a single scan operation;

FIG. 24 is an explanatory diagram showing another structure for the nozzle and a single scan operation;

DESCRIPTION OF THE PREFERED EMBODIMENT

Next the invention shall be explained based upon embodiments of the invention, in the following order.

A. First working example
  A1. Device structure:
  A2. Printing
B. Second working example
C. Third working example
D. Variation

A. FIRST WORKING EXAMPLE

Figure 1:
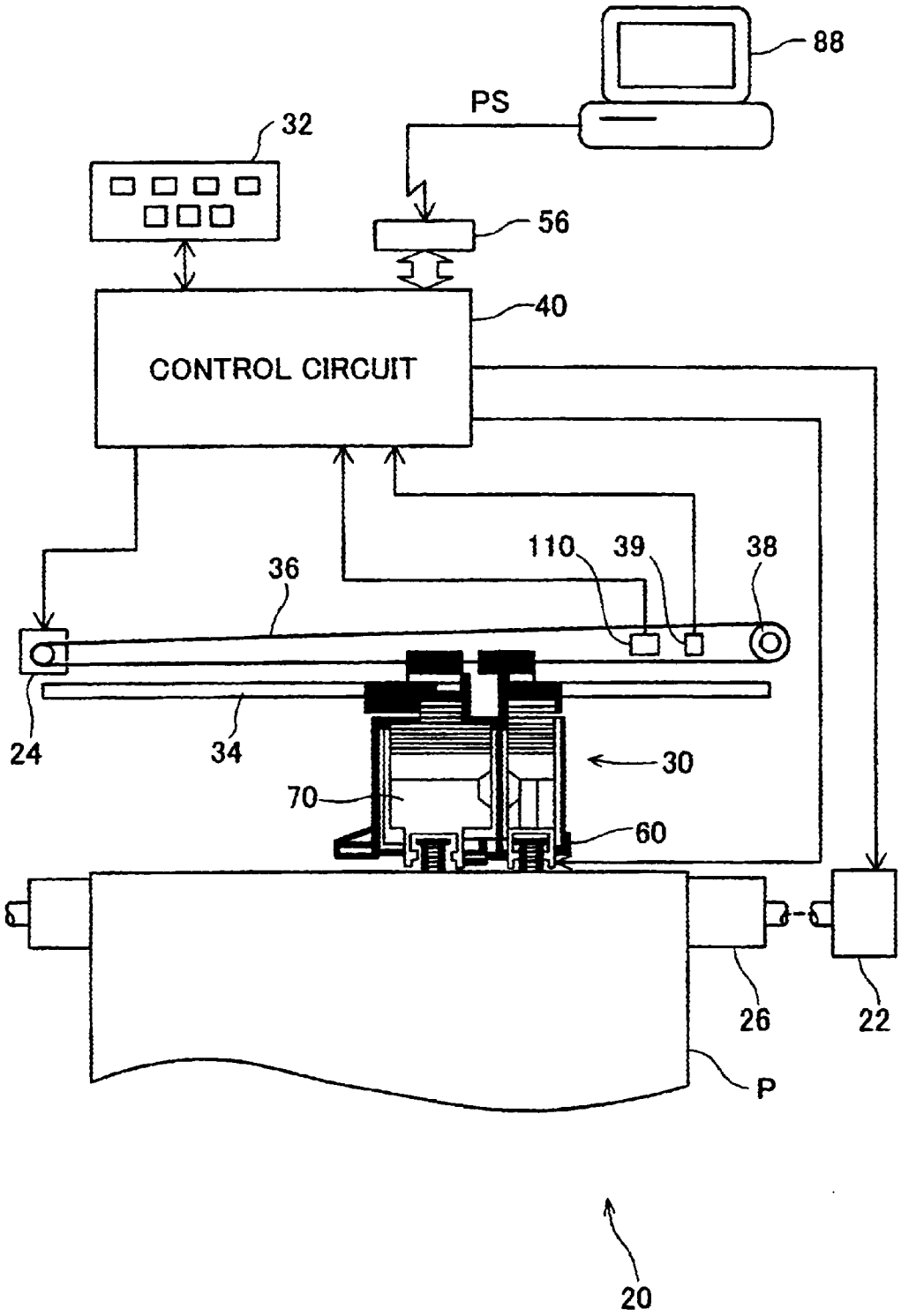
FIG. 1 is a simplified block diagram of the printing system furnished with printer 20 of the First working example.

A1. Device Structure:

FIG. 1 is a schematic structural diagram of a printing system equipped with an inkjet printer 20 as a working example of the present invention. This printer 20 is equipped with a main scan feeding mechanism that slides carriage 30 back and forth along sliding axis 34 using carriage motor 24, a sub-scan feeding mechanism that transports printing paper P in a direction perpendicular to the main scan direction (called "the sub-scan direction") using paper feed motor 22, a head driving mechanism that drives printing head unit 60 which is on carriage 30 and controls ink ejection and dot formation, and control circuit 40 which exchanges the control signals with these paper feed motor 22, carriage motor 24, printing head unit 60, and operating panel 32. Control circuit 40 is connected to computer 88 via connector 56.

The sub-scan feeding mechanism that transports printing paper P has a gear train (not illustrated) that conveys the rotation of paper feed motor 22 to the paper transport roller (not illustrated). Also, the main scan feed mechanism that slides carriage 30 back and forth comprises a sliding axis 34, built in a direction perpendicular to the transport direction of printing paper P, that holds carriage 30 so it is able to slide, a pulley 38 for which seamless drive belt 36 is extended between carriage 30 and carriage motor 24, and a position sensor 39 that detects the origin position of carriage 30.

Figure 2:
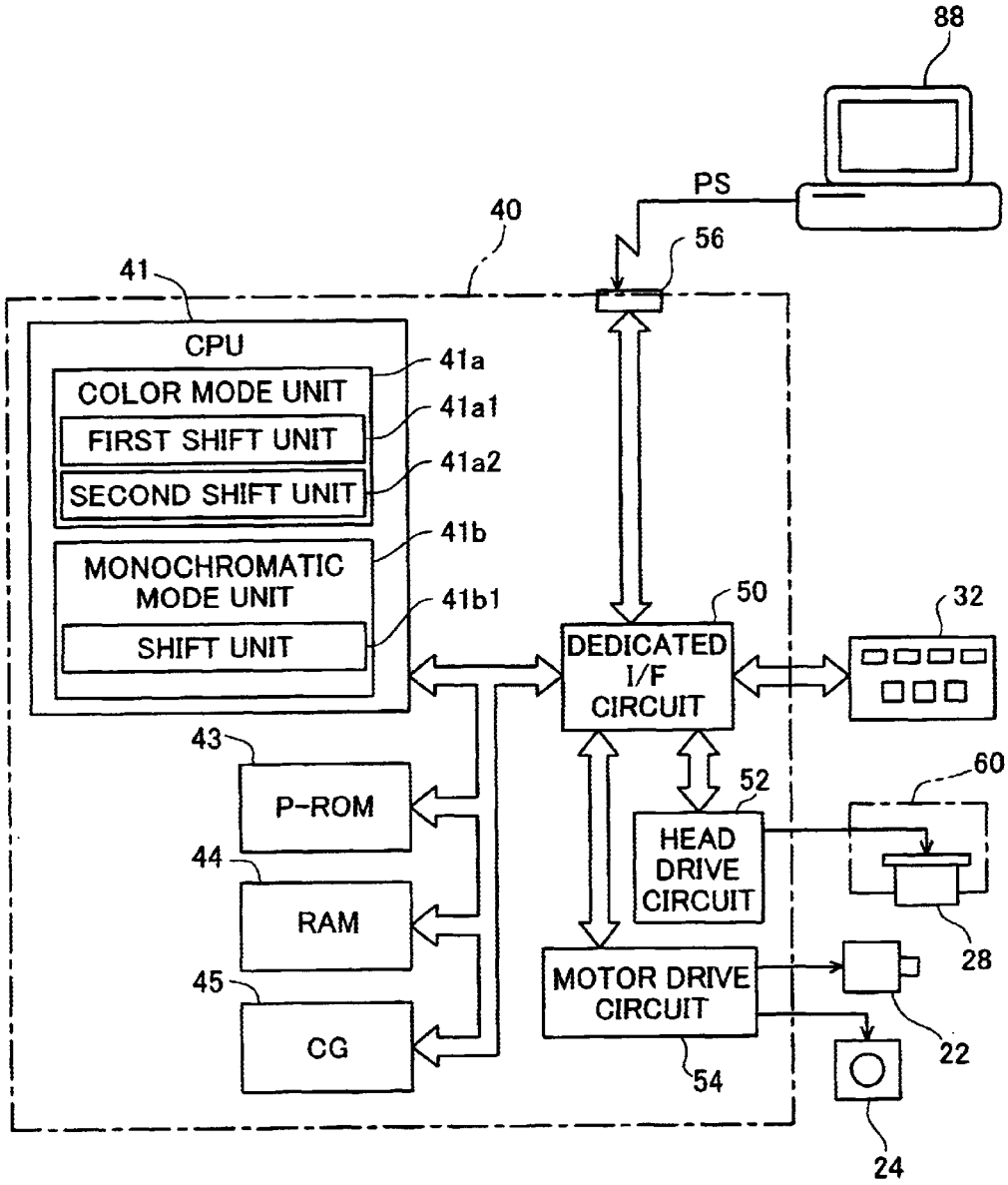
FIG. 2 is a block diagram showing the structure of control circuit 40 of printer 20.

FIG. 2 is a block diagram that shows the structure of a printer 20 with control circuit 40 as its core. Control circuit 40 is formed as an arithmetic logical operation circuit comprising a CPU 41, programmable ROM (PROM) 43, RAM 44, and a character generator (CG) 45 that records the dot matrix of characters. This control circuit 40 further comprises an dedicated interface circuit 50 that performs an interface exclusively with an external motor, a head drive circuit 52 that is connected to this dedicated interface circuit 50, drives the printing head unit 60, and ejects ink, and a motor drive circuit 54 that drives paper feed motor 22 and carriage motor 24. Dedicated interface circuit 50 has a built in parallel interface circuit, and can receive printing signal PS supplied from computer 88 via connector 56. By executing the computer program stored in PROM 42, CPU 41 functions as the color mode unit 41*a* and monochromatic mode unit 41*b* to be described later.

Printing head 28 has a plurality of nozzles n provided in a row for each color, and an actuator circuit 90 that operates the piezo element PE that is provided on each nozzle n. Actuator circuit 90 is part of head drive circuit 52 (see FIG. 2), and performs on/off control of drive signals given from the drive signal generating circuit (not illustrated) within head drive circuit 52. Specifically, actuator circuit 90 latches data that shows on (ink is ejected) or off (ink is not ejected) for each nozzle according to the print signal PS supplied from computer 88, and the drive signal is applied to the piezo element PE only for the nozzles that are on.

Figure 3:
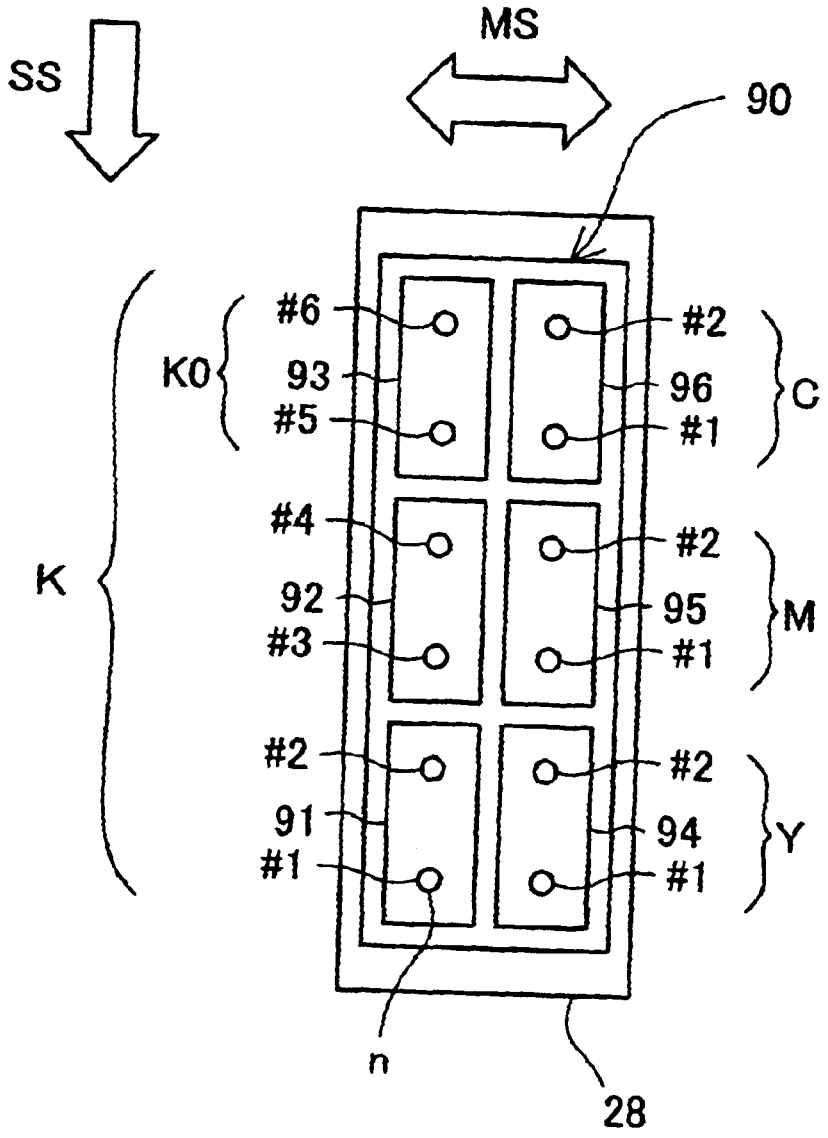
FIG. 3 is an explanatory diagram showing the disposition of nozzles arranged in printing head 28.

FIG. 3 is an explanatory diagram that shows the arrangement of nozzles provided on printing head 28. This printer 20 is a printing apparatus that performs printing using four colors of ink, black (K), cyan (C), magenta (M), and yellow (Y), and two nozzles each are provided for cyan (C), magenta (M), and yellow (Y), while six nozzles are provided for black (K). Nozzles #1 and #2 of cyan (C), magenta (M) and yellow (Y) correlate to the "single chromatic nozzle group" noted in the claims. Nozzles #1 through #6 for black (K) correlate to the "achromatic nozzle group" noted in the claims.

Provided in actuator circuit 90 are actuator chips 91 to 93 which drive black nozzle row K, actuator chip 94 which drives cyan nozzle row C, actuator chip 95 which drives magenta nozzle row M, and actuator chip 96 which drives yellow nozzle row Y.

Printing head 28 slides back and forth along sliding axis 34 in the direction of arrow MS by carriage motor 24. Printing paper P is sent in the arrow SS direction in relation to printing head 28 by paper feed motor 22.

A2. Printing:

(1) Color Mode Printing and Monochromatic Mode Printing:

FIG. 4 is an explanatory diagram that shows recording of the main scan line by unit scan operation during monochromatic mode printing. FIG. 5 is an explanatory diagram that shows recording of the main scan line by unit scan operation during color mode printing. At the left side of each figure the typical nozzle arrangement is shown, and at the right side, the state as the main scan line is recorded by each nozzle is shown. In actuality, printing paper P is transported in relation to the printing head so that the relative position of these two items changes, but here, to make the explanation more simple, the situation is shown as the printing head moving downward in relation to printing paper P. The numbers noted in the squares marked by # show the number of the nozzle that records each main scan line. Also, in this specification, when we explain the recording of each main scan line, the front end direction when printing paper P is sent by paper feed motor 22 is called "upward" and the back end direction is called "downward."

Each row of pixels aligned in the left-right direction shows a main scan line in FIG. 4. The gap between adjacent main scan lines in the vertical direction is D. As can be seen from FIG. 4, the vertical (sub-scan direction) pitch of each nozzle on the printing head is 4×D. In this specification, the gap for adjacent main scan lines is noted as "1 dot." Therefore, the pitch for each nozzle on the printing head is 4 dots. When noting the feed amount of the sub-scan feed as well, the gap between main scan lines is noted in "dot" units as a standard. With the first working example, the nozzle pitch is 4 dots, but nozzle pitch can also be another value such as 6 or 8. Specifically, nozzle pitch k (noted in dot) should be an integer of 2 or greater.

With the printing for the first working example, a unit scan operation is performed by performing the main scan k times and fine feeds (sub-scans) of 1 dot each between each main scan. By doing this unit scan operation, dots are recorded in the band formed by a plurality of adjacent main scan lines in the sub-scan direction. Then, a large feed is performed between one unit scan operation and the next unit scan operation, so that recording is performed on the printing paper in units of main scan line bundle in sequence. With the first working example, as shown in FIGS. 4 and 5, by performing four main scan lines with three repetitions of a one dot feed, one unit scan operation is completed. Note that one main scan is called a "pass."

In FIG. 4, L1 denotes the number of the main scan lines which are recorded when a unit scan operation is performed with all the nozzles in the black nozzle group K, and lie without gaps each other. As shown in FIG. 4, L1 has 24 dots width. The agglomeration of main scan lines recorded by black ink when a unit scan operation is performed using all nozzles of the black nozzle group K are called the "achromatic unit lines," and of these, the bundle of main scan lines aligned with no gap in the sub-scan direction is called an "achromatic unit band." With the first working example, the "achromatic unit lines" is equal to "achromatic unit band". For the monochromatic mode printing which performs the unit scan operation using all the nozzles of the black nozzle group K, when one unit scan operation ends, a sub-scan of 21 main scan lines is performed to do the next unit scan operation. This sub-scan is called the "monochromatic mode sub-scan." The feed amount Sm of the monochromatic mode sub-scan is 21 dots.

The phrase, "using (all) nozzles" means that it is possible to use those nozzles during printing of that mode. Therefore, depending on the contents of the printing data sent, there are in fact cases when that nozzle is not used. Also, when a nozzle that ejects the same color ink passes over a main scan line for which recording of a colored ink has already been performed due to the situation of the sub-scan, there are cases when that nozzle is in fact not used. Note that the printing data includes not only image data but also data such as the estimated pixel pitch data and sub-scan feed amount data. When the word "image" is used in the explanation of the present invention, in addition to pictures, this includes any embodiment subject to recording on the printing medium such as text, symbols, and line drawings.

Meanwhile, for color mode printing, printing is performed using the same number of nozzles for each ink color. Because of this, only two nozzles #5 and #6 are used for the nozzles of black nozzle group K. The black nozzles used for color mode printing are called "special black nozzle group K0."

In FIG. 5, L2 denotes the number of the main scan lines which are recorded by each of single chromatic nozzle groups Y, M, and C and special black nozzle group K0 when a unit scan operation is performed with single chromatic nozzle groups Y, M, and C and special black nozzle group K0, and lie without gaps each other. The bundle of these main scan lines is called "single chromatic unit band". As shown in FIG. 5, L2 has 8 dots width. Although not shown directly in FIG. 5, the same is true for special black nozzle group K0. Furthermore, the cluster of main scan lines that can be recorded without gaps in the sub-scan orientation by a specific black nozzle group K0 in a single unit scan operation is called in particular "the Second Achromatic Unit Band." For color mode printing, after one unit scan line operation ends, before the next unit scan operation is performed, sub-scan is performed by a feed amount of 5 main scan lines. This sub-scan is called the "color mode sub-scan." The color mode sub-scan feed amount Sc is 5 dots.

When we explain with a focus on lines 17 to 24 of FIG. 5, first, with the first unit scan operation, dots are formed at lines 17 to 24 by nozzles #5 and #6 of the special black nozzle group K0 and by cyan nozzle group C. After that, when a color mode sub-scan of 8 main scan lines is performed, magenta dots are recorded by magenta nozzle group M at lines 17 to 24. Then, when the color mode sub-scan is performed for 8 main scan lines, yellow dots are recorded on lines 17 to 24 by yellow nozzle group Y. In this way, black, cyan, magenta, and yellow color dots are formed on lines 17 to 24, thus recording a color image. Recording is performed in sequence by three unit scan operations in the same manner for each main scan line on the printing paper.

In FIG. 5, to make the explanation simpler, there is no display of recording of each main scan line by nozzles #5 and #6 of the special black nozzle group. Recording of each main scan line by these black nozzles #5 and #6 is performed in the same manner as recording of each main scan line by cyan nozzles #1 and #2.

Now we will consider the case when unit scan operation is performed using single chromatic nozzle groups Y, M, and C and special black nozzle group K0, and a color mode sub-scan is performed between each unit scan operation, in other words, the case of color mode printing. For color mode printing, each main scan line for which yellow nozzle group Y recording has ended in a unit scan operation is a main scan line for which printing data recording is completed for all inks KCMY. Specifically, recording of data for the new main scan line is completed every 8 lines for each unit scan operation. This kind of agglomeration of main scan lines for which it is possible to complete new recording by a plurality of single chromatic nozzle groups with a single unit scan operation is called a "color unit line." Of the color unit lines, the main scan lines that are aligned with no gap in the sub-scan direction are called the "color unit band." With the first working example, the "color unit lines" and the "color unit band" match. The width of the color unit band is equal to the width of the single chromatic unit band. Normally, the color unit band matches the single chromatic color band of the single chromatic nozzle group positioned at the highest level.

Color mode printing is executed by color mode unit 41*a*, and monochromatic mode printing is executed by monochromatic mode unit 41*b* (see FIG. 2).

Figure 6:
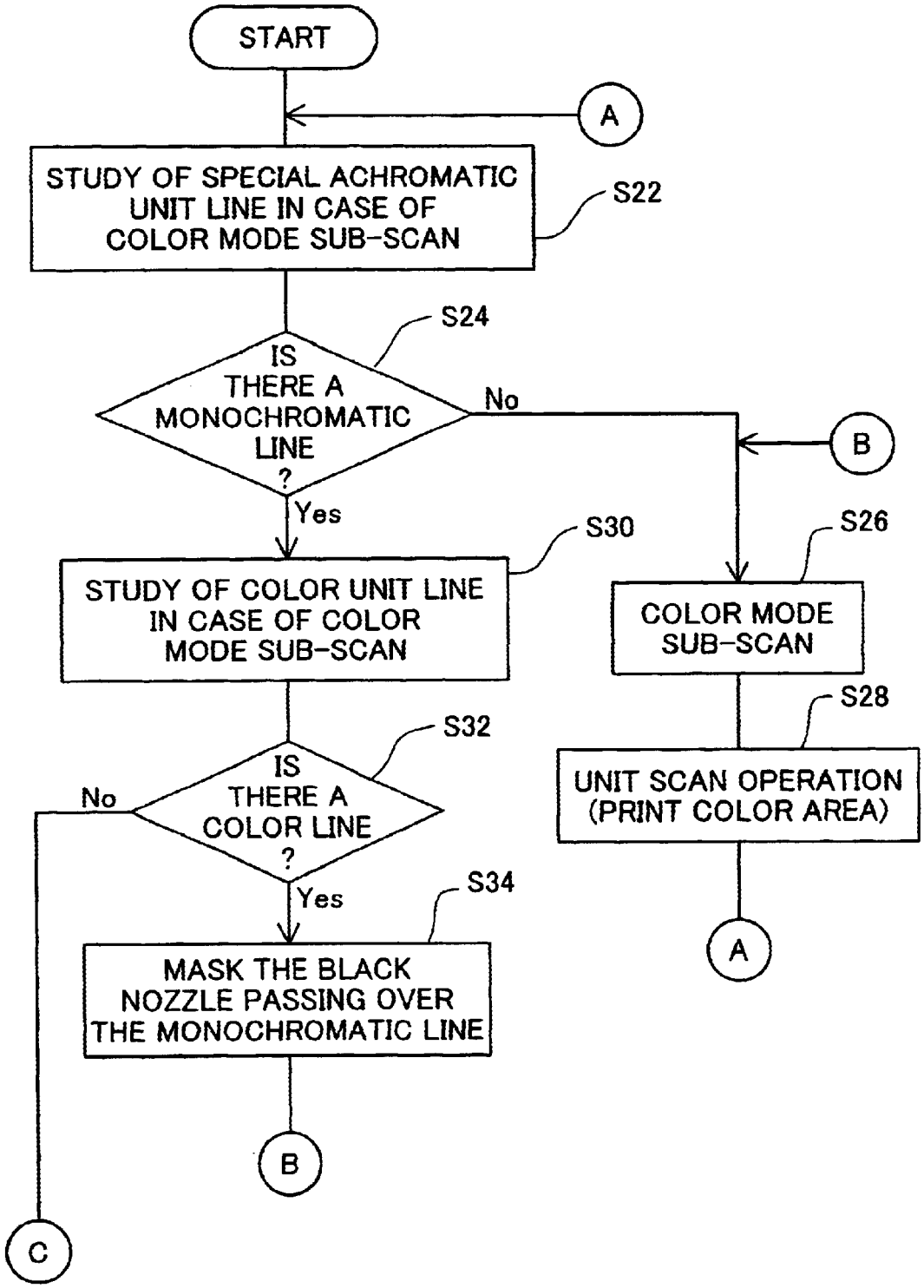
FIG. 6 is a flowchart showing a process for color mode printing.
Figure 7:
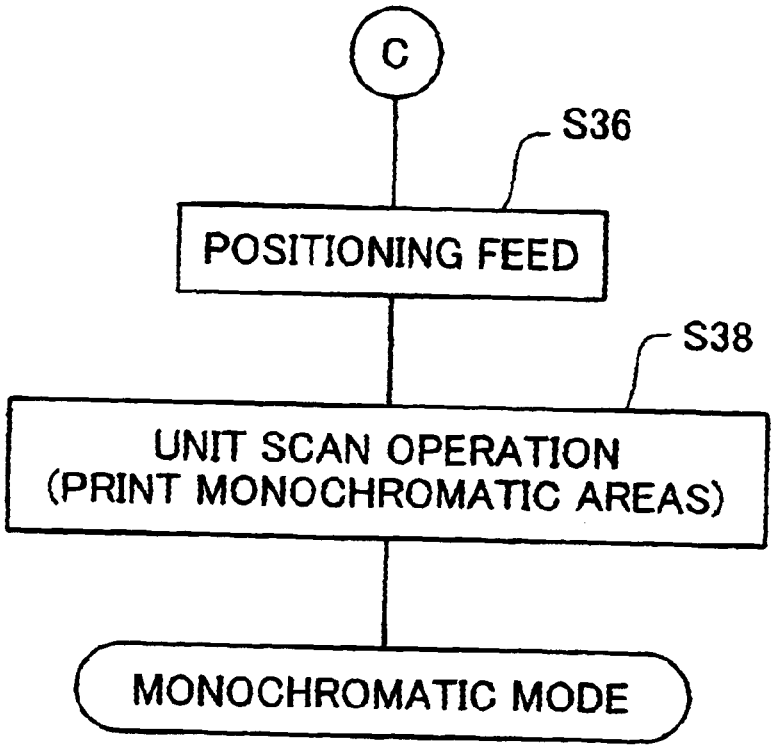
FIG. 7 is a flowchart showing a process for color mode printing.
Figure 8:
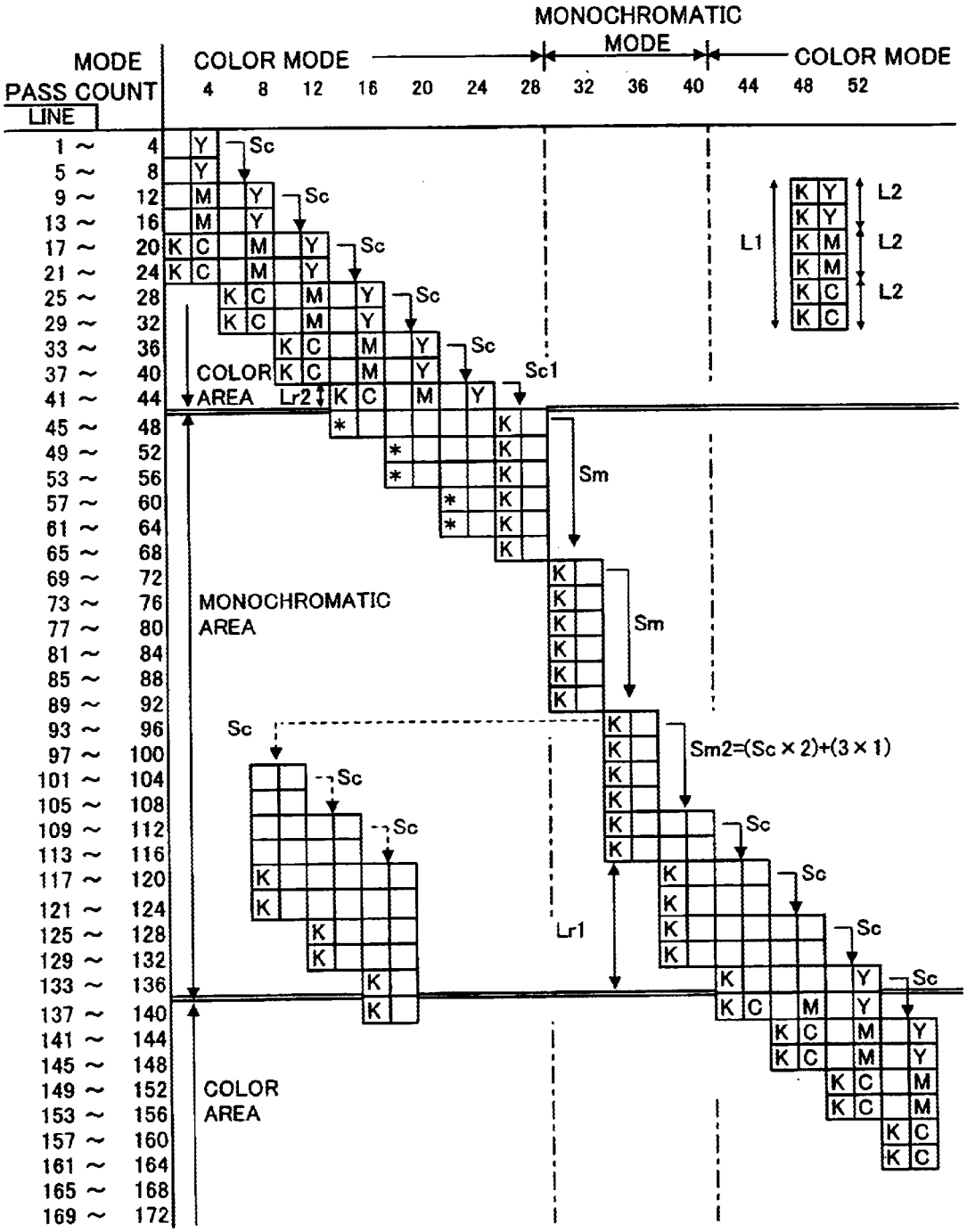
FIG. 8 is an explanatory diagram showing how to record image data containing color areas and monochromatic areas.

(2) Shift 1 from Color Mode Printing to Monochromatic Mode Printing:

FIGS. 6 and 7 are flow charts that show the processes for color mode printing. FIG. 8 is an explanatory diagram that shows how image data including color areas and monochromatic areas is recorded. Image data to be printed includes chromatic areas and achromatic areas. As a result, there are color areas and monochromatic areas on the printing paper on which the image is to be printed that correspond respectively to the chromatic areas and achromatic areas of the image data. Color areas are areas that are recorded using at least chromatic ink. With the first working example, black ink is also used for recording the color areas. Monochromatic areas are areas for which recording is done using only achromatic ink. With the first working example, only black ink is used for recording the monochromatic areas.

In FIG. 8, main scan lines (4 lines in this case) recorded by one nozzle with a single unit scan operation are shown typically aligned in one row of squares in the horizontal direction. For example, the topmost row shows lines 1 to 4 recorded by yellow nozzle #1 with the first unit scan operation. Then, in the example in FIG. 8, lines 45 to 136 are a monochromatic area, and lines above line 44 and lines below line 137 are color areas. Also, in FIG. 8, as shown in the upper right of the figure, the printing head that executes the unit scan operation is typically shown in 2 rows×6 lines of squares. One row corresponds to an actual nozzle row (see FIGS. 4 and 5), and the area that correlates to the width of 4 main scan lines recorded by one unit scan operation by each nozzle is shown by one line. The K, C, M, and Y in each square show the color of ink ejected by each nozzle. In actuality, printing paper P is transported in relation to the printing head so that the relative position of these two items changes, but here, to make the explanation more simple in FIG. 8, the printing head shown by 2 rows×6 lines of squares is shown as being moved downward in relation to printing paper P. Then, for nozzles not actually used for each main scan line, a K, C, M, or Y is not noted in the square corresponding to each nozzle.

In Step S22 of FIG. 6, which relates to color mode printing, when assuming that next a color mode sub-scan is executed and a unit scan operation has been performed, a check is performed to see what kind of main scan lines are included in the main scan lines to be recorded by special black nozzle group K0 (called "specific achromatic unit lines"). If the result is that there are no monochromatic lines (called main scan lines included in the monochromatic area; this applies below) in Step S24, then the color mode sub-scan will be performed in Step S26, and the unit scan operation will be performed in Step S28 using 2 nozzles for each color. In the example shown in FIG. 8, the printing up through the 12th pass is executed according to this routine.

In color mode printing, if monochromatic lines are included in the unit lines or unit bands to be recorded by the execution of a sub-scan investigated to be executed next and the subsequent unit scan operation, the lower main scan lines of the investigated unit lines or unit bands are thought of as being positioned in a monochromatic area. If no monochromatic lines are included in these unit lines and unit bands, the lower main scan lines of the unit lines or unit bands are thought of as being positioned in a color area.

On the other hand, when it is determined in Step S24 that monochromatic lines are present, in Step S30, an investigation is made to see what kind of main scan lines are in the color unit lines when it is assumed that there will next be executed a color mode sub-scan and then a unit scan operation. If the result given in Step S32 is that color lines (this refers to the main scan lines that are included in a color area; this applies below as well) are present, then in Step S34 those nozzles of the special black nozzle group K0 that pass above the monochromatic lines will be masked. Then, transitioning to Step S26, a sub-scan for the color mode is executed, and in Step S28 a unit scan operation is performed. This routine is followed for passes 13 through 24 in the example shown in FIG. 8. In the figure, the nozzles marked with an asterisk (*) are those nozzles that have been masked in Step S34. Note that this type of transition processing from color mode printing to monochromatic mode printing is executed by first shift unit 41*a*1 of color mode unit 41*a* (refer to FIG. 2).

If in Step S32, the result is returned that there are no color lines in the next color unit line, a positioning feed is executed in Step S36 of FIG. 7. This positioning feed is conducted so that, assuming that the unit scan operation using all the nozzles of the black nozzle group has been executed, the uppermost main scan line of the first achromatic unit band is in a relative position such that it matches the uppermost main scan line of the monochromatic area. Then a switch is made to the monochromatic mode, with a unit scan operation being executed in Step S38 using all the nozzles of the black nozzle group. In the example shown in FIG. 8, the sub-scanning feed that follows the 24th pass is the positioning feed that occurs in Step S36. In the example shown in FIG. 8, the feed amount Sc1 for the positioning feed is 4 dots. The unit scan operation, including passes 24–28, is the unit scan operation that occurs in Step S38. The processing for the switch from color mode printing to monochromatic mode printing is executed by second shift unit 41*a*2 of color mode unit 41*a* (refer to FIG. 2).

More specifically, in color mode printing, Steps S26 through S28 are repeated to execute the color mode printing only when color area main scan lines are included in the color unit lines when the next color mode sub-scan is executed. At this time, when nozzles of the special black nozzle group K0 are in a monochromatic area, those nozzles are masked (Step S34), so no main scan lines are recorded on the monochromatic area. In the example shown in FIG. 8, the black nozzles pass above lines 45–64, but since these black nozzles have been masked, they do not record lines 45–64.

When the result is returned that no main scan lines are included in a color area in case that a sub-scan is executed for the next color mode (Step S32 of FIG. 6), a positioning feed is executed (Step S36). In the example shown in FIG. 8, the achromatic unit lines and the first achromatic unit band match, so a sub-scan is executed so that the uppermost nozzle of black nozzle group K is positioned on the 45th line, which is the upper edge of the monochromatic area. A unit scan operation is then conducted using all the nozzles in the black nozzle group K (Step S38), and then monochromatic mode printing is executed.

This type of arrangement makes it possible to reduce the number of times that the color mode sub-scan, the monochromatic mode sub-scan, and the positioning feed need to be executed when recording the portion of the upper border of the monochromatic area that touches the color area. For example, in FIG. 8, when lines 45–64 are recorded by those nozzles marked by an asterisk (*) on the thirteenth through twenty-fourth passes, lines 45–64 in the monochromatic area can be recorded with 3 unit scan operations with 2 intervening color mode sub-scans between them. In contrast, in the arrangement for First working example, lines 45–64 were recorded by a one-time unit scan operation on passes 24–28. The feed amount for the color mode sub-scan, monochromatic mode sub-scan, and positioning feed is larger than the minute feed (refer to FIGS. 4 and 5) executed during the unit scan operation; therefore there is more possibility that the quality of the printed results will be lower in proportion to the number of such feeds during the printing of the same areas. It was possible to reduce the number of feeds in First working example, so it was accordingly possible to improve the quality of printed results in those regions of the monochromatic areas that border on color areas, where the upper edge touches the color area.

Figure 9:
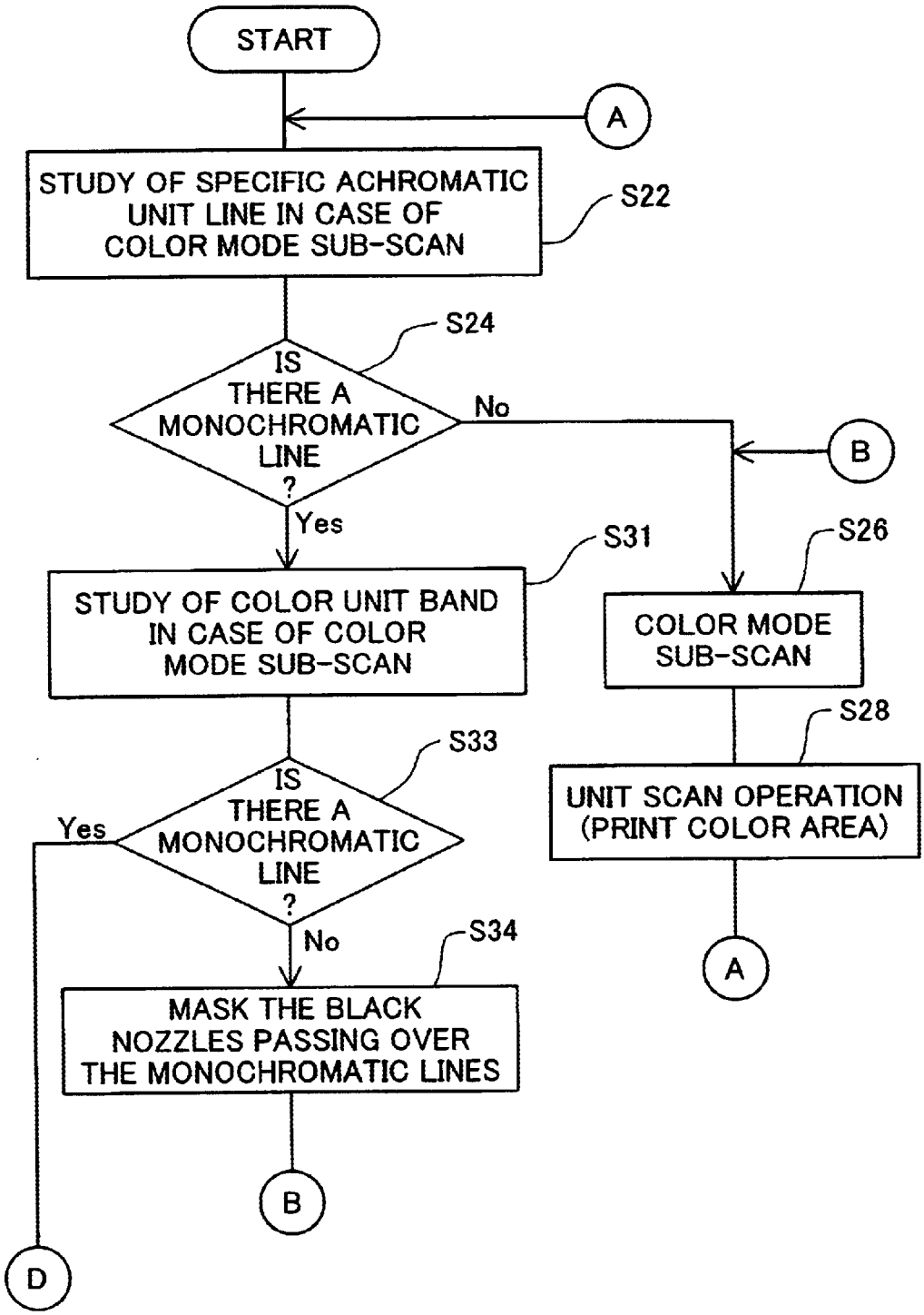
FIG. 9 is a flowchart showing a process for monochromatic mode printing.
Figure 10:
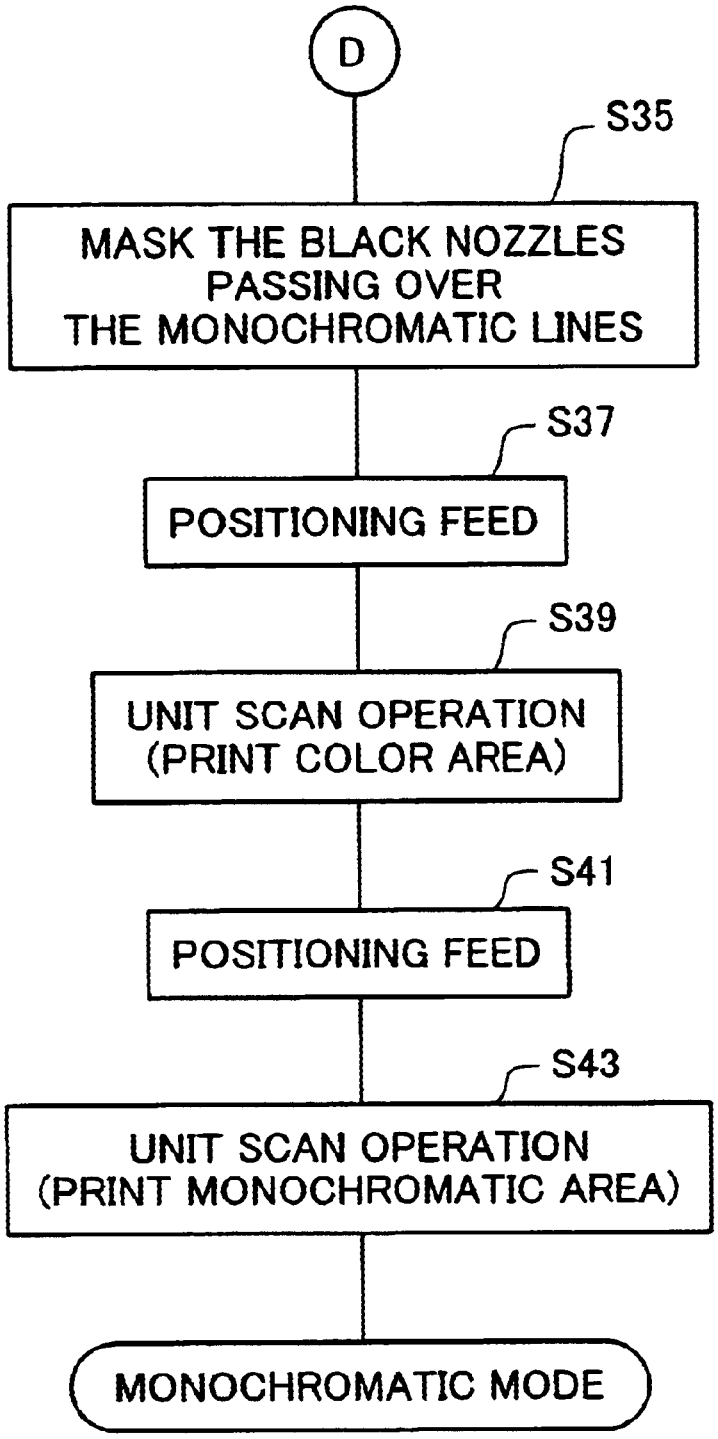
FIG. 10 is a flowchart showing a process for monochromatic mode printing.
Figure 11:
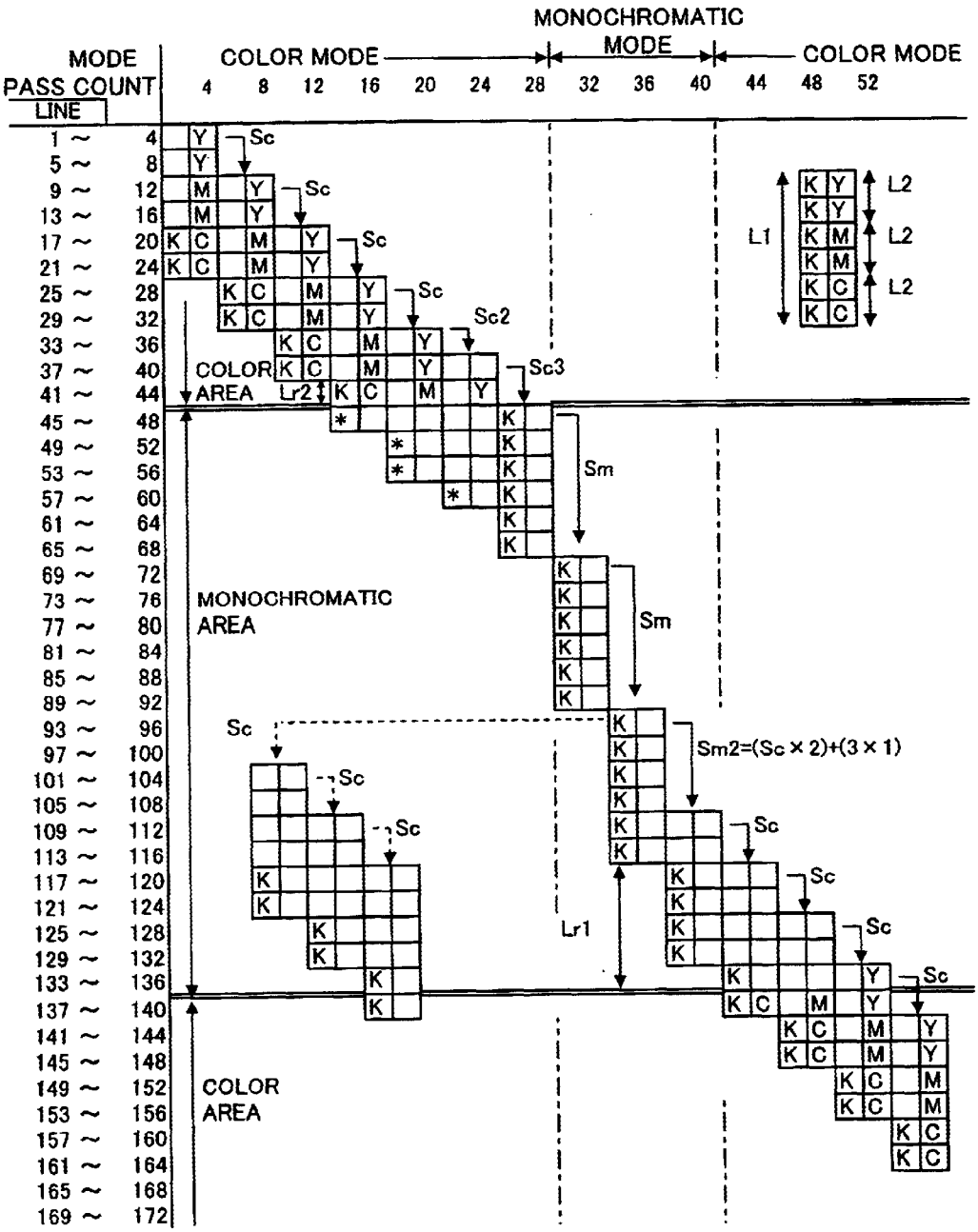
FIG. 11 is an explanatory diagram showing another example of how to record image data that includes color areas and monochromatic areas.

(3) Shift 2 from Color Mode Printing to Monochromatic Mode Printing:

FIGS. 9 and 10 are flowcharts shown examples of other processes for color mode printing. FIG. 11 is an explanatory diagram showing another example of how to record image data that includes color areas and monochromatic areas. The flowcharts of FIGS. 9 and 10 differ from the flowcharts of FIGS. 6 and 7 in the process that occurs in Step S24 when there are monochromatic lines in the prescribed achromatic unit lines. Other points are identical to the flowcharts of FIGS. 6 and 7. In Step S24, when there are monochromatic lines, in Step S31, an investigation is made of what kind of main scan lines are included in the color unit band in case that a color mode sub-scan and then a unit scan operation are conducted. If the result is that there are no monochromatic lines in Step S33, then in Step S34 those nozzles of the special black nozzle group K0 that pass above the monochromatic lines will be masked. The processes that occur in Step S34 and thereafter are identical to those shown in the flowcharts of FIGS. 6 and 7. In the example shown in FIG. 11, this routine is following while executing the printing operations from passes 13 through 20. The printing performed from passes 13 through 20 is identical to that performed in FIG. 8.

On the other hand, if in Step S33 it is determined that there are monochromatic lines, that is, if when the next color mode sub-scan is executed and the result is returned that the main scan lines of the color unit band to be executed contain main scan lines in a monochromatic area, then in Step S35 of FIG. 10 those nozzles of the special black nozzle group K0 that pass above the monochromatic lines will be masked. Then a positioning feed is executed in Step S37. Because of the positioning feed, the lowermost main scan line of the color unit band when the unit scan operation is executed once will match the lower main scan line of the color area. Then, in Step S39, a unit scan operation is executed using each single chromatic nozzle group. In the example shown in FIG. 11, the sub-scanning feed that occurs after the twentieth pass is the positioning feed that is conducted in Step S37. In FIG. 11, the feed amount for the positioning feed is 1 dot. The unit scan operation containing passes 21–24 is the unit scan operation that occurs in Step S39.

Subsequently another positioning feed is executed in Step S41. This positioning feed is performed so that the uppermost main scan line of the next first achromatic unit band matches the uppermost main scan line of the monochromatic area. Then, in Step S43, the unit scan operation is executed using all of the nozzles in the black nozzle group K. Then the process switches to monochromatic mode printing. In the example shown in FIG. 11, the sub-scanning feed for the twenty-fourth pass is the positioning feed that occurs in Step S41. In FIG. 11, the feed amount Sc3 of the positioning feed is 5 dots, and the unit scan operation including passes 25 through 28 is corresponds to the unit scan operation that occurs in Step S43. This type of transition processing from color mode printing to monochromatic mode printing is executed by the second shift unit 41*a*2 of the color mode unit 41*a* (refer to FIG. 2). In this type of arrangement it is possible to reduce the number of color mode sub-scans and positioning feeds, which makes it possible to improve printing quality.

Figure 12:
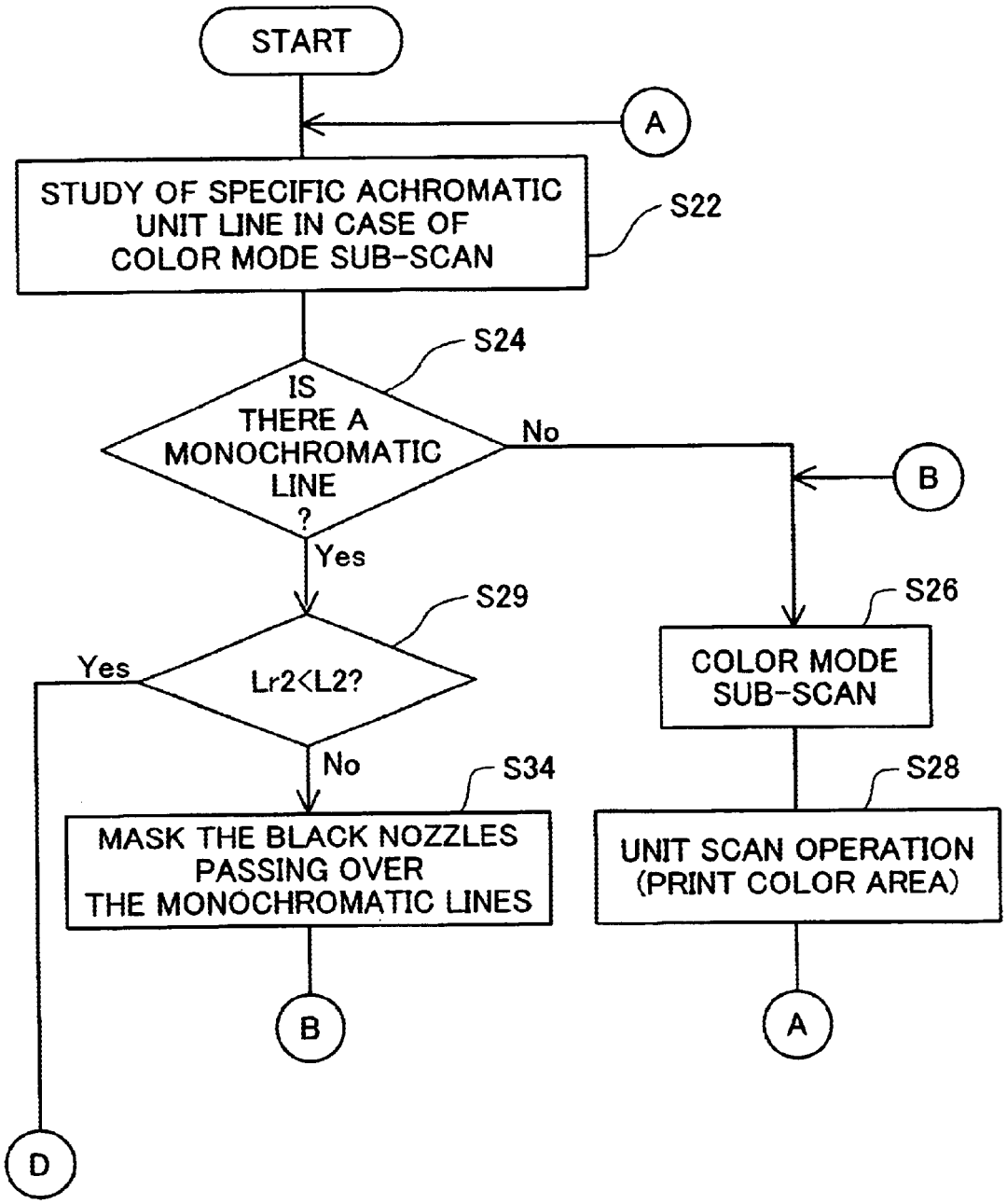
FIG. 12 is a flowchart showing an example of another process for color mode printing.

(4) Shift 3 from Color Mode Printing to Monochromatic Mode Printing:

FIG. 12 is a flowchart showing an example of another process for color mode printing. In FIG. 12, Step S29 is executed instead of Steps S31 and S33 of FIG. 9. All other points are identical to the flowchart of FIG. 9. The process for monochromatic mode printing can be performed as follows.

In Step S24, when it is determined that there are monochromatic lines in the specific achromatic unit lines, in case that the color mode sub-scan is executed, the next thing to be investigated is whether the number Lr2 of remaining color area main scan lines is less than the number L2 of main scan lines for the single chromatic unit band. The "remaining color areas" are those areas in the color area for which main scan lines have not yet been recorded. In the example shown in FIG. 11, once the twentieth pass has been completed, there are monochromatic lines in the specific achromatic unit band in case of the next color mode sub-scan (Step S24). Accordingly, at the time when the twentieth pass has been completed, lines 41 through 44 that have not yet been finished recording (they have not been recorded with yellow nozzle group as the uppermost nozzle group) by the time, and these are the remaining color lines.

If, in Step S29, the number Lr2 of remaining color area main scan lines is less than the number L2 of main scan lines for the color unit band, Steps S35 through S43 of FIG. 10 are executed, and a transition is made to monochromatic mode printing. If, in Step S29, the number Lr2 of remaining color area main scan lines is greater than L2, in Step S34 those nozzles of the special black nozzle group K0 that pass above the monochromatic lines will be masked. The processes after Step S34 are identical to those of the flowcharts in FIGS. 6 and 7.

Even for this type of process, printing can be executed appropriately as shown in FIG. 11. And, if this type of process is used, it is possible to switch from color mode printing to monochromatic mode printing by a simpler process. For the purpose of comparison, the upper right of FIG. 11 shows the number L1 of main scan lines of the first achromatic unit band and the number L2 of main scan lines for the single chromatic unit band for each single chromatic nozzle group.

Figure 13:
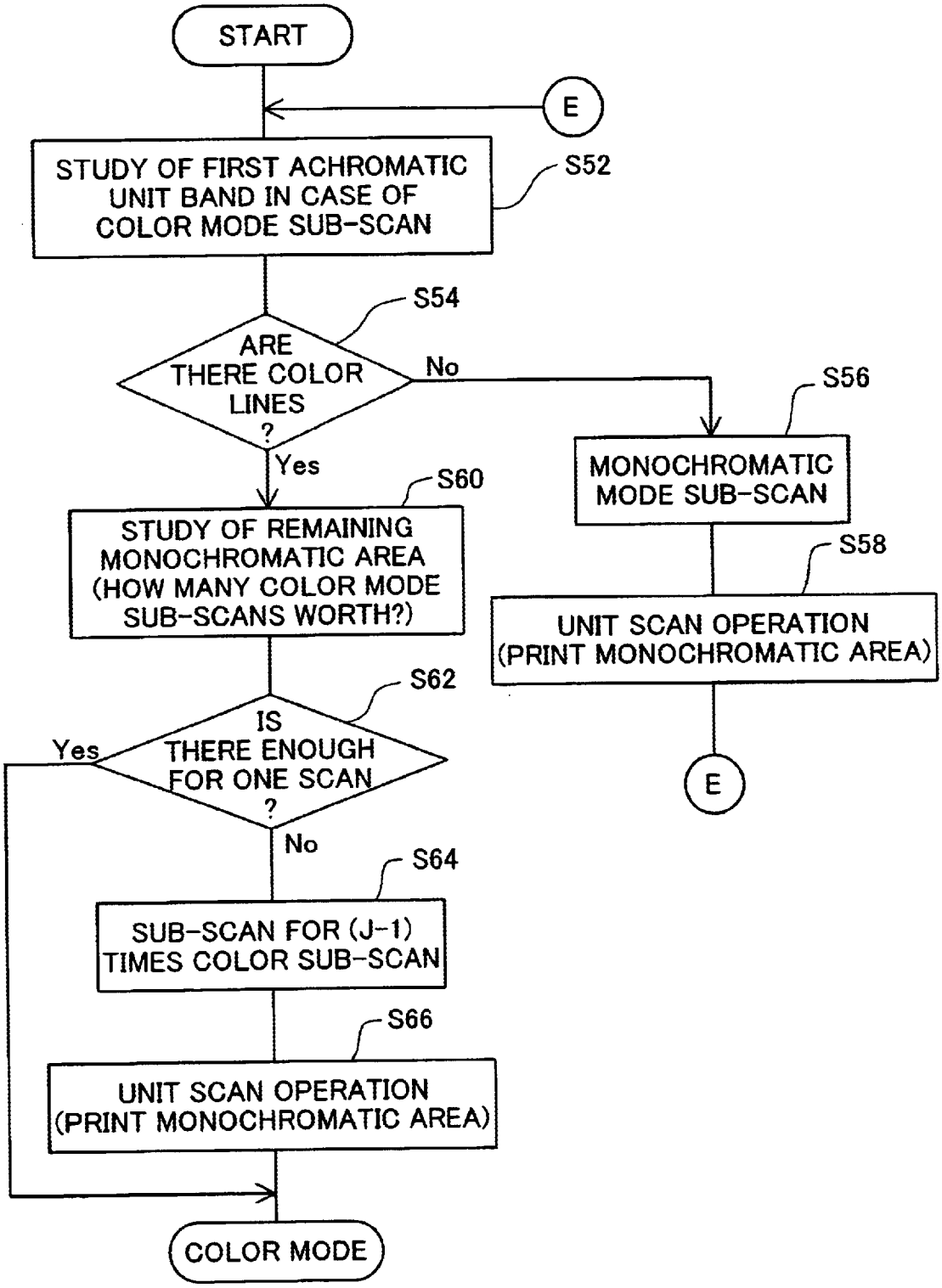
FIG. 13 is a flowchart showing a process for monochromatic mode printing.

(5) Shift 1 from Monochromatic Mode Printing to Color Mode Printing:

FIG. 13 is a flow chart that shows the processing for monochromatic mode printing. In monochromatic mode printing, at step S52, the problem is studied what kind of main scan lines are contained in the first achromatic unit band when it is assumed that a monochromatic mode sub-scan is performed next. As a result, when it is determined that there are no color lines at step S54, a monochromatic mode sub-scan is performed at step S56, and a unit scan operation is performed using all the nozzles of black nozzle group K at step S58. After that, the process returns to step S52. In FIG. 8, printing up to pass 36 after the sub-scan performed after pass 28 is executed according to this routine.

Specifically, in monochromatic mode printing, as long as no main scan lines of color area are contained in the first achromatic unit band when the monochromatic mode sub-scan is performed next, steps S56 and S58 are repeated, and monochromatic mode printing is executed.

In monochromatic mode printing, when color line is contained in the unit line or unit band recorded by executing the sub-scan studied as the next item to be performed and the unit scan operation executed thereafter, it is considered that the main scan line of the lower edge of the studied unit line or unit band is positioned in a color area. Then, when color line is not contained in that kind of unit line or unit band, the main scan line of the lower edge of the unit line or unit band is considered to be positioned in a monochromatic area.

If the result returned in Step S54 is that there are color lines, then in Step S60 investigation is made of the extent of the specific area in the monochromatic area where main scan lines are present in which recording is not yet complete. The specific area is referred to as the "remaining monochromatic area". More specifically, assuming that a color mode sub-scan and subsequent one unit scan operation are to be executed J times (where J is an integer of 1 or greater), an investigation is made to see how many times J the color mode sub-scan and the unit scan operation must be performed before the position of the lowermost main scan line of the cluster of main scan lines that can be recorded without a gap in a single unit scan operation by the prescribed black nozzle group in the sub-scan direction (second achromatic unit band) is first in a color area. In other words, assuming that a sub-scan having a feed amount equal to a sum of J times the feed amount of the color mode sub-scan and (J−1) times the feed amount of the set of the sub-scans performed in one unit scan operation is to be performed, and also assuming one unit scan operation is to be performed, an investigation is made to see how many times J the color mode sub-scan and (J−1) the set of unit scan operations should be performed in order for the lowermost main scan line of the second achromatic unit band to first be positioned in a color area. In the example shown in FIG. 8, as shown in the lower left, once the thirty-sixth pass has been completed, the lower edge of the second achromatic unit band is first positioned in a color area after the color mode sub-scan and unit scan operation have been executed 3 times.

In Step S62, an investigation is made of whether the lower edge of the second achromatic unit band will reach a color area after just one pair of color mode sub-scan and unit scan operation. If the number of the pair of sub-scan and unit scan operation J that must be performed before the lower edge of the second achromatic unit band reaches a color area is 2 or greater, then a sub-scan whose feed amount is equal to a sum of (J−1) times the feed amount of the color mode sub-scan and (J−2) times the total feed amount of sub-scans performed in one unit operation is executed in Step S64. Then, in Step S66, a unit scan operation is executed using all of the nozzles in the black nozzle group. Then a transition is made to the color mode. In the example shown in FIG. 8, the sub-scan that occurs after the thirty-sixth pass is the sub-scan that is executed in Step S64. Here the feed amount Sm2 for the sub-scan is equal to the sum of 2 times the color mode sub-scan feed amount and 1 time the total feed amount of sub-scans performed in one unit scan operation, 3 dots. The unit scan operation that includes Steps 37–40 corresponds to the unit scan operation that occurs in Step S66. Note that, in the example shown in FIG. 8, lines 109 through 116 have already been recorded by the thirty-sixth pass, so actually the upper two nozzles of black nozzle group K are not used. Also, this type of transition processing from the monochromatic mode printing to color mode printing is executed by shift unit 41*b*1 of monochromatic mode unit 41*b* (refer to FIG. 2).

Figure 14:
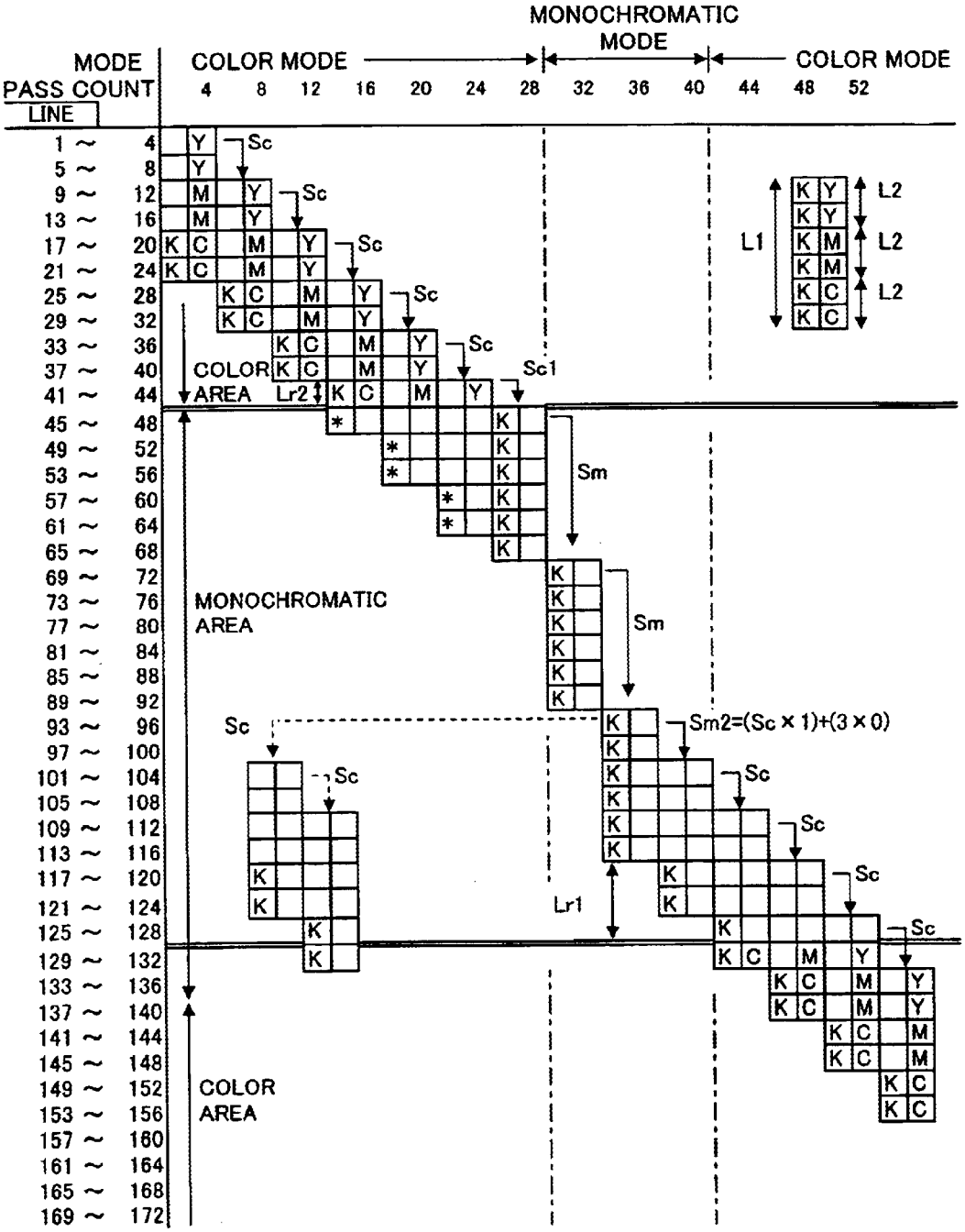
FIG. 14 is an explanatory diagram showing how to record image data that includes color areas and monochromatic areas.

FIG. 14 is an explanatory diagram showing how to record image data that includes color areas and monochromatic areas. In FIG. 14, the color area extends from line 129 to the bottom. The other points are identical to FIG. 8. As shown in FIG. 14, once the thirty-sixth pass has been completed, if the lower edge of the second achromatic unit band reaches a color area after two sub-scans have been executed, the feed amount Sm2 of the sub-scan executed in Step S64 (refer to FIG. 13), which is executed after the thirty-sixth pass, equals to a sum of 1 time the feed amount Sc of the color mode sub-scan and 0 time a total feed amount of sub-scans performed in one unit scan operation.

Figure 15:
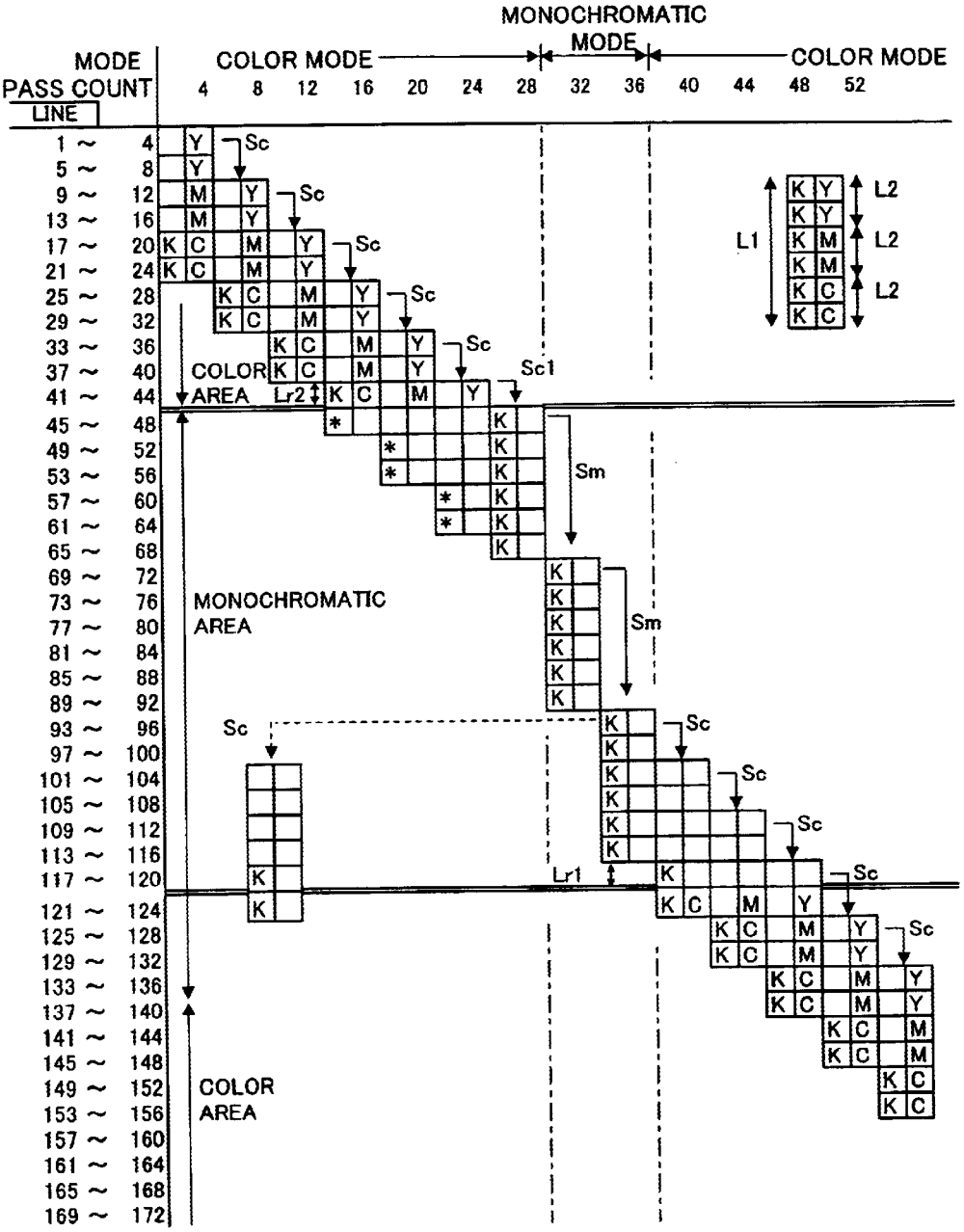
FIG. 15 is an explanatory diagram showing how to record image data that includes color areas and monochromatic areas.

FIG. 15 is an explanatory diagram showing how to record image data that includes color areas and monochromatic areas. In FIG. 15 the color area extends from line 121 to the bottom. Other points are identical to FIG. 8. As shown in FIG. 15, after the thirty-sixth pass, if the lower edge of the second achromatic unit band reaches a color area after one sub-scan has been executed, a transition is made to the color mode directly from Step S62 of FIG. 13.

In First working example, a positioning feed is executed in Step S64, and then a unit scan operation is executed using all of the nozzles in the black nozzle group K. This makes it possible to reduce the number of times that the color mode sub-scan, the monochromatic mode sub-scan, and the positioning feed are executed when recording the portion on the lower edge of a monochromatic area that touches a color area. For example, in FIG. 8, when a transition is made to the color mood directly after the thirty-sixth pass, lines 117 through 132 are recorded by 3 unit scan operations with 2 intervening color mode sub-scans between them. In contrast, in the arrangement for First working example, recording was done in a single unit scan operation on passes 37 through 40. Accordingly, print quality is high in the border sections of the monochromatic area where the lower part of the monochromatic area touches the color area.

Figure 16:
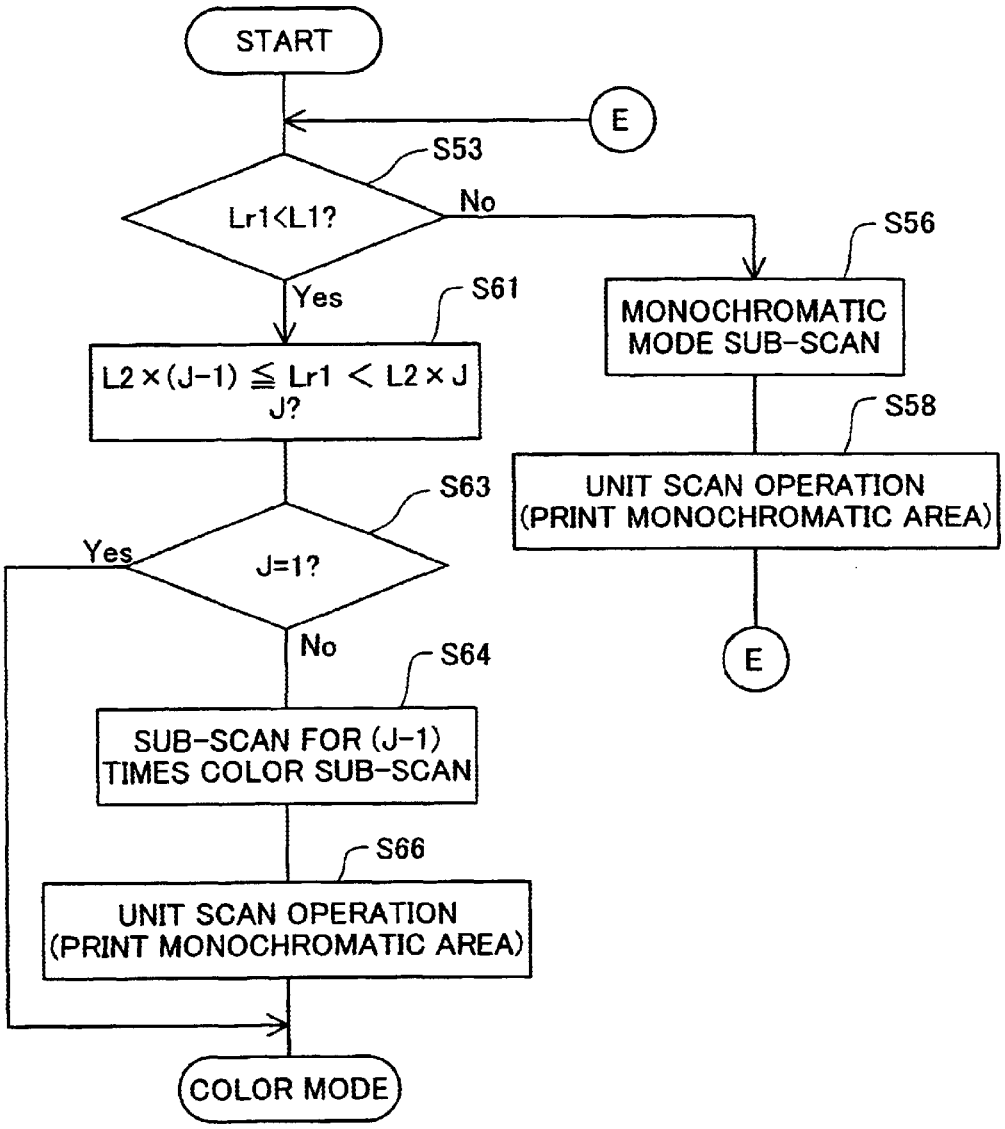
FIG. 16 is a flowchart showing an example of another process for monochromatic mode printing.

(6) Shift 2 from Monochromatic Mode Printing to Color Mode Printing:

FIG. 16 is a flow chart that shows an example of other processing of monochromatic mode printing. In the flow chart shown in FIG. 16, step S53 is executed in place of steps S52 and S54 of FIG. 13, and steps S61 and S63 are executed in place of steps S60 and S62 of FIG. 13. In other regards, the process is the same as the flow chart shown in FIG. 13. It is also possible to have the processing for monochromatic mode printing be as follows.

First, at step S53, the count Lr1 of the main scan lines of the remaining monochromatic area is compared with the count L1 of the main scan lines of the achromatic unit band. The remaining monochromatic area consists of the main scan lines of the currently recording monochromatic areas and also the main scan lines for which recording is not completed. When the count Lr1 of the main scan lines of the remaining monochromatic areas is equal to or greater than count L1 of the main scan lines of the first achromatic unit band, steps S56 and S58 are executed, and monochromatic mode printing is executed.

In Step S53, if the number of main scan lines Lr1 of the remaining monochromatic area is less than the number L1 of main scan lines of the first achromatic unit band, in Step 61 the integer J is determined such that the number of main scan lines Lr1 of the remaining monochromatic area is less than J times and is equal to or greater than (J−1) times L2, the number of main scan lines in the single monochromatic unit band. Then in Step S63, if J is 1, it will switch to the color mode as is; but if J is 2 or greater, it will switch to the color mode after positioning feed in Step S64 and main scan operation in Step 66.

Even when this kind of processing is performed, printing such as that shown in FIGS. 8, 14 and 15 is performed as appropriate. If this kind of processing is used, it is possible to shift from monochromatic mode printing to color mode printing with simpler processing. For comparison purposes, count L1 of the main scan lines of the first achromatic unit band and count L2 of the main scan lines of the single chromatic unit band of each single chromatic nozzle group are shown in the upper right of FIGS. 8, 14 and 15.

B. SECOND WORKING EXAMPLE (1) Color Mode Printing and Monochromatic Mode Printing:

FIGS. 17 and 18 are explanatory diagrams that show the printer nozzle arrangement and the recording of main scan lines by the unit scan operation for a second working example. For the printer of the second working example as well, the nozzles provided on the printing head are arranged at a pitch k of 4 in the sub-scan direction. However, for the printer of the second working example, black nozzle group K has 15 nozzles aligned in a row in the sub-scan direction. The single chromatic nozzle groups C, M, and Y each have 5 nozzles aligned in a row in the sub-scan direction. Then, of the black nozzle group K, special black nozzle group K0 used for color mode printing consists of nozzles #11 to #15. In other regards, this printer is the same as the printer for the first working example. For the second working example, as shown in FIGS. 17 and 18, one unit scan operation is completed by three repetitions of a 3-dot feed and by performing four main scans. In this way, by using the 3 dot feed amount which is disjoint with a nozzle pitch of 4 dots, it is possible to record the main scan lines without gaps by repeating the unit scan operation. This 3-dot feed amount that is performed within a unit scan operation is the "first feed amount" mentioned in the claims.

With the second working example, to perform a 3-dot feed, the main scan lines recorded by a unit scan operation are not all adjacently in contact with each other. To explain the example shown in FIG. 17, line 1, lines 4 and 5, and line 7 are recorded with one unit scan operation, but lines 2 and 3 between line 1 and line 4 are not recorded by that unit scan operation. Line 6 which is between line 5 and line 7 is also not recorded by that unit scan operation. Because of this, with the second working example, the achromatic unit lines are the 60 main scan lines from lines 1 to 66 in FIG. 17, but the first achromatic unit band is the 54 main scan lines among these from lines 7 to 60. Thus, the count L1 of the main scan lines of the first achromatic unit band recorded by black nozzle group K is 54 lines. Then, the main scan lines that are recorded by the same unit scan operation as that first achromatic unit band exist between the top side and bottom side of the first achromatic unit band, sandwiching the main scan lines not recorded by that unit scan operation. These main scan lines are also included in the achromatic unit lines.

In FIG. 17, at pass 4 which is the final pass of the unit scan operation, nozzle #1 is positioned at line 10. In monochromatic mode printing, with pass 5 which is the first pass of the next unit scan operation, nozzle #1 comes to the position of line 61 which was not recorded by the previous unit scan operation. Specifically, feed amount Sm of the monochromatic mode sub-scan is 51 dots. This monochromatic mode sub-scan is performed such that the nozzle of the top edge of black nozzle group K is positioned at the main scan line (line 61) one below the lower edge main scan line (line 60 in FIG. 17) of the bundle of main scan lines that are aligned without a gap in the sub-scan direction and that are the bundle of main scan lines recorded by the immediately preceding unit scan operation. By performing this kind of monochromatic mode sub-scan, each main scan line is recorded without a gap with monochromatic mode printing.

In this way, if the feed amount of the sub-scan performed for the unit scan operation is 2 dots or greater, a portion of the main scan lines recorded by each unit scan operation are positioned alternating with each other. For example, with the example shown in FIG. 17, lines 62, 63, and 66 are recorded with the first unit scan operation, while lines 60, 61, 64, and 65 sandwiched between these are recorded with the next unit scan operation. Because of this, the boundary line between first achromatic unit bands recorded by the unit scan operations is not very visible, and the quality of the printing results is higher. This is also the same for the case of the color mode printing shown in FIG. 18. The same is also true for the boundary line of the first achromatic unit band and the color unit band.

We can think in the same way about the other single chromatic nozzle groups C, M, and Y and the special black nozzle group K0 used for color mode printing. Specifically, to explain the example of the yellow nozzle group in FIG. 18, the main scan lines recorded by nozzles #1 to #5 of the yellow nozzle group with one unit scan operation are 20 main scan lines from line 1 to line 26, but the main scan lines that are recorded without a gap in the sub-scan direction are the 14 main scan lines of these from line 7 to line 20. Specifically, the count L2 of the main scan lines of the single chromatic unit band of the single chromatic nozzle groups Y, M, and C is 14 lines for each. The same thought as for cyan nozzle group C can be applied for the special black nozzle group K0. Then, the main scan line count for the color unit band is also 14 lines. In comparison to this, the main scan line count for the color unit lines is 20 lines.

To explain using FIG. 18 for reference, with the color mode sub-scan performed after pass 4, yellow nozzle #1 is sent from the line 10 position to the line 21 position. Specifically, feed amount Sc of the color mode sub-scan is 11 dots. The color mode sub-scan is performed such that the nozzle positioned at the top of the nozzles of the plurality of single chromatic nozzle group (nozzle #1 of the yellow nozzle group) is positioned at the main scan line (line 21) one below the lower edge main scan line (line 20 of FIG. 18) of the bundle of main scan lines aligned without a gap in the sub-scan direction which is the bundle of main scan lines for which recording is completed with the immediately prior unit scan operation. By performing this kind of color mode sub-scan, the main scan lines are recorded without a gap with color mode printing.

Figure 19:
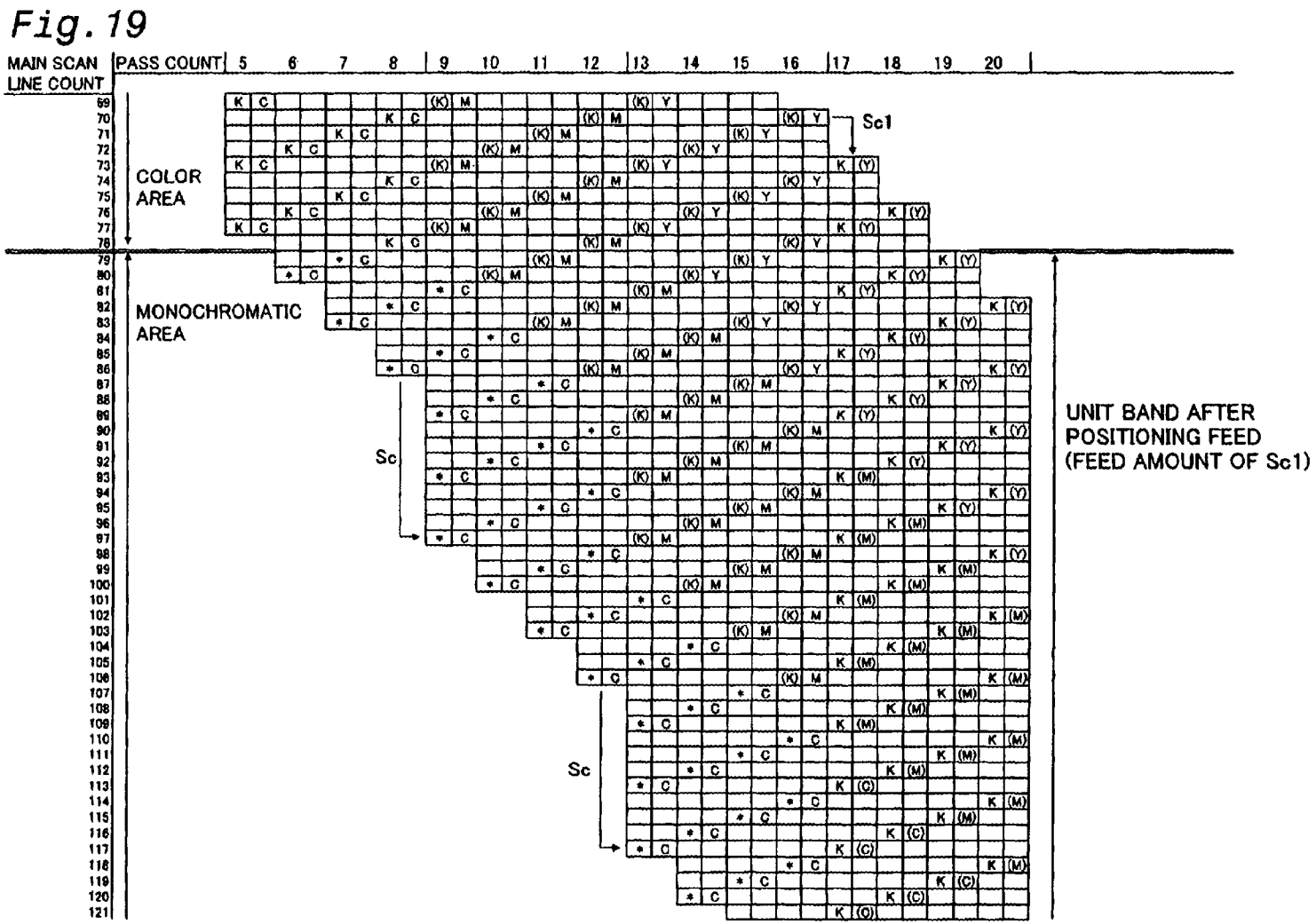
FIG. 19 is an explanatory diagram for Second working example, showing how to record image data that includes color areas and monochromatic areas.

(2) Shift from Color Mode Printing to Monochromatic Mode Printing:

FIG. 19 is an explanatory diagram that shows how image data that contains color areas and monochromatic areas is recorded for the second working example. Here, when a unit scan operation such as that shown in FIGS. 17 and 18 is performed, we will explain how printing is performed according to the flow charts of FIGS. 6 and 7. In the figure below FIG. 19, each pass number is noted without omission, so to make it easier to understand, we have put a delineation line at the pass count space for each unit pass. For the example shown in FIG. 19, from above line 78 of the image data is a color area, and from below line 79 is a monochromatic area. Therefore, color mode printing is executed first.

Initially each nozzle does not reach above the monochromatic area. Then from the sixth pass, the lowermost nozzle of special black nozzle group K0 reach above the monochromatic area. During the sixth pass, this nozzle is masked, and main scan lines are not recorded in the monochromatic areas. Even during the seventh through sixteenth passes shown in FIG. 19, similarly, of nozzles #11 through #15 of the special black nozzle group K0, those nozzles in the monochromatic areas are masked, and main scan lines are not recorded for the monochromatic areas. In FIG. 19 an asterisk (*) has been attacked to the masked nozzles.

Once the sixteenth pass has been completed, next a color mode sub-scan will be conducted such that the color unit line includes only main scan lines in the monochromatic areas. In other words, the determination of whether there are not any color lines is made in Step S32 of the flowchart shown in FIG. 6. Therefore after the sixteenth pass a positioning feed is executed for feed amount Sc1=3 dots (Step S36 of FIG. 7). This positioning feed is executed so that the upper main scan lines of the first achromatic unit band match with the upper main scan lines of the monochromatic areas. Then, during passes seventeen through twenty, all of the nozzles in the black nozzle group are used to perform the unit scan operation (Step S38 of FIG. 7), and a transition is made to the monochromatic mode.

Figure 20:
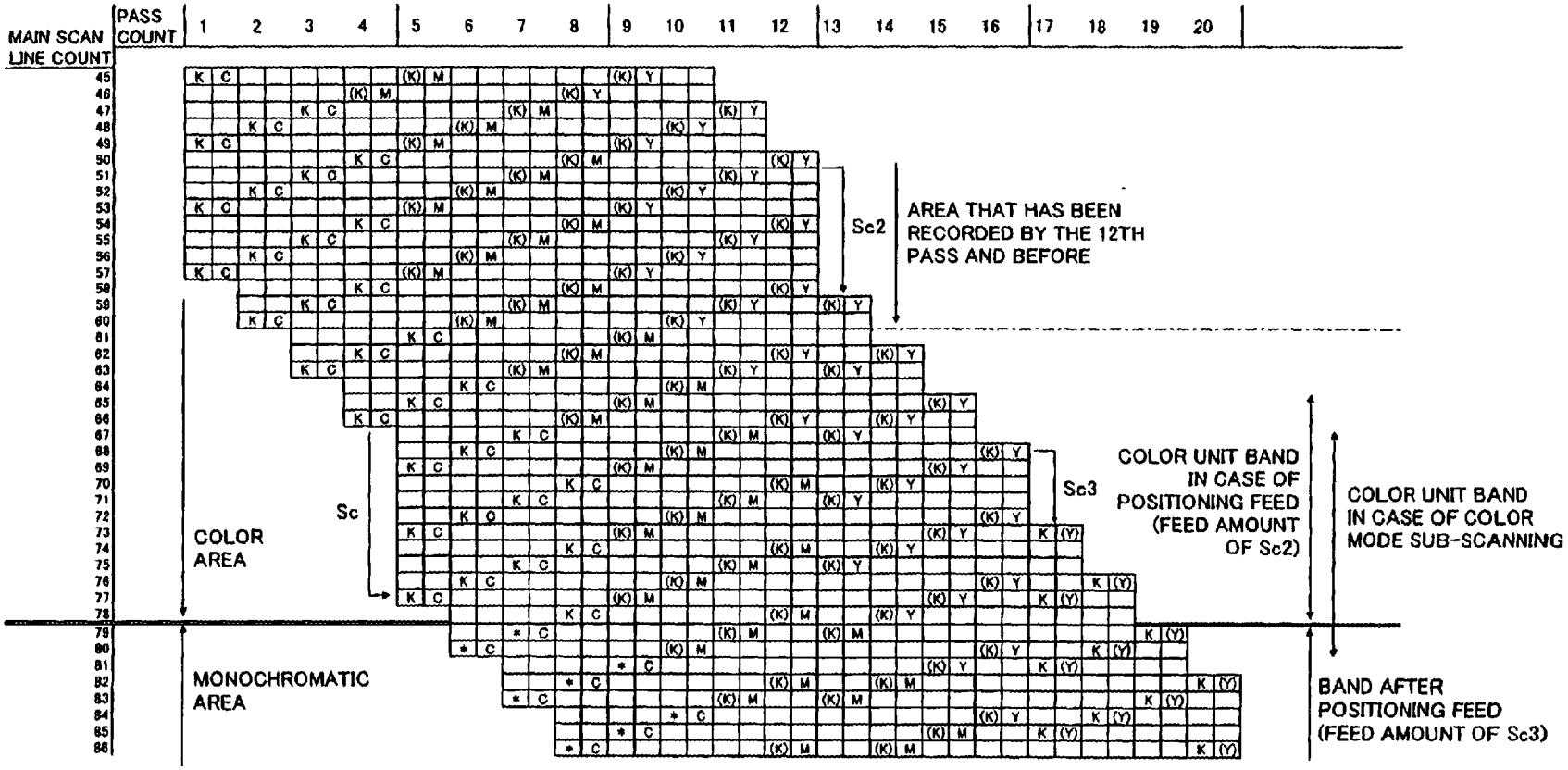
FIG. 20 is an explanatory diagram for Second working example, showing how to record image data that includes color areas and monochromatic areas.

(3) Shift 2 from Color Mode Printing to Monochromatic Mode Printing:

FIG. 20 is an explanatory diagram for Second working example, being another example showing how to record image data that includes color areas and monochromatic areas. This explains how to perform the printing according to the flow charts of FIGS. 9 and 10 when a unit scan operation such as that shown in FIGS. 17 and 18 is executed. The color areas and monochromatic areas of the image data shown in FIG. 20 are the same as those shown for FIG. 19. The method for recording each area is similar to that shown on FIG. 19 up to the twelfth pass.

Once the twelfth pass is finished and the next one monochromatic mode sub-scan is executed, there will be main scan lines for the monochromatic areas included in the color unit band (note that it is not the "color unit line"). In other words, whether there are any monochromatic lines is determined in Step S33 in the FIG. 9 flowchart. Therefore, after the twelfth pass, the black nozzles in the monochromatic areas are masked (Step S35 of FIG. 10). Then a positioning feed of feed amount Sc2=9 dots is executed (Step S37). This positioning feed is executed so that the lowermost main scan line of the color unit band matches with the lower main scan lines of the color areas. Then, during passes thirteen through sixteen, the nozzles in the single chromatic nozzle group are used to perform the unit scan operation (Step S39 of FIG. 10).

Then a positioning feed of feed amount Sc3=5 dots is executed (Step S41). This positioning feed is so that the uppermost main scan line of the next first achromatic unit band matches with the uppermost main scan line of the monochromatic areas. Then, in passes seventeen through twenty, a unit scan operation (Step S43) is conducted using all the nozzles of the black nozzle group, and a transition is made to the monochromatic mode.

In the example shown in FIG. 20, a judgment is made of whether to switch from color mode printing to monochromatic mode printing according to the flowcharts of FIGS. 9 and 10; but it is also possible to make the judgment according to the flowchart of FIG. 12. More specifically, the judgment of whether to switch to color mode printing can be made by comparing the number of main scan lines of the remaining color areas Lr2 with the number of main scan lines of the first achromatic unit band L1 and the number of main scan lines of the single chromatic unit band L2.

Figure 21:
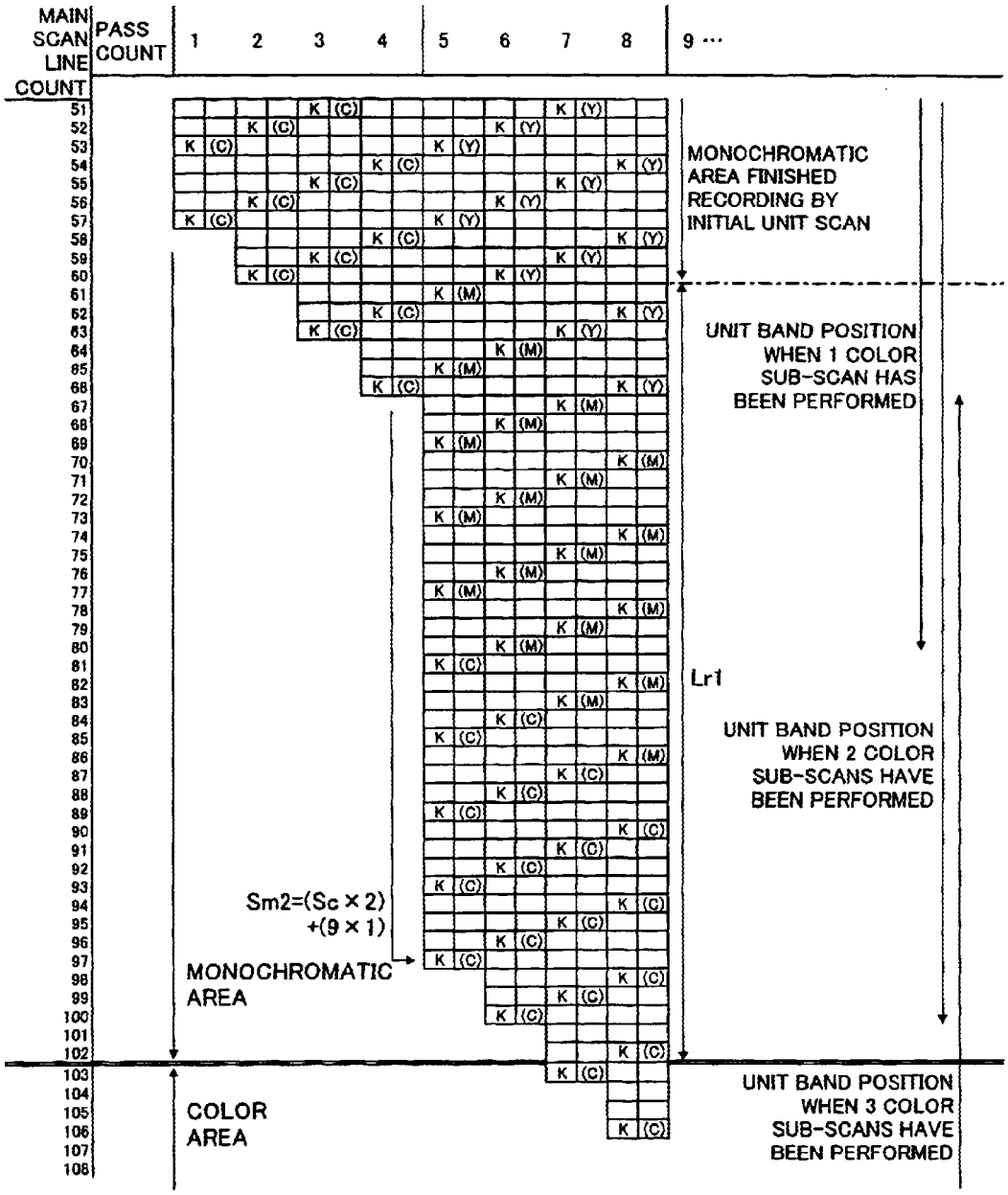
FIG. 21 is an explanatory diagram for Second working example, showing how to record image data that includes color areas and monochromatic areas.

(3) Shift from Monochromatic Mode Printing to Color Mode Printing:

FIG. 21 is explanatory diagrams that show how image data that contains color areas and monochromatic areas is recorded for the second working example. Here, when a unit scan operation such as that sown in FIGS. 17 and 18 is performed, we will explain how printing is performed according to the flow chart shown in FIG. 13. In the example shown in FIG. 21, from above line 102 of the image data is a monochromatic area, and from below line 103 is a color area. Therefore, monochromatic mode printing is executed first.

After the fourth pass is finished and a monochromatic mode subscan is next to be performed, the lower edge of the first achromatic unit band is positioned in the color area. Therefore a judgment is made in Step S54 of FIG. 13 that color lines are present. Then, when the color mode sub-scan is to be executed, as shown on the right side of FIG. 21, on the third iteration the lower edge of the second achromatic unit band (here this is identical to the lower edge of the first achromatic unit band) is positioned in the color area. Therefore, after the fourth pass, a positioning feed is executed (Step S54 of FIG. 13) so that the feed amount Sm2 is equal to a sum of twice the positioning feed Sc for the color mode sub-scan and 1 time a total feed amount of sub-scans performed in one unit scan operation, 9 dots. Then the unit scan operation is conducted (Step S66) using all nozzles in the black nozzle group K, and a transition is made to the color mode.

Figure 22:
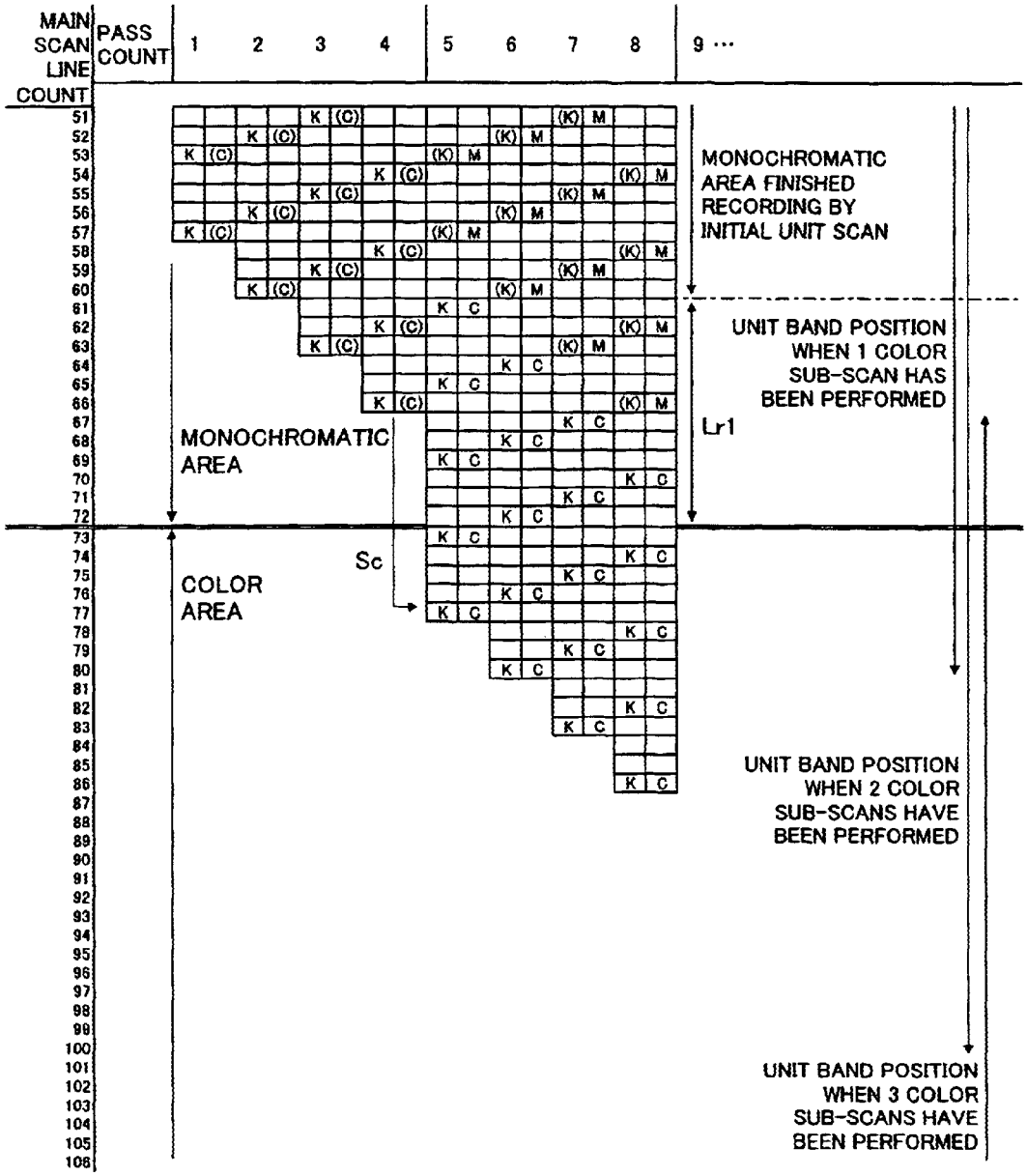
FIG. 22 is an explanatory diagram for Second working example, showing how to record image data that includes color areas and monochromatic areas.

FIG. 22 is an explanatory diagram that shows how image data that contains color areas and monochromatic areas are recorded for the second working example. In the example shown in FIG. 22, from line 72 of the image data and above is a monochromatic area, and from line 73 and below is a color area.

When the fourth pass has been completed and is to be followed by a monochromatic mode sub-scan, the lower edge of the first achromatic unit band is positioned in the color area. Therefore a judgment is made in Step S54 of FIG. 13 as to whether color lines are present. Then, when a color mode sub-scan is to be executed, as shown on the right side of FIG. 22, the lower edge of the second achromatic unit band is positioned on the first iteration in the color area. Thus when it has been determined in Step S62 of FIG. 13 that there is enough for one scan, it will switch as is to color mode printing.

Although the examples shown in FIGS. 21 and 22 follow the flowchart of FIG. 13 to determine whether to switch from monochromatic mode printing to color mode printing, the determination could also be made according to the flowchart of FIG. 16. More specifically, it is also possible to determine whether to switch to color mode printing by comparing the number Lr1 of main scan lines in the remaining monochromatic areas with the number L1 of main scan lines of the first achromatic unit band and the number L2 of main scan lines for the single chromatic unit band.

C. THIRD WORKING EXAMPLE (1) Color Mode Printing and Monochromatic Mode Printing It is also possible to print using print head 28 of First working example as shown in FIG. 3, such that the main scan pitch is the same as the nozzle pitch. An example of such printing is explained in Third working example. The hardware structure for the printing apparatus used is identical to that of First working example.

Figure 25:
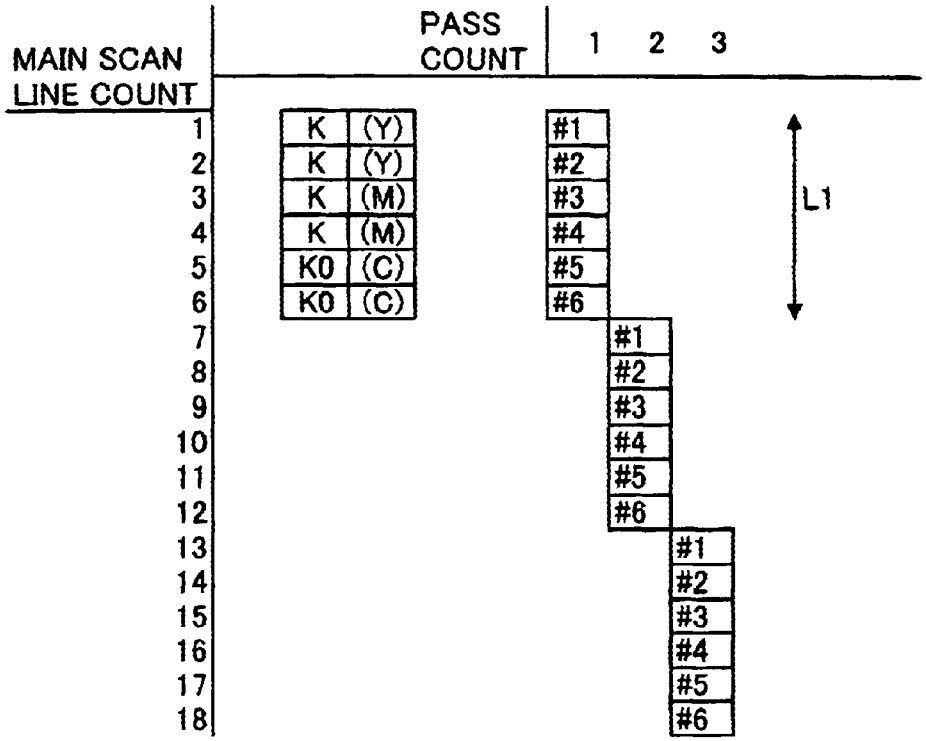
FIG. 25 is an explanatory diagram showing the recording of a main scan line during monochromatic mode printing.
Figure 26:
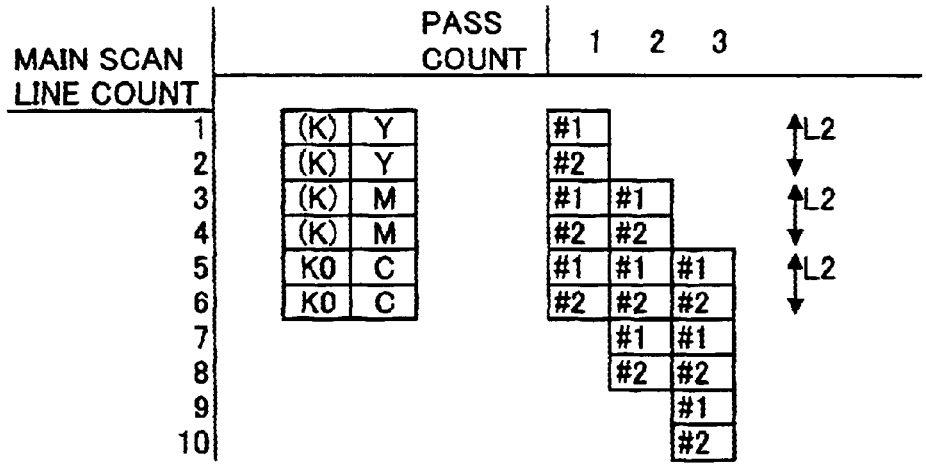
FIG. 26 is an explanatory diagram showing the recording of a main scan line during color mode printing.

FIG. 25 is an explanatory diagram showing the recording of a main scan line during monochromatic mode printing. FIG. 26 is an explanatory diagram showing the recording of a main scan line during color mode printing. The nozzle position is shown on the left side of each figure. As can be understood from FIG. 25, the gap Da between upper and lower adjacent main scan lines is the same as the pitch in the upper and lower directions (sub-scan direction) of each nozzle on the print head. Therefore each nozzle pitch on the print head is 1 dot.

As shown in FIG. 25, in Third working example, the number L1 of main scan lines of "first achromatic unit band" is 6. "The first achromatic unit band" is the main scan lines recorded with black ink and lined up without a gap in the sub-scan direction when the main scan is executed using all the nozzles of black nozzle group K. In Third working example the "achromatic unit lines" matches the "first achromatic unit band." In monochromatic mode printing where the main scan is executed using all the nozzles of black nozzle group K, whenever a single main scan is completed, it is followed by a sub-scan for the 6 main scan lines to be recorded by the next main scan. This sub-scan is called the "monochromatic mode sub-scan." The feed amount Sm of the monochromatic mode sub-scan is 6 dots.

On the other hand, in color mode printing, as was the case in First working example, the print operation uses the same number of nozzles for each ink color. Only two nozzles, #5 and #6, of the black nozzle group K are used. The black nozzles used in color mode printing are called "special black nozzle group K0."

As shown in FIG. 26, the number L2 of main scan lines of the "single chromatic unit band" or the "second achromatic unit band" is 2 for each. "The single chromatic unit band" is the main scan lines recorded without a gap in the sub-scan direction by the single chromatic nozzle groups Y, M, and C when the main scan is executed using the single chromatic nozzle groups Y, M, and C. "The second achromatic unit band" is the main scan lines recorded without a gap in the sub-scan direction by the special black nozzle group K0 when the main scan is executed using the special black nozzle group K0. In color mode printing, after one main scan is completed a sub-scan is performed for 2 main scan lines prior to the execution of the next main scan. This sub-scan is called a "color mode sub-scan." The feed amount for the color mode sub-scan is 2 dots.

In Third working example there is a match between the "color unit line" and the "color unit band." The width of the color unit band is equal to the width of the single chromatic unit band. Also, color mode printing is executed by color mode unit 41*a*, and monochromatic mode printing is executed by monochromatic mode unit 41*b* (refer to FIG. 2).

Figure 27:
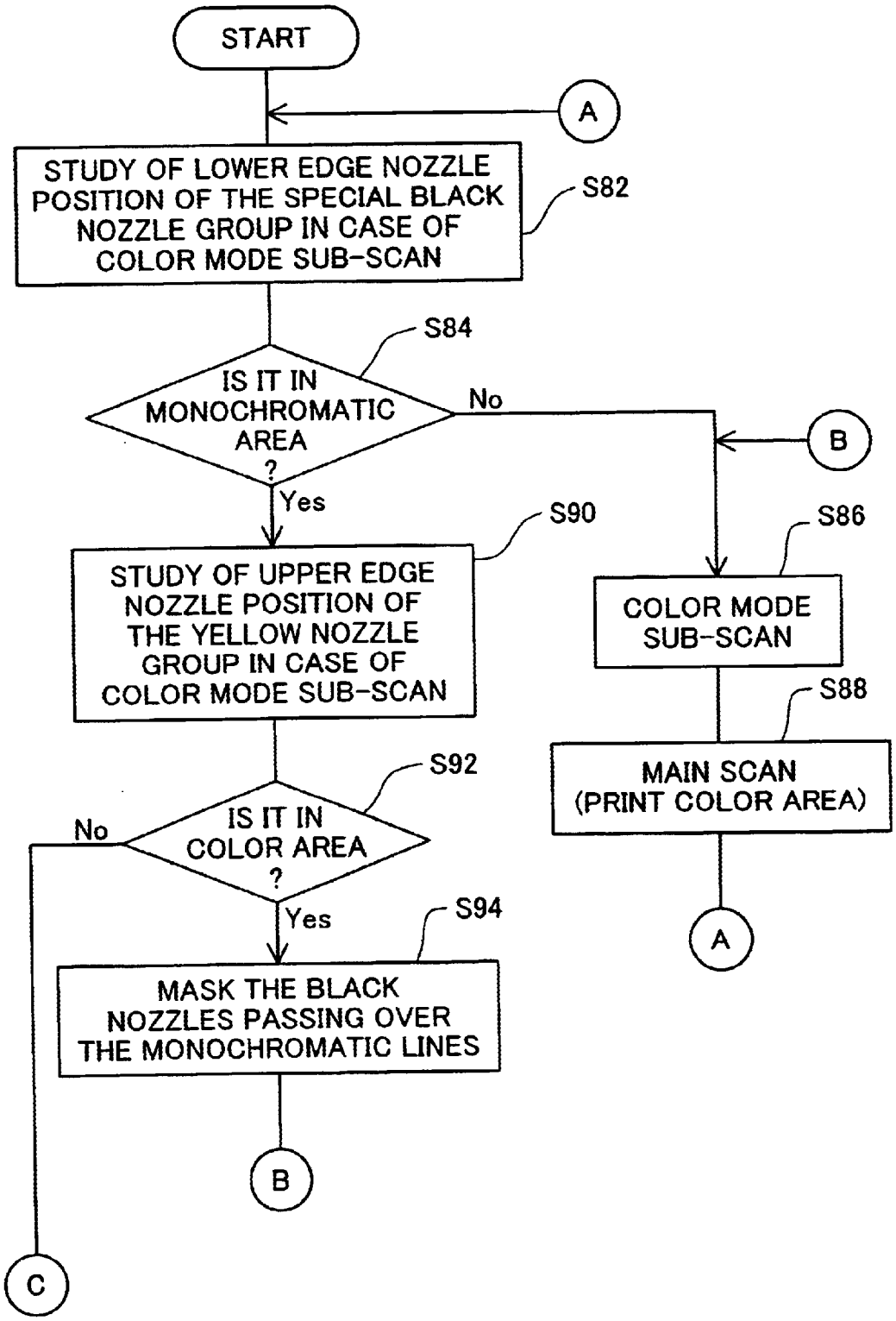
FIG. 27 is a flowchart showing the process of color mode printing.
Figure 28:
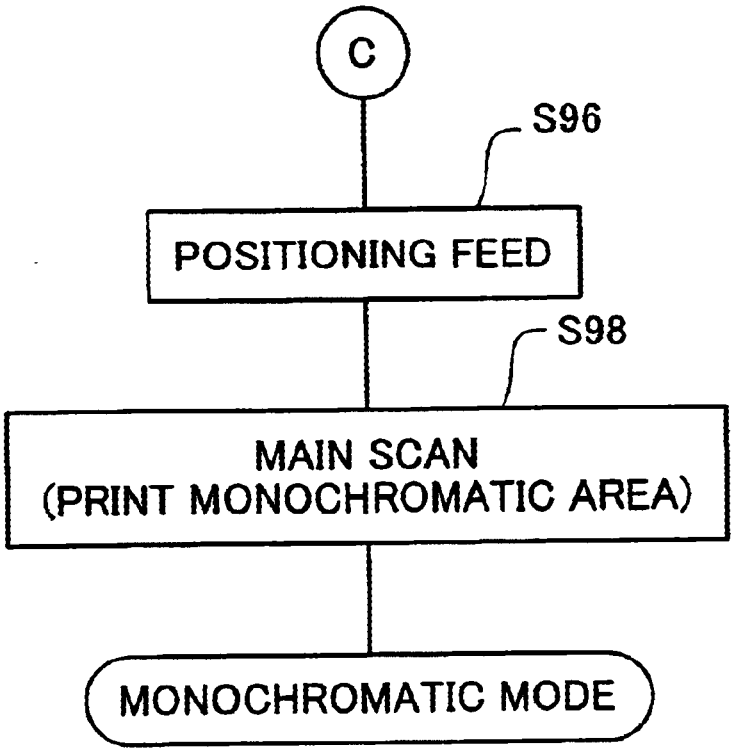
FIG. 28 is a flowchart showing the process of color mode printing.
Figure 29:
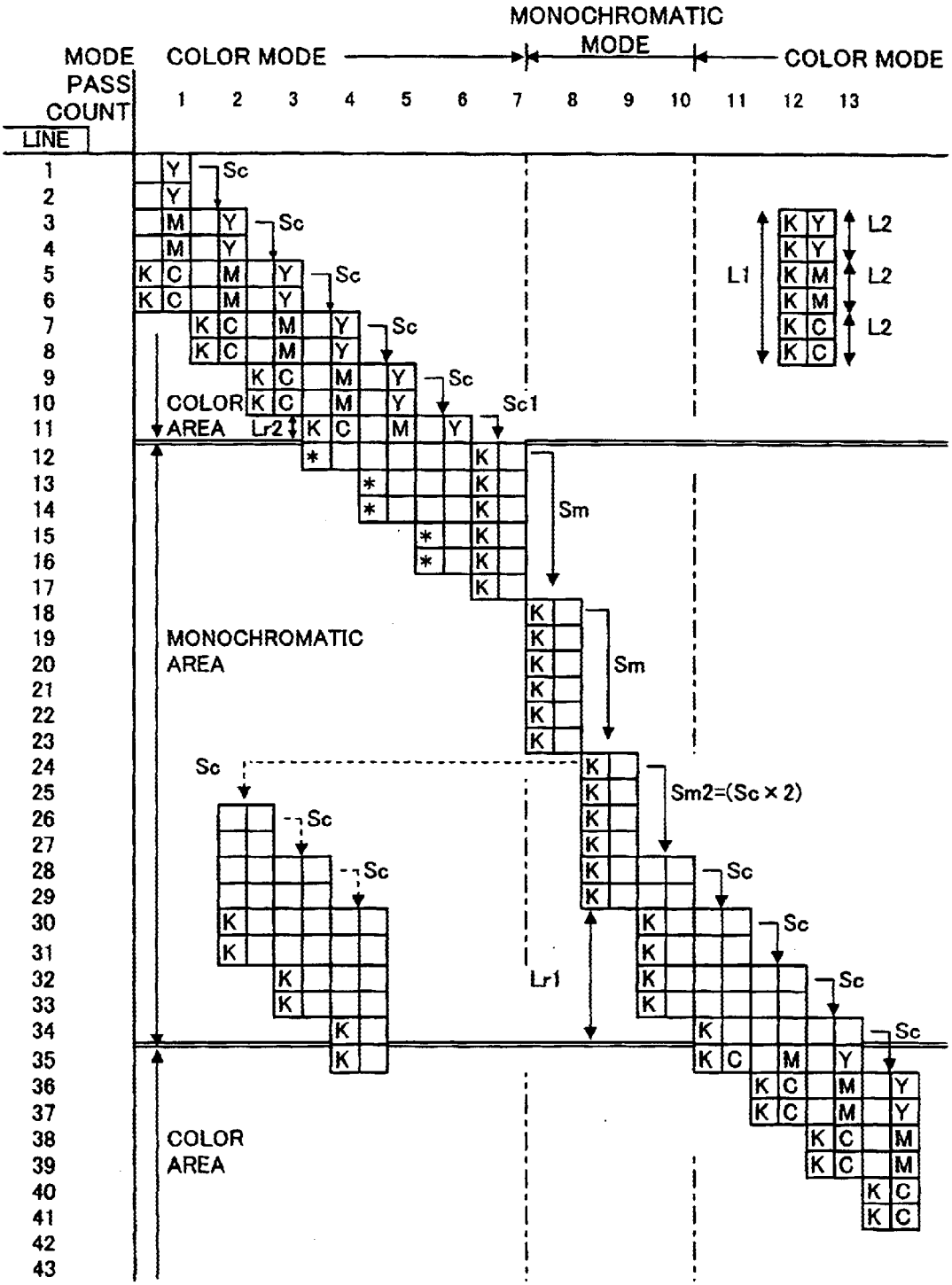
FIG. 29 is an explanatory diagram showing how to record image data that includes color areas and monochromatic areas.

(2) Shift 1 from Color Mode Printing to Monochromatic Mode Printing:

FIGS. 27 and 28 are flowcharts showing the process for color mode printing. FIG. 29 is an explanatory diagram showing how to record image data that includes color areas and monochromatic areas. In FIG. 29, horizontal rows of squares mean the main scan lines recorded by one nozzle for one main scan. In the example shown in FIG. 29, lines 12–34 are monochromatic areas, and lines 1–11 and line 35 through the end are color areas. In FIG. 8, as shown in the upper right of the figure, the printing head that executes the unit scan operation is typically shown in 2 rows×6 lines of squares. In FIG. 8 one square corresponds to one nozzle.

With regards to color mode printing, in Step S82 of FIG. 27, assuming that a color mode sub-scan and a main scan have been performed next, a check is performed to see whether the lower edge nozzle position of the special black nozzle group K0 is positioned in the color area or in the monochromatic area. In Step S84, if the result is that the lower edge nozzle of special black nozzle group K0 is not in a monochromatic area (if it is in a color area), the color mode sub-scan will be conducted in Step S86, and a main scan will be conducted in Step S88 using 2 nozzles for each color. In the example shown in FIG. 29, the printing from the beginning to the third pass is conducted according to this routine.

If, on the other hand, in Step S84 the results reveal that the lower edge nozzle of special black nozzle group K0 is positioned in a monochromatic area, a check is made of the relative position of the upper nozzle #1 of the yellow nozzle group with regards to the printing paper when it is assumed that in Step S90 a color mode sub-scan is next conducted. The nozzle whose relative position is checked in Step S90 is the uppermost nozzle of those nozzles included in the nozzle group for ejecting chromatic ink. In Step S92, if the uppermost nozzle of the yellow nozzle group is positioned in a color area, in Step S94 those nozzles within special black nozzle group K0 that pass above the monochromatic lines are masked. Then a transition is made to Step S86, a color mode sub-scan is conducted, and in Step S88 the main scan is executed. In the example shown in FIG. 29, this routine is followed for the printing that is performed in passes 4–6. The processing for the switch from color mode printing to monochromatic mode printing is executed by first shift unit 41*a*1 of color mode unit 41*a* (refer to FIG. 2).

If, in Step S92, the upper nozzle of the yellow nozzle group is not positioned in a color area (i.e. if it is positioned in a monochromatic area), a positioning feed is executed in Step S92. The positioning feed is executed so that the uppermost nozzle of the black nozzle group is positioned above the uppermost main scan line of the monochromatic areas. Then, in Step S98, the main scan is conducted using all the nozzles of the black nozzle group, and a switch is made to the monochromatic mode. In the example shown in FIG. 29, the sub-scan feed after the sixth pass is the positioning feed occurring in Step S96. In FIG. 29 the feed amount of the positioning feed is 1 dot. The seventh pass is the main scan conducted in Step S98. This type of transition from color mode printing to monochromatic mode printing is executed by the second shift unit 41*a*2 of the color mode unit 41*a* (refer to FIG. 2).

More specifically, in the color mode printing, steps S86 and S88 are repeated, and color mode printing is executed, as long as the upper nozzle of the yellow nozzle group is positioned in a color area when it is assumed that a color mode sub-scan is performed next. If, at this time, the nozzles of special black nozzle group K0 are in a monochromatic area, those nozzles are masked (Step S94), and no recording is performed on the main scan lines of the monochromatic areas. In the example shown in FIG. 29, the black nozzles pass above lines 12–16 during passes 4–6, but since these black nozzles are masked they do not record onto lines 12–16.

Subsequently, when the uppermost nozzle of the yellow nozzle group is not positioned in a color area (i.e. is positioned in a monochromatic area) when it is assumed that the color mode sub-can is performed next (Step S92 of FIG. 27), a positioning feed is executed (Step S96 of FIG. 28). Then the main scan is performed using all the nozzles of black nozzle group K (Step S98), and then monochromatic mode printing is executed.

Given this condition, when printing the bordering portion of a monochromatic area whose upper edge touches the color area (lines 12–16 in FIG. 29), the number of sub-scans can be decreased. Accordingly, the quality of printing results in this area increases.

Figure 30:
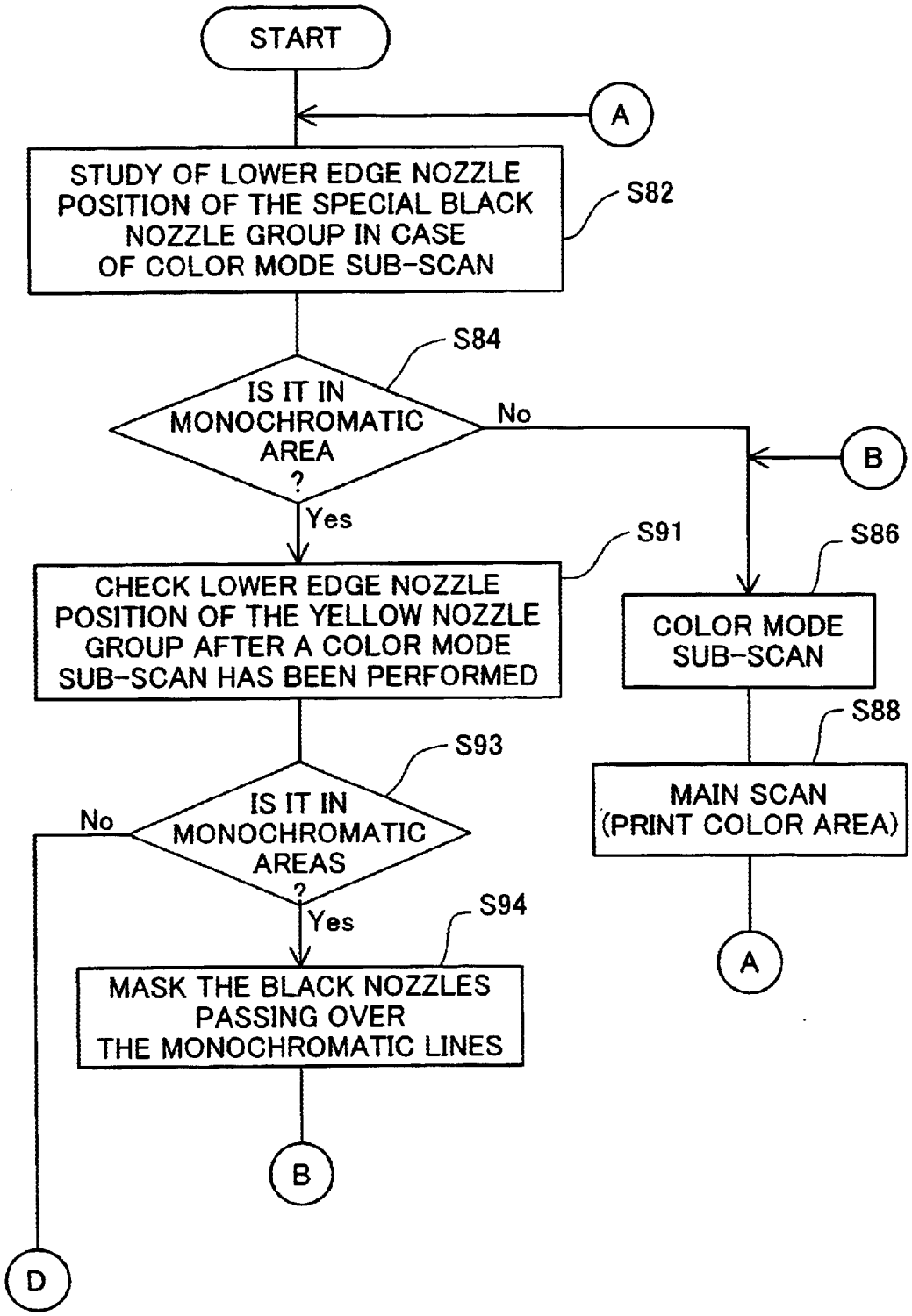
FIG. 30 is a flowchart showing an example of another process for color mode printing.
Figure 31:
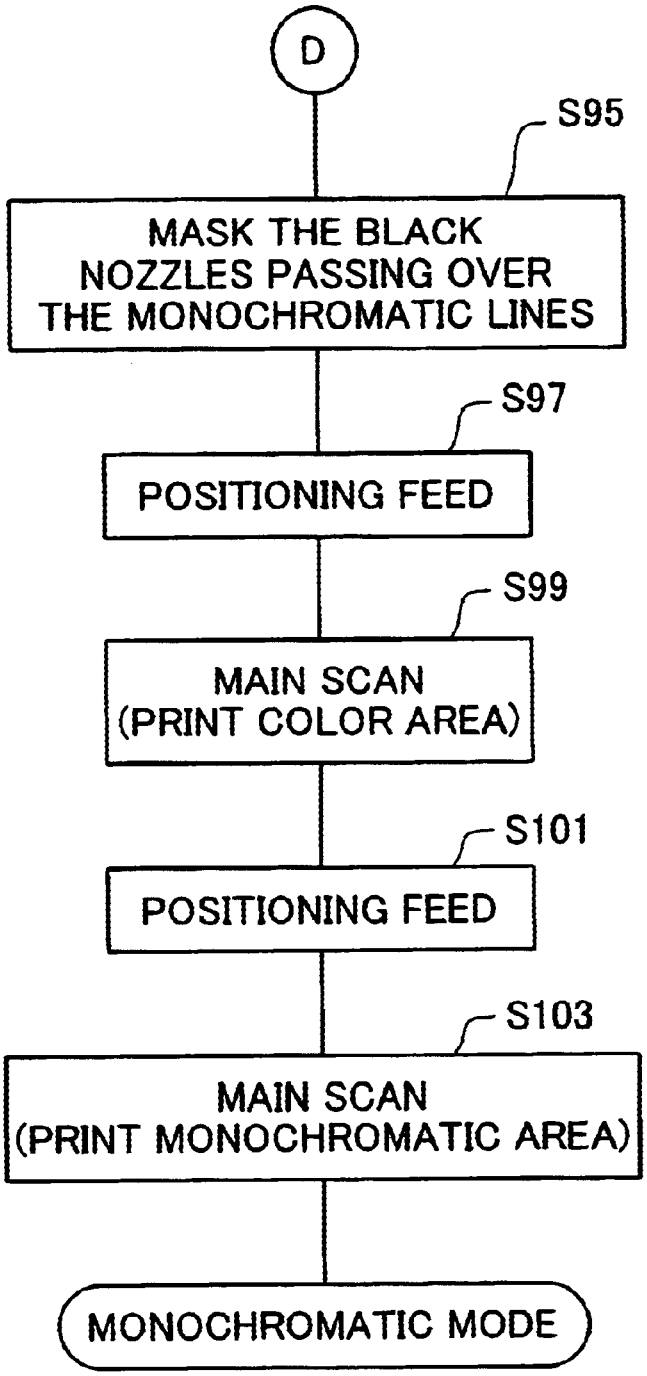
FIG. 31 is a flowchart showing an example of another process for color mode printing.
Figure 32:
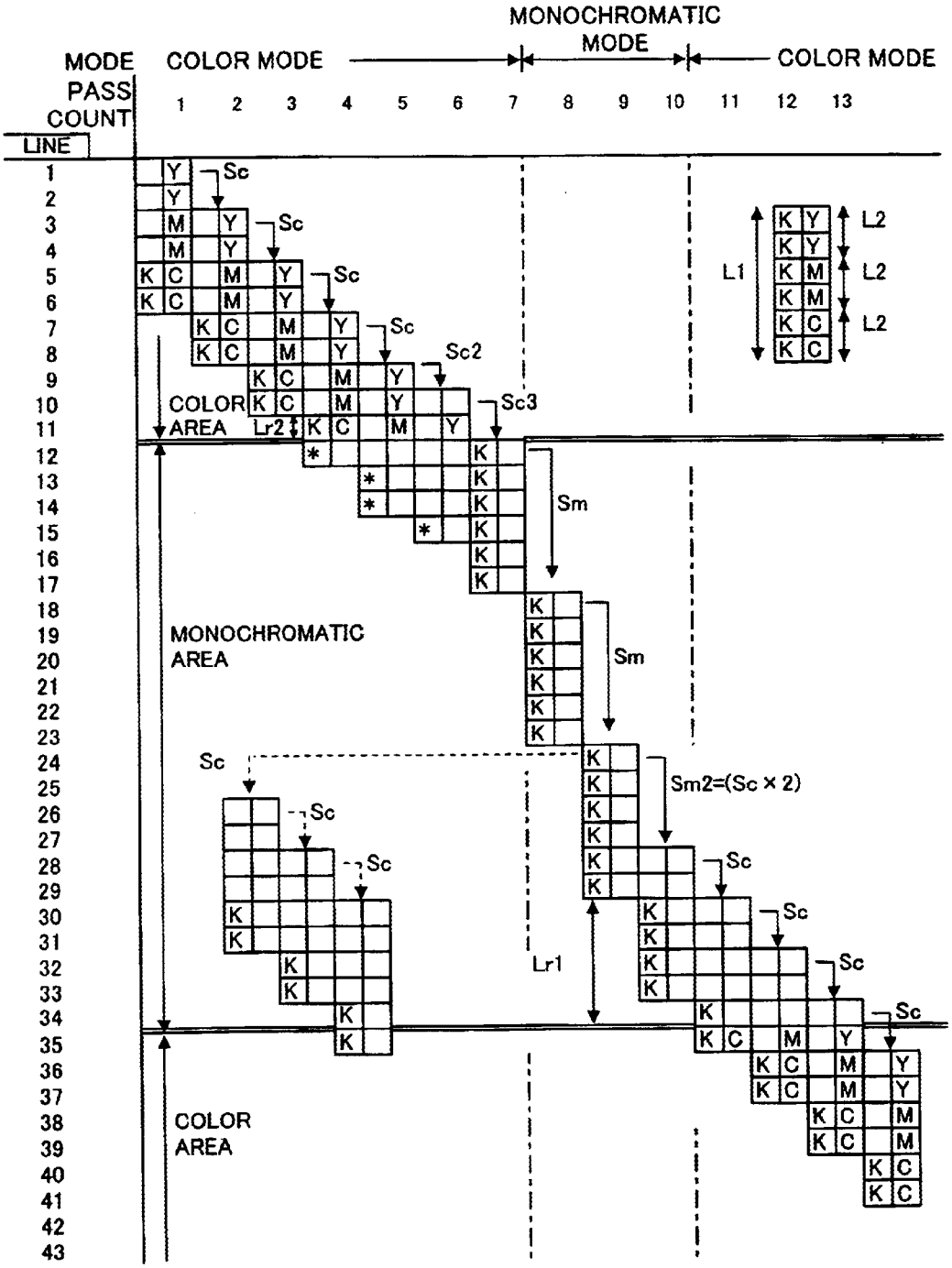
FIG. 32 is an explanatory diagram for another example showing how to record image data that includes color areas and monochromatic areas.

(3) Shift 2 from Color Mode Printing to Monochromatic Mode Printing:

FIGS. 30 and 31 are flowcharts showing examples of other processes for color mode printing. FIG. 32 is an explanatory diagram for another example showing how to record image data that includes color areas and monochromatic areas. The process shown the flowcharts of FIGS. 30 and 31 differ from the process shown in the flowcharts of FIGS. 27 and 28 in the procedures that are executed when the lowermost nozzles of special black nozzle group K0 is found to be in a monochromatic area in Step S84. In other points they are identical to the flowcharts of FIGS. 27 and 28. In Step 84, when the lower nozzles of special black nozzle group K0 are in a monochromatic area, a check is performed in Step S91 to see whether lowermost nozzle #2 of the yellow nozzle group is positioned in a color area or a monochromatic area when it is assumed that a color mode sub-scan is to be conducted next. Note that the check performed in Step S91 is of the lowermost nozzle in the nozzle group (yellow nozzle group) that is positioned uppermost among the groups of single chromatic nozzles (nozzle groups for cyan, magenta, and yellow). If the result of the check performed in Step S91 is that the lower nozzle of the yellow nozzle group is not positioned in a monochromatic area (i.e. if it is in a color area), in Step S94 those nozzles of the special black nozzle group K0 that pass above the monochromatic areas will be masked. The processes that follow Step S94 are identical to those shown in the flowcharts of FIGS. 27 and 28. In the example shown in FIG. 32, this routine is followed for the printing that occurs during passes 4 and 5. The printing performed on the fourth and fifth passes is identical to that of FIG. 29.

On the other hand, if it is determined in Step S93 that the lowermost nozzle of the yellow nozzle group is positioned in a monochromatic area, then those nozzles of the special black nozzle group K0 that pass above the monochromatic lines will be masked in Step S95 of FIG. 31. Then a positioning feed is executed in Step S97. This positioning feed positions the lowermost nozzle of the yellow nozzle group above the main scan lines at the bottom edge of the color areas. Then in Step S99 the main scan is executed using each single chromatic nozzle group. In the example shown in FIG. 32, the sub-scan feed after the fifth pass is the positioning feed performed in Step S97. In FIG. 32, the feed amount Sc2 for the positioning feed is 1 dot. The sixth pass is the main scan conducted in Step S99.

Then a positioning feed is again executed in Step S101. This positioning feed is executed so that, after the positioning feed has been executed, the uppermost nozzles of the black nozzle group will be positioned above the uppermost main scan line of the monochromatic areas. Then in Step S103, the main scan is executed using all of the nozzles in black nozzle group K. Then it switches to monochromatic mode printing. In the example shown in FIG. 32, the sub-scan feed after the sixth pass is the positioning feed that occurs in Step S101. The feed amount Sc3 for the positioning feed in FIG. 32 is 2 dots. The seventh pass is the main scan executed in Step S103. This transition processing from color mode printing to monochromatic mode printing is executed by the second shift unit 41*a*2 of the color mode unit 41*a* (refer to FIG. 2). It is also possible in this situation to reduce the number of color mode sub-scans and positioning feeds, thus making it possible to improve printing quality.

Figure 33:
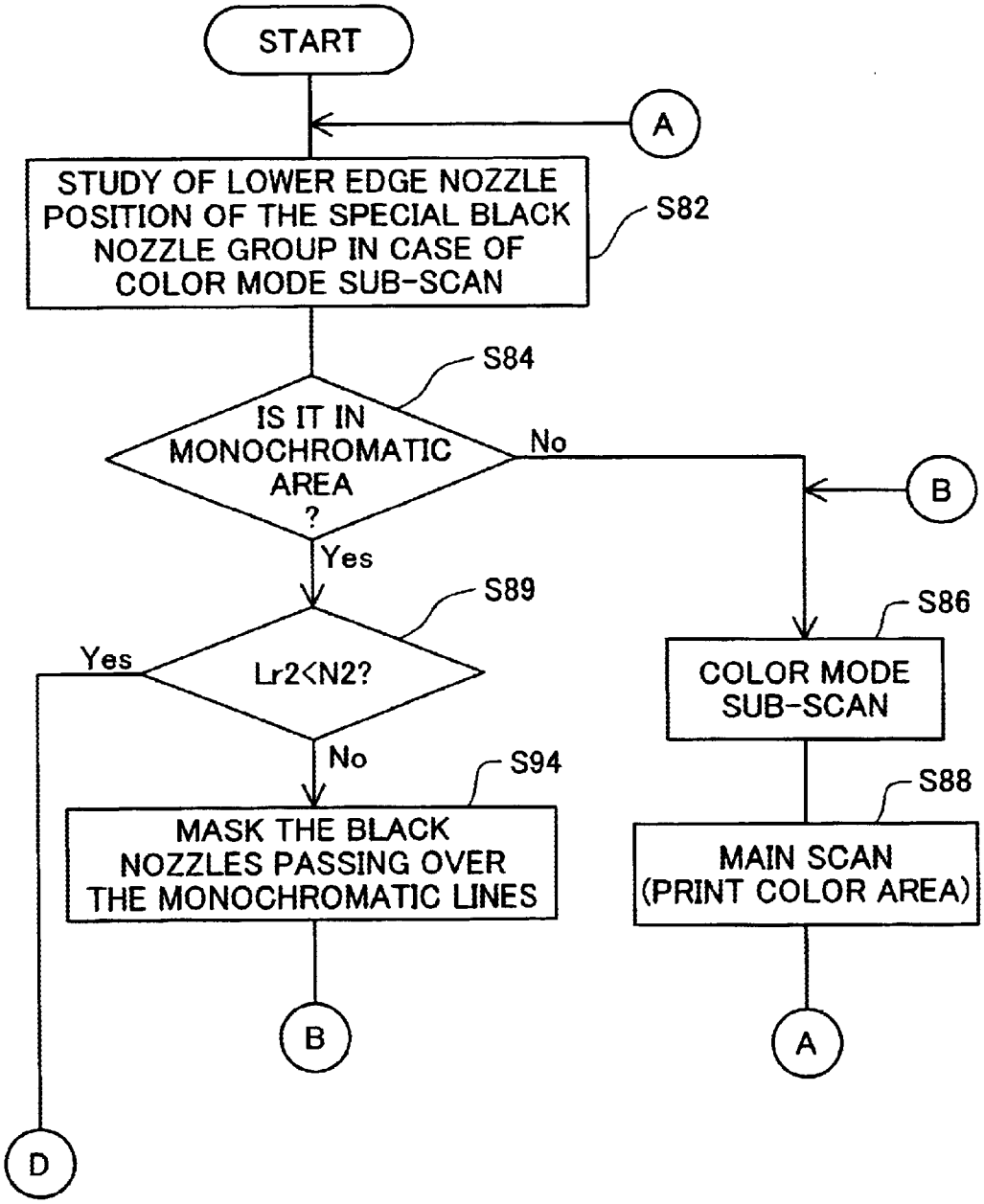
FIG. 33 is a flowchart showing an example of another process for color mode printing.

(4) Shift 3 from Color Mode Printing to Monochromatic Mode Printing:

FIG. 33 is a flowchart showing an example of another process for color mode printing. In the flowchart of FIG. 33, Step S90 is executed instead of Steps S91 and S93 on FIG. 30. The other points are identical to the flowchart of FIG. 30. The process for monochromatic mode printing can also be done as follows.

If in Step S84, the color mode sub-scan has been executed, and the lowest nozzles of the special black nozzle group K0 have been positioned in a monochromatic area, then, in Step S89, the number Lr2 of remaining color area main scan lines is checked to see if it is less than the number N2 of nozzles in each of the cyan, magenta, and yellow nozzle groups. In the example shown in FIG. 32, if after the fifth pass has been completed and in this condition a color mode sub-scan has next been conducted, the lowermost nozzle of special black nozzle group K0 is positioned in a monochromatic area. Therefore the decision reached in Step S84 will be "Yes." Given the condition after the fifth pass has been completed, the eleventh line that has not yet been recorded (has been recorded with yellow ink) is a remaining color line.

When, in Step S89, the number Lr2 of remaining color area main scan lines is less than N2, Steps S95–S103 of FIG. 31 will be executed, and a transition make to monochromatic mode printing. In Step S89, if the number L2 of remaining color area main scan lines is equal to or greater than N2, then those nozzles of the special black nozzle group K0 that pass above the monochromatic lines will be masked. The process from Step S94 and following is identical to that shown in FIGS. 27 and 28.

Even when this type of process is executed, the printing such as that shown in FIG. 32 is executed appropriately. Then, given this type of process, it is possible to execute the transition from color mode printing to monochromatic mode printing by a simple process.

Figure 34:
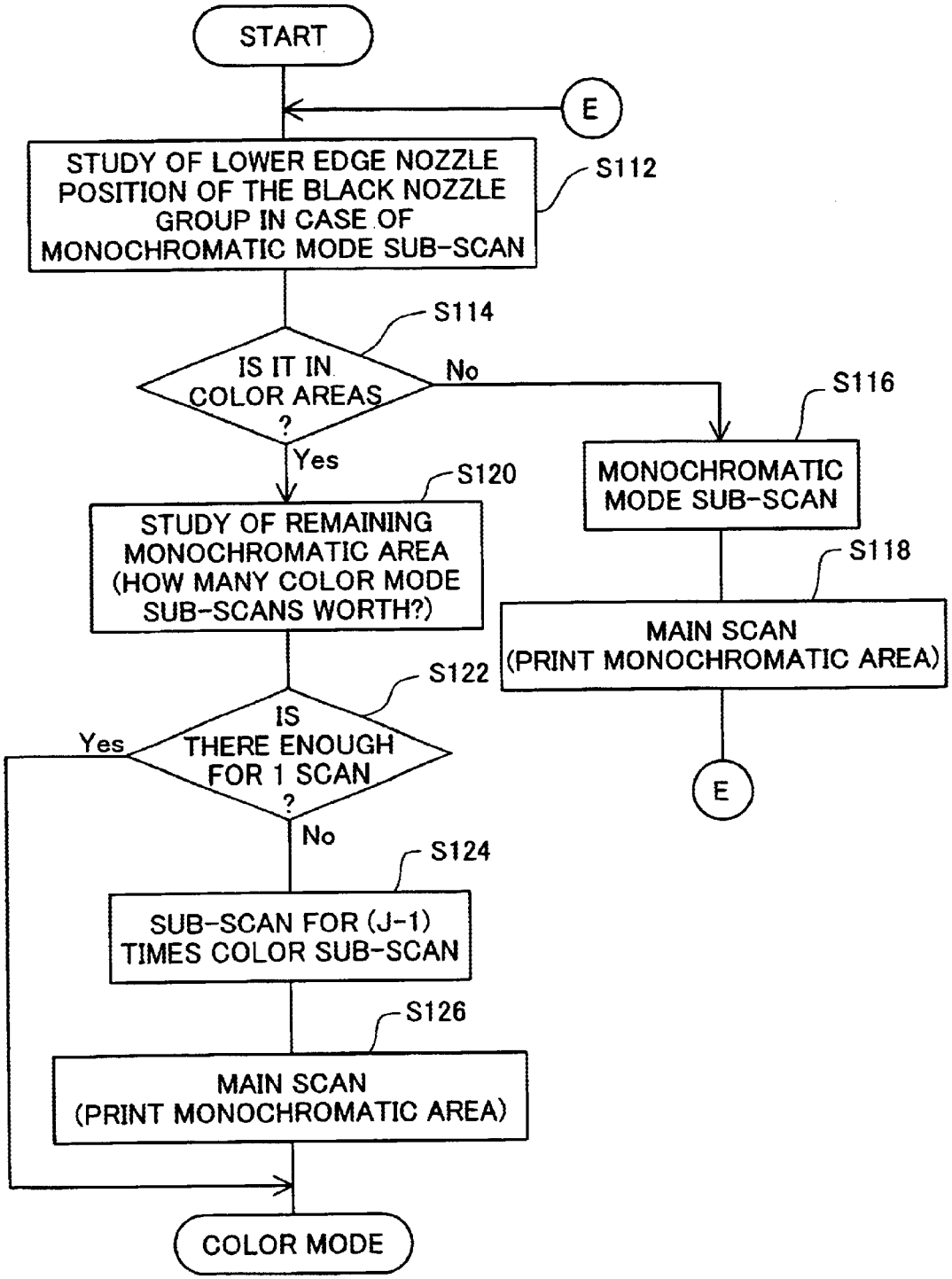
FIG. 34 is a flowchart showing a process for monochromatic mode printing.

(5) Shift 1 from Monochromatic Mode Printing to Color Mode Printing:

FIG. 34 is a flowchart showing a process for monochromatic mode printing. In monochromatic mode printing, in Step S112, a check is made to see whether the lower nozzle of the black nozzle group is positioned in either a monochromatic area or a color area when it is assumed that the next process to be executed will be the monochromatic mode sub-scan. If the result in Step S114 is that it is not positioned in a color area (i.e. it is positioned in a monochromatic area), then a monochromatic mode sub-scan will be conducted in Step S116, and a main scan will be conducted in Step S118 using all the nozzles of black nozzle group K. Then the process returns to Step S112. In the example shown in FIG. 29, this routine is used to execute the printing operation after the sub-scan executed on the seventh pass, through the ninth pass.

More specifically, in monochromatic mode printing, Steps S116 and S118 are repeated and thereby monochromatic mode printing is executed as long as the lowermost nozzle of black nozzle group K is not positioned in a color area when it is assumed a monochromatic mode sub-scan has next been executed.

If [the result returned] in Step S114 is that a color line exists, then in Step S120 a check is made of the amount of the area (the "remaining monochromatic area") where main scan lines exist in the monochromatic area that have not yet been recorded. More specifically, a check is made of J iterations of the color mode sub-scan that is when the lower nozzle of the special black nozzle group K0 is first positioned in a color area when the color mode sub-scan is executed J times (where J is an integer of 1 or greater). In the example shown in FIG. 29, as shown in the lower left, once the ninth pass has been completed, on the third iteration of the color mode sub-scan is when the lowermost nozzle of the special black nozzle group K0 is first positioned on a color area.

In Step S122 a check is made of whether the lowermost nozzle of the special black nozzle group KO reaches a color area when only 1 color mode sub-scan has been conducted. If the number J of sub-scan feeds needed for the lowermost nozzle of the special black nozzle group KO to reach a color area is 2 or greater, then a sub-scan is executed in Step S124 having a feed amount of (J−1) times the color mode sub-scan. Then, in Step S126, a main scan is executed using all of the nozzles in the black nozzle group; then a switch is made to the color mode. The sub-scan that follows the ninth pass in the example shown in FIG. 29 is the sub-scan that is executed in Step S124. Then the sub-scan feed amount Sm2 equals to a sum of twice the quantum of feed for the color mode sub-scan. Then pass 10 is the main scan executed in Step S126. Note that, the example shown in FIG. 29, the $28^{th}$ and $29^{th}$ lines are already recorded by the ninth pass, so actually the upper 2 nozzles of black nozzle group K are not used. Also, the transition processing from monochromatic mode printing to color mode printing is executed by shift unit 41*b*1 of monochromatic mode unit 41*b* (refer to FIG. 2).

Figure 35:
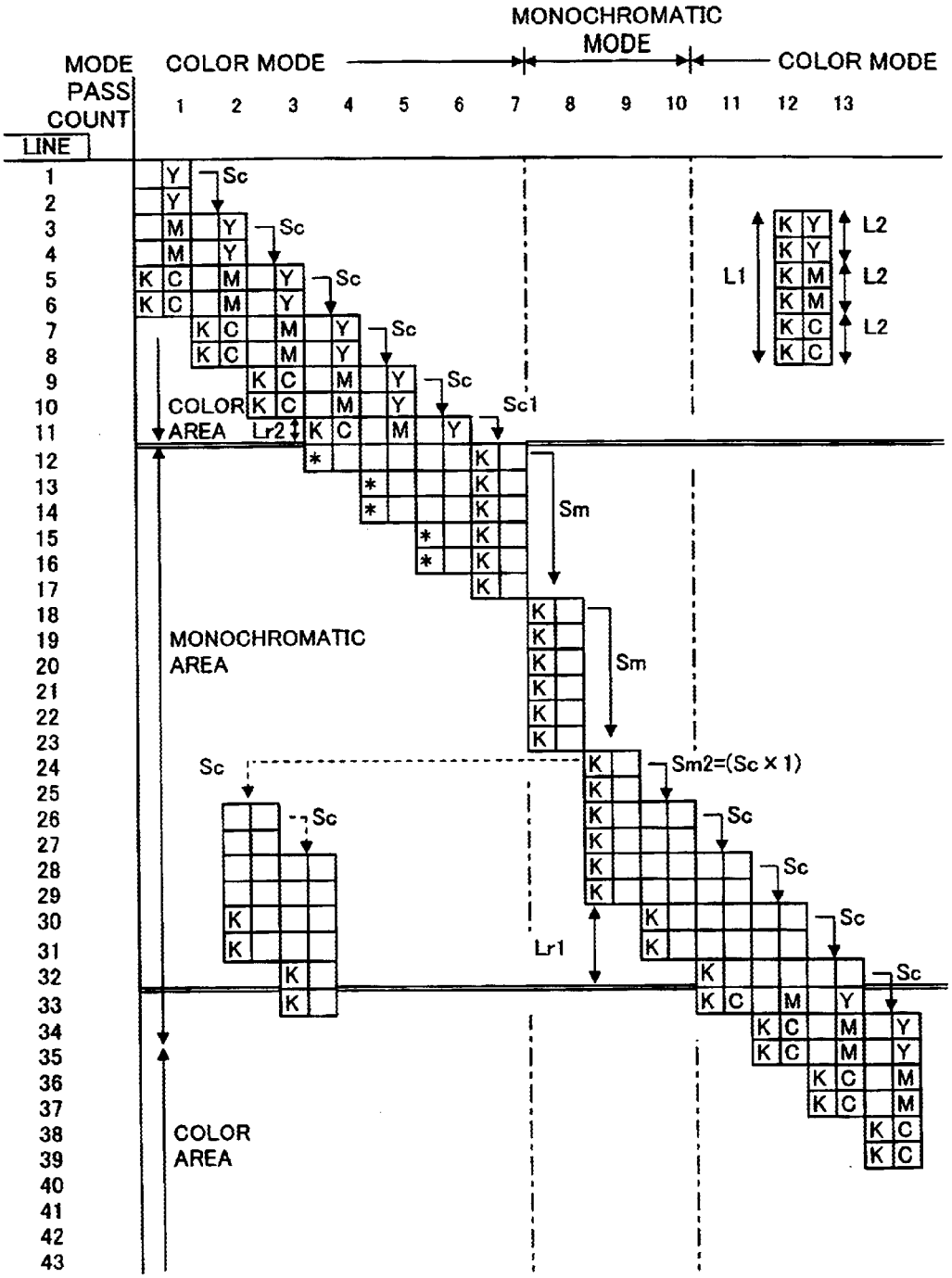
FIG. 35 is an explanatory diagram showing how to record image data that includes color areas and monochromatic areas.

FIG. 35 is an explanatory diagram showing how to record image data that includes color areas and monochromatic areas. In FIG. 35 the color area begins from the thirty-third line. The other points are identical to FIG. 29. As shown in FIG. 35, after the ninth pass has been completed, two sub-scans are executed, and if the lowermost nozzle of special black nozzle group K0 reaches a color area, the sub-scan feed amount Sm2 in Step S124 (see FIG. 34), which occurs after the ninth pass, is 1 times the feed quantum Sc for the color mode sub-scan.

Figure 36:
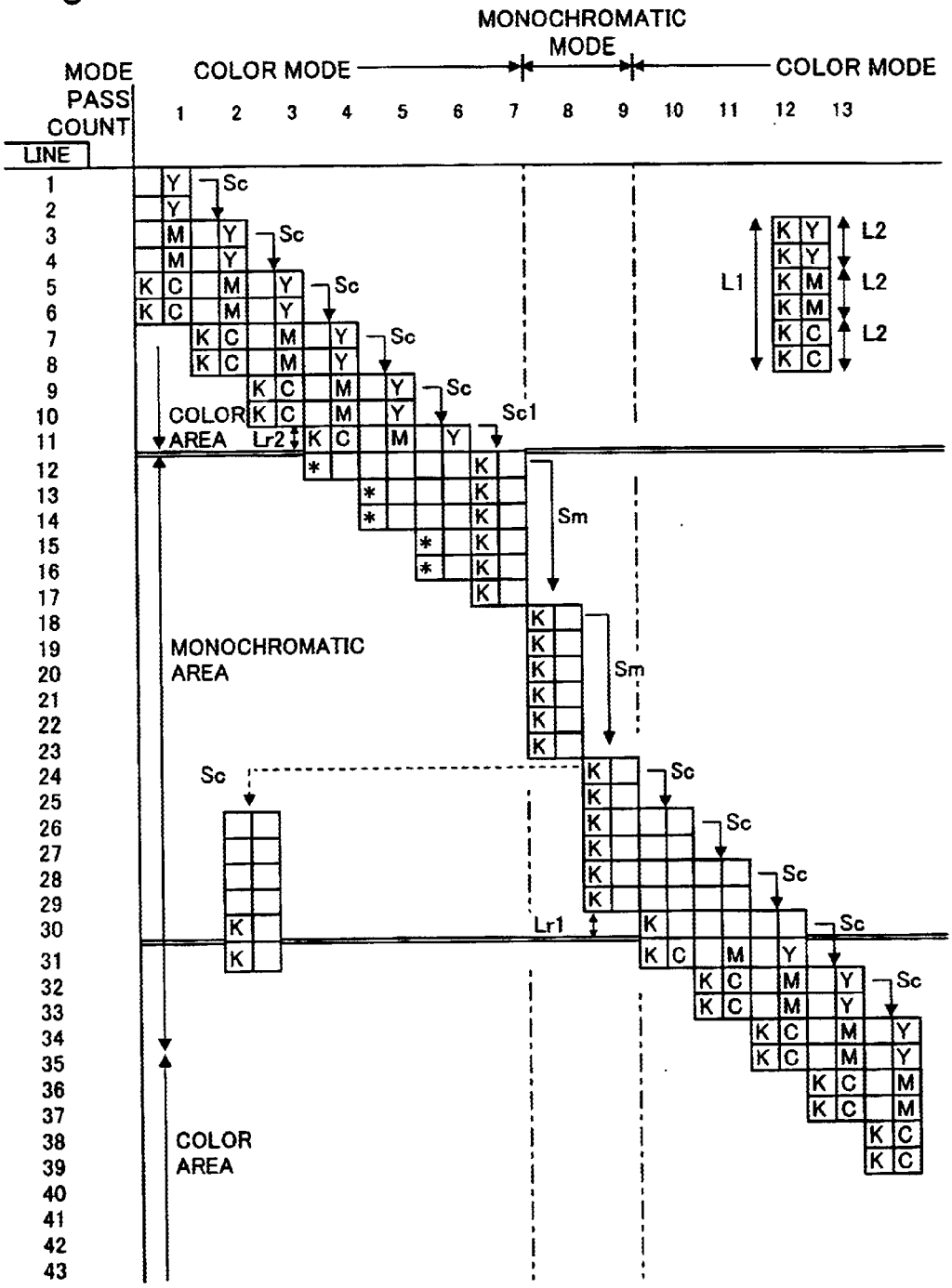
FIG. 36 is an explanatory diagram showing how to record image data that includes color areas and monochromatic areas.

FIG. 36 is an explanatory diagram showing how to record image data that includes color areas and monochromatic areas. In FIG. 36 the color areas extend from line 31 to the bottom. The other points are identical to FIG. 29. As shown in FIG. 36, once the ninth pass has been completed, one sub-scan is executed, and if the lower nozzle of the special black nozzle group K0 reaches a color area, then a transition is made directly to the color mode from Step S122 of FIG. 34.

In First working example a positioning feed was executed in Step S124 and then a main scan was executed using all the nozzles in the black nozzle group K. This made it possible reduce the number of monochromatic mode sub-scans and positioning feeds when recording onto the areas at the bottom edge of the monochromatic areas that touched the color areas. This results in high print quality of the border area of the monochromatic area whose lower edge touches the color area.

Figure 37:
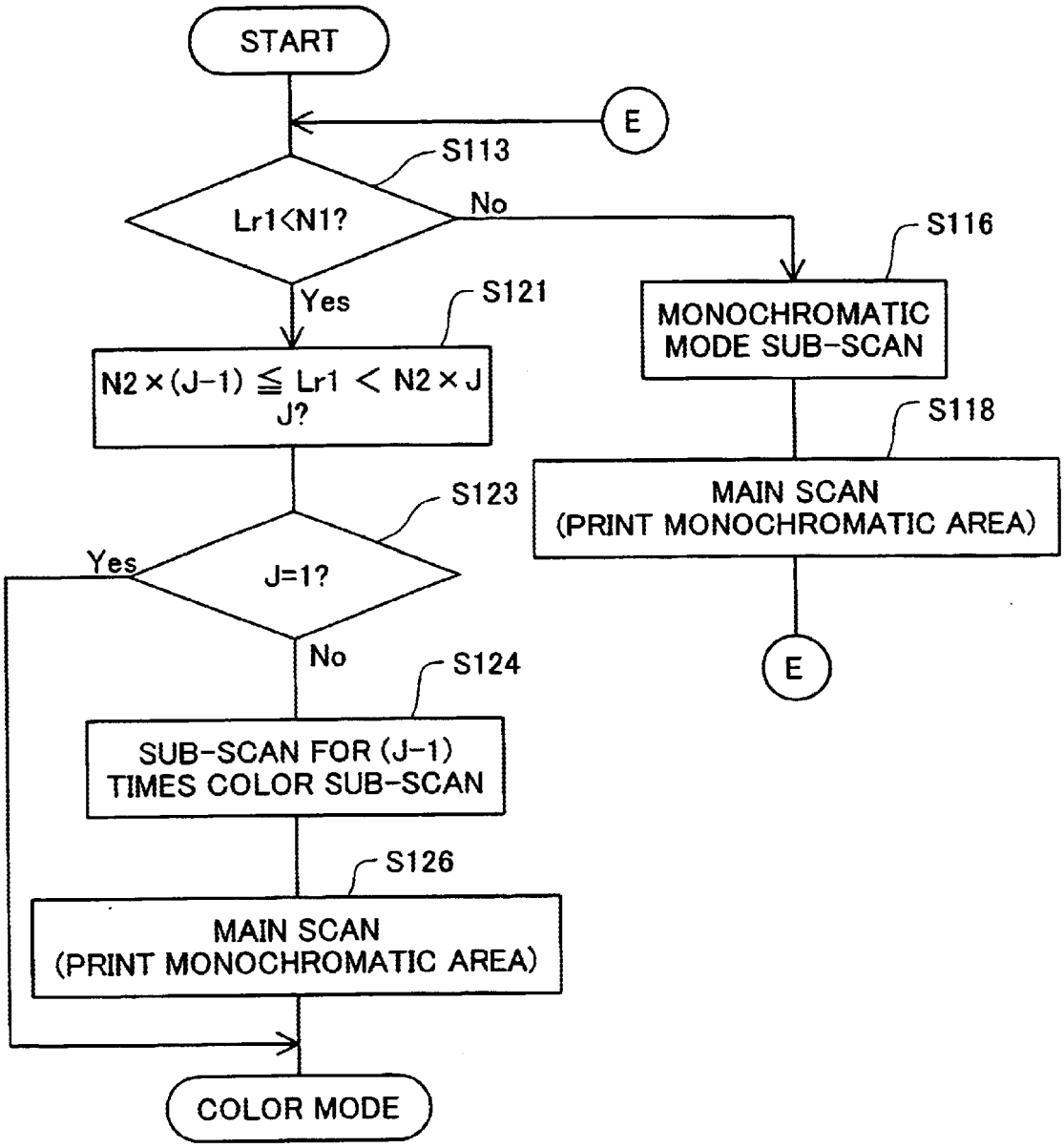
FIG. 37 is a flowchart showing an example of another process for monochromatic mode printing.

(6) Shift 2 from Monochromatic Mode Printing to Color Mode Printing:

FIG. 37 is a flowchart showing an example of another process for monochromatic mode printing. In the flowchart of FIG. 37, Step S113 is executed instead of Steps S112 and S114 of FIG. 34, and Steps S121 and S123 are executed instead of Steps S120 and S122 of FIG. 34. The other points are identical to the flowchart of FIG. 34. The process for monochromatic mode printing is able to do the following.

First of all, in Step S113, a comparison is made between the number N1, which is the number of nozzles in black nozzle group K, and the number Lr1, which is the number of main scan lines in the remaining monochromatic areas, in other words main scan lines that have not yet been completely recorded which are also main scan lines for the monochromatic areas to be currently recorded. If the number Lr1, being the number of remaining monochromatic area main scan lines, is equal to or greater than N1, then Steps S116 and S118 will be executed, and monochromatic mode printing will be performed.

In Step S113, if the number Lr1 of main scan lines in the remaining monochromatic area is less than N1, then in Step S121 a determination is made of an integer J such that the number Lr1 of main scan lines in the remaining monochromatic area will be equal to or more than (J−1) times N2 and less than J times N2. The number N2 is the number of nozzles in each of the cyan, magenta, and yellow nozzle groups. Then in Step S123 a transition to the color mode is made as is if J is 1, or a positioning feed is made in Step S124 if J is equal to or greater than 2.

The execution of such a process will also allow printing to be performed suitably as shown in FIGS. 28, 35, and 36. And, if such a process is used, a simpler process may be used to execute the transition from monochromatic mode printing to color mode printing.

D. Variation

Note that this invention is not limited by the working examples and embodiments noted above, but that in fact it is possible to implement the invention in a variety of aspects that do not stray from the scope of the key points, with a variation such as follows possible.

FIGS. 23 and 24 are explanatory diagrams that show another unit scan operation. The color mode printing and monochromatic mode printing shown above can be applied to nozzle configurations and unit scan operations other than the nozzle configurations and unit scan operations shown in FIGS. 4 and 5 as well as in FIGS. 17 and 18. For example, as shown in FIGS. 23 and 24, for the same nozzle configuration as the nozzle configuration shown in FIGS. 17 and 18, it is also possible to apply this to a case of doing three repetitions of a small feed of 1 dot each and performing four main scans to complete a unit scan operation. For this kind of embodiment, as shown in FIG. 23, the achromatic unit band recorded with one unit scan operation is 60 continuous main scan lines, and as shown in FIG. 24, the single chromatic unit band is 20 continuous main scan lines. For this kind of embodiment, the main scan lines recorded by the unit scan operation are all aligned with no gap in the sub-scan direction, so it is possible to execute printing with the same processing as for the first working example.

Nozzle pitch k can also be set to a suitable value such as 6 or 8 rather than being limited to the value 4. In this case, it is preferable that the feed amount of the fine feed performed with the unit scan operation be a value that is disjoint with nozzle pitch k. By setting in this way, it is possible to perform sub-scans with a constant feed amount and to record all the main scan lines with no gap. It is also preferable that the fine feed count be (k−1).

Figure 38:
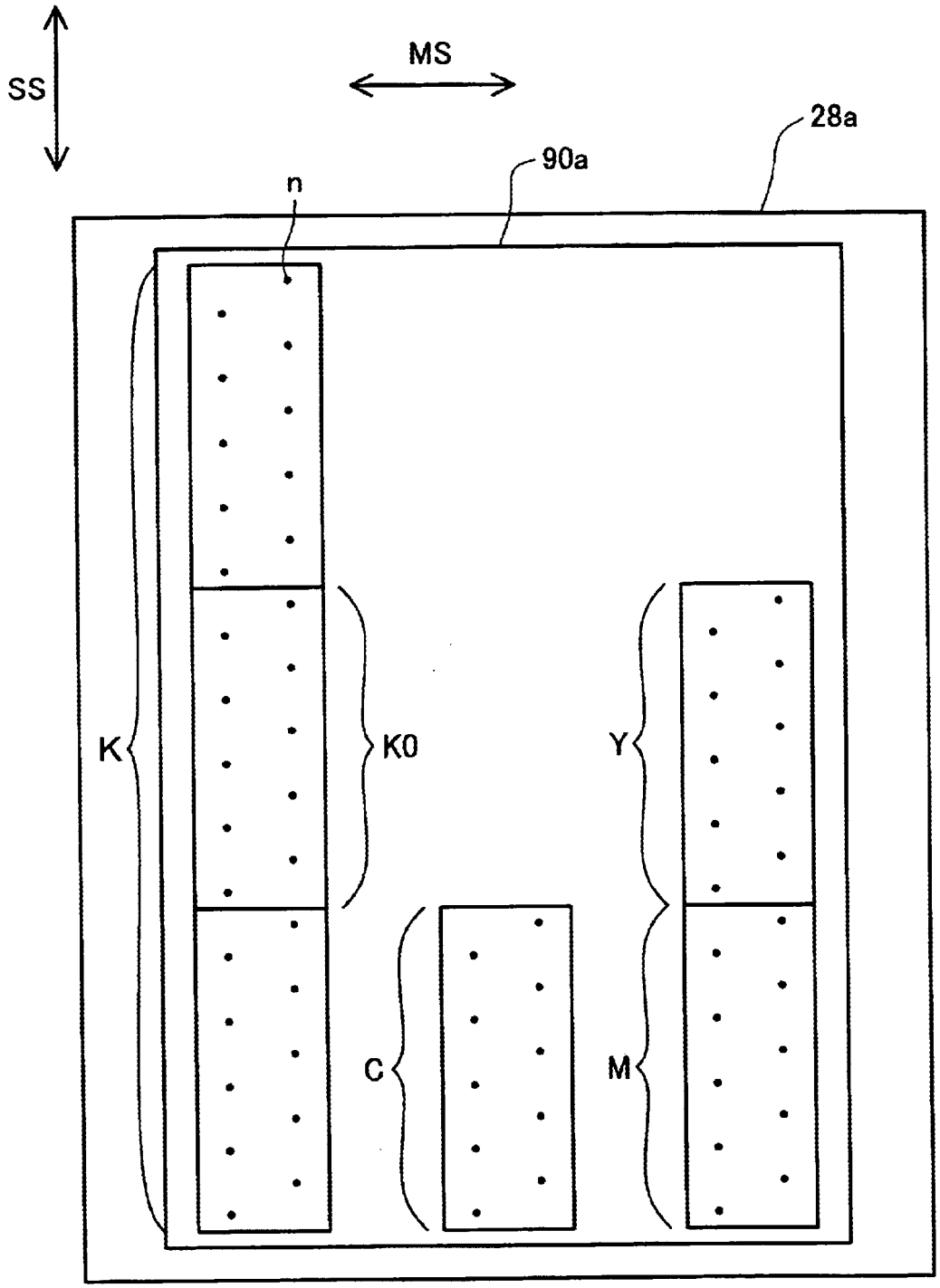
FIG. 38 is an explanatory diagram showing the disposition of the nozzle of print head 28*a* of another embodiment.
Figure 39:
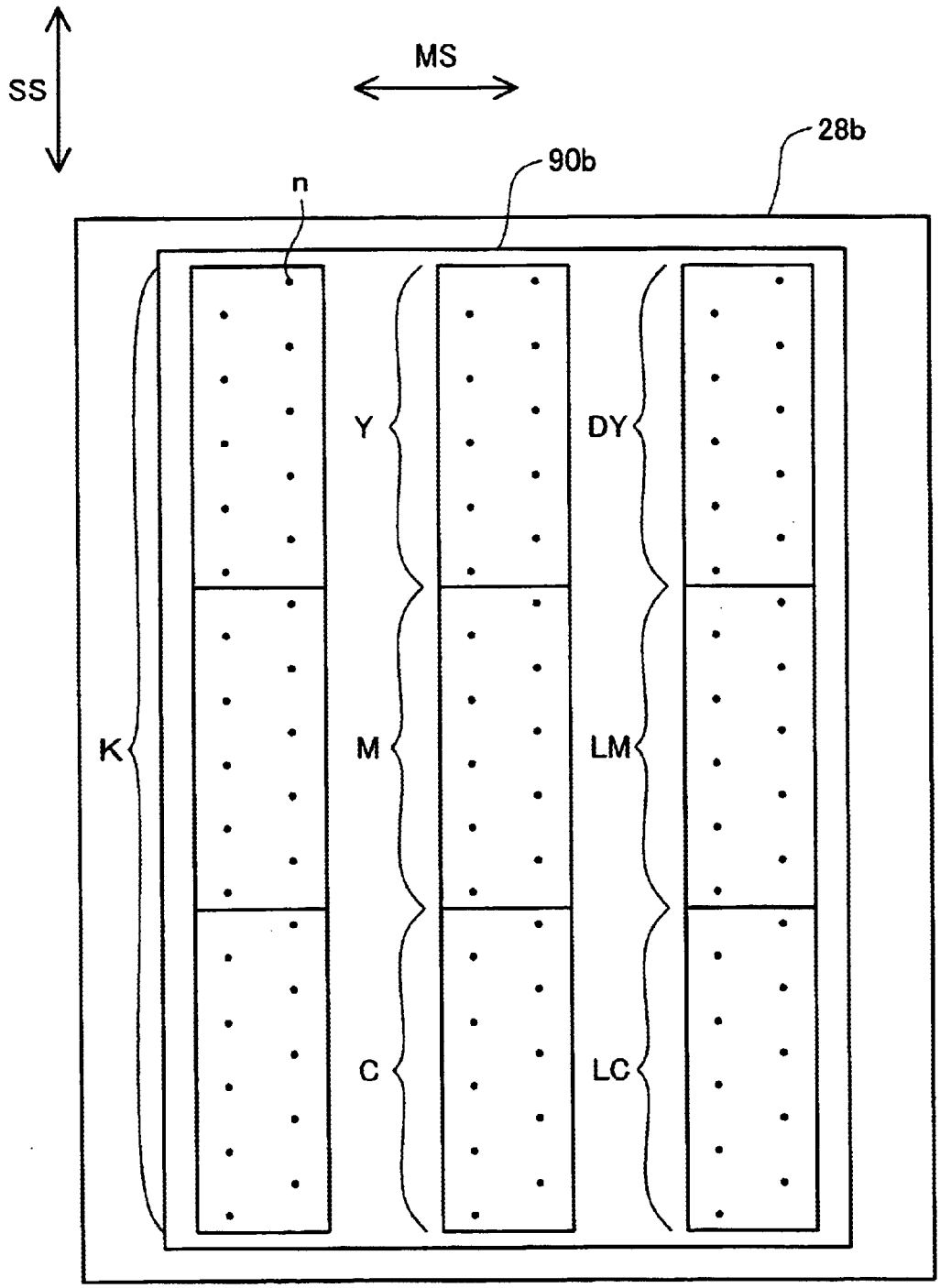
FIG. 39 is an explanatory diagram showing the disposition of the nozzle of print head 28*b* of another embodiment.

FIGS. 38 and 39 are explanatory diagrams that show the nozzle arrangement of printing heads 28*a* and 28*b* of another embodiment. In the aforementioned working examples, the nozzles contained in each nozzle group were aligned in a row, but the nozzles contained in each nozzle group can also be aligned in two rows as shown in FIG. 38 or in 3 or more rows. Also, the nozzles of a nozzle group can also be arranged in an array whereby they have different arrangements from each other in sub-scan direction SS, a so-called zigzag arrangement. Then, for the aforementioned working examples, each nozzle row for cyan, magenta, and yellow was aligned in a row in the sub-scan direction SS, but it is also possible to provide the single chromatic nozzle groups provided in differing positions for main scan direction MS as shown in FIG. 38. It is also acceptable if the range in which the achromatic nozzle groups exist in the sub-scan direction SS and the range in which a plurality of single chromatic nozzle groups exist in the sub-scan direction SS do not match. Furthermore, for the aforementioned working examples, the single chromatic nozzle groups were the cyan, magenta, and yellow nozzle groups, but single chromatic nozzle groups can also include nozzle groups that eject other color inks such as light cyan, light magenta, and dark yellow as shown in FIG. 39, for example. It is also possible to include nozzles that eject achromatic inks such as gray. Specifically, the "single chromatic nozzle groups" can have any nozzle arrangement, any ink color, and any number of ink colors as long as there is a mutually equal number of nozzles and these eject different colored inks from each other. The inks ejected by single chromatic nozzle groups are the inks used for color mode printing.

Also, with the aforementioned working examples, the achromatic nozzle groups were nozzle groups that eject black ink, but when printing data includes areas to be recorded by a single color ink other than black, it is possible to eject an ink for recording that area from an achromatic nozzle group. Furthermore, it is also possible to provide two or more achromatic nozzle groups. In this case, it is preferable that the number of nozzles of each single chromatic nozzle group be equal.

Also, with the aforementioned working examples, the special black nozzle group K0 used for color mode printing was one group of nozzles placed at the bottom of the nozzles of black nozzle group K. However, as shown in FIG. 38, a special achromatic nozzle group can be nozzle group K0 that is placed near the center of sub-scan direction SS of the achromatic nozzle group, or can be nozzles placed in another position. Specifically, it can be a nozzle group that is part of the achromatic nozzle group and that contains the same number of nozzles as the single chromatic nozzle groups.

The printing head may include a plurality of single chromatic nozzle groups each consisting of plurality of nozzles that are arranged at nozzle pitch k D where k is an integer of at least 2 and D is a pitch of main scan lines, the plurality of single chromatic nozzle groups being configured to eject mutually different chromatic inks. The printing head may also include an achromatic nozzle group for ejecting achromatic ink. The achromatic nozzle group consists of a greater number of nozzles that are arranged at nozzle pitch k D than each of the single chromatic nozzle groups.

The color mode printing may be executed by repeating a unit scan operation using a specific achromatic nozzle group and the plurality of single chromatic nozzle groups. The unit scan operation consists of k main scans and (k−1) sub-scans of a first feed amount. The color mode sub-scan of a second feed amount may be performed in each interval between each unit scan operations.

The monochromatic mode printing may be executed by repeating the unit scan operation using all the nozzles of the achromatic nozzle group but without using the single chromatic nozzle groups while a monochromatic mode sub-scan of a third feed amount more than the second feed amount is performed in each interval between each unit scan operations.

In this Specification, when the transition from color mode printing to monochromatic mode printing was performed, switching to monochromatic mode printing is performed after executing a positioning feed and a unit scan operation or a main scan in the color mode printing. For example, In FIG. 8 the positioning feed (Step S36) for feed amount Sc1 after the 24th pass, and the unit scan operation (Step 38), which includes the 25th through 28th passes, are to be included in color mode printing (refer to FIGS. 6 and 7 showing the color mode printing procedure). Note that it is only for the sake of convenience that the positioning feed and unit scan operation or main scan are included in the color mode printing process rather than in the monochromatic mode printing process. Therefore, the positioning feed and the subsequent unit scan operation or main scan can also be thought of as being included in monochromatic mode printing after the color mode printing has been executed.

Similarly, in this Specification, when the transition is made from monochromatic mode printing to color mode printing, during the monochromatic mode printing the positioning feed is executed and then a unit scan operation or main scan is executed, after which the transition is made to color mode printing. For example in FIG. 8, the positioning feed (Step S64) for the feed amount Sc2 after the 36th pass and the unit scan operation including passes 37 through 40 (Step S66) are included within monochromatic mode printing (refer to FIG. 13, showing the procedure for monochromatic mode printing). Note that it is only for the sake of convenience that the positioning feed and the subsequent unit scan operation or main scan are included in the monochromatic mode printing process. Therefore, the positioning feed and the subsequent unit scan operation or main scan can also be thought of as being included in color mode printing after the transition has been executed.

With each of the aforementioned working examples, we gave an explanation of an inkjet printer, but the present invention is not limited to inkjet printers, but rather can generally be applied to various printing apparatus that perform printing using printing heads. Also, the present invention is not limited to a method and device for ejecting ink drops, but can also be applied to a method or device for recording dots by other means.

With each of the aforementioned working examples, it is possible to replace part of the configuration that is realized by hardware using software, and conversely, part of the configuration that is realized using software can be replaced by hardware. For example, part of the function of head drive circuit 52 shown in FIG. 2 can be realized using software.

Although the present invention has been described and illustrated in detail, it is clearly understood that the same is by way of illustration and example only and is not to be taken by way of limitation, the spirit and scope of the present invention being limited only by the terms of the appended claims.

What we claimed is:

1. A printing method comprising the steps of:

(a) executing monochromatic mode printing by repeating a unit scan operation using an achromatic nozzle group, the unit scan operation consisting of main scans and intervening sub-scans of a first feed amount, wherein all dot positions in a first achromatic unit band consisting of plural main scan lines without any gap therebetween are serviced in a single unit scan operation by the achromatic nozzle group, and wherein a monochromatic mode sub-scan of a second feed amount is performed in each interval between each unit scan operations, and (b) executing color mode printing by repeating the unit scan operation using a specific achromatic nozzle group and a plurality of single chromatic nozzle groups while a color mode sub-scan of a third feed amount less than the second feed amount is performed in each interval between each unit scan operations, the specific achromatic nozzle group being part of the achromatic nozzle group, wherein the step (a) comprises:

(a1) in a case that a lowermost main scan line of a second achromatic unit band comes to be positioned within the color area when it is assumed that a set of the color mode sub-scan and the unit scan operation is performed J times (where J is an integer of two or greater), the second achromatic unit band consisting of plural main scan lines without any gap therebetween for which the specific achromatic nozzle group services with a single unit scan operation, performing a sub-scan whose feed amount is equal to a sum of (J−1) times the third feed amount and (J−2) times a total feed amount of sub-scans performed in one unit scan operation; and proceeding to the color mode printing.

2. A printing method comprising the steps of:

(a) executing monochromatic mode printing by repeating a unit scan operation using an achromatic nozzle group, the unit scan operation consisting of main scans and intervening sub-scans of a first feed amount, wherein all dot positions in a first achromatic unit band consisting of plural main scan lines without any gap therebetween are serviced in a single unit scan operation by the achromatic nozzle group, and wherein a monochromatic mode sub-scan of a second feed amount is performed in each interval between each unit scan operations, and (b) executing color mode printing by repeating the unit scan operation using a specific achromatic nozzle group and a plurality of single chromatic nozzle groups while a color mode sub-scan of a third feed amount less than the second feed amount is performed in each interval between each unit scan operations, the specific achromatic nozzle group being part of the achromatic nozzle group, wherein the step (a) comprises:

(a1) in a case that a lowermost main scan line of the first achromatic unit band comes to be positioned within the color area when it is assumed that the monochromatic mode sub-scan of the second feed amount and the unit scan operation are performed, proceeding to the color mode printing.

3. A printing method comprising the steps of:

providing a print head having:

a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups; and printing images in a monochromatic area on a printing medium with the achromatic ink alone, and in a color area with the chromatic inks, the step of printing images comprising the steps of:

(a) executing monochromatic mode printing by repeating a unit scan operation using all the nozzles of the achromatic nozzle group but without using the single chromatic nozzle groups, the unit scan operation consisting of k main scans and (k−1) sub-scans of a first feed amount, wherein the unit scan operation in the monochromatic mode printing is performed such that all dot positions in a first achromatic unit band consisting of plural main scan lines without any gap therebetween are serviced by the achromatic nozzle group, and wherein a monochromatic mode sub-scan of a second feed amount is performed in each interval between each unit scan operations, and (b) executing color mode printing by repeating the unit scan operation using a specific achromatic nozzle group and the plurality of single chromatic nozzle groups while a color mode sub-scan of a third feed amount less than the second feed amount is performed in each interval between each unit scan operations, the specific achromatic nozzle group being part of the achromatic nozzle group, wherein the step (a) comprises:

(a1) in a case that (i) a lowermost main scan line of the first achromatic unit band comes to be positioned within the color area when it is assumed that the monochromatic mode sub-scan and the unit scan operation are performed next, that (ii) a lowermost main scan line of a second achromatic unit band comes to be positioned within the color area when it is assumed that a set of the color mode sub-scan and the unit scan operation is performed J times (where J is an integer of two or greater), and that (iii) a lowermost main scan line of the second achromatic unit band comes to be positioned within the monochromatic area when it is assumed that the set of the color mode sub-scan and the unit scan operation is performed (J−1) times, the second achromatic unit band consisting of plural main scan lines without any gap therebetween for which the specific achromatic nozzle group services with a single unit scan operation, performing a sub-scan whose feed amount is equal to a sum of (J−1) times the third feed amount and (J−2) times a total feed amount of sub-scans performed in one unit scan operation;

performing the unit scan operation once, while forming dots in the monochromatic area using the achromatic nozzle group; and proceeding to the color mode printing.

4. The printing method according to claim 3, wherein the plurality of single chromatic nozzle groups includes C nozzle rows each of which includes N nozzles arranged in the sub-scan direction at the nozzle pitch k×D, where C is an integer of at least 2 and N is an integer of at least 2, the achromatic nozzle group includes a nozzle row consisting of N×C nozzles arranged in the sub-scan direction at the nozzle pitch k×D, wherein the first feed amount is equal to D, the second feed amount is equal to N×C×k×D, and the third feed amount is equal to N×k×D.

5. The printing method according to claim 3, wherein the plurality of single chromatic nozzle groups includes C nozzle rows each of which includes N nozzles arranged in the sub-scan direction at the nozzle pitch k×D, where C is an integer of at least 2 and N is an integer of at least 2, the achromatic nozzle group includes a nozzle row consisting of N×C nozzles arranged in the sub-scan direction at the nozzle pitch k×D, wherein the first feed amount is equal to m×D (where m is an integer of 2 or greater that disjoints with k), the second feed amount is determined such that a sub-scan by the second feed amount will put an upper end nozzle of the achromatic nozzle group at a position of a main scan line immediately below a lower edge of the bundle of main scan lines recorded by the immediately prior unit scan operation without any gap therebetween, and the third feed amount is determined such that a sub-scan by the third feed amount will put a nozzle positioned at the very top of the nozzles of the plurality of single chromatic nozzle groups at a position of a main scan line immediately below a lower edge of a bundle of main scan lines without any gap therebetween for which recording is completed by the immediately prior unit scan operation.

6. The printing method according to claim 3, wherein the step (a) further comprises:

(a2) in a case that a lowermost main scan line of the second achromatic unit band comes to be positioned within the color area when it is assumed that the color mode sub-scan and the unit scan operation are performed next, proceeding to the color mode printing.

7. A printing method comprising the steps of:

providing a print head having:

a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups; and printing images in a monochromatic area on a printing medium with the achromatic ink alone, and in a color area with the chromatic inks, the step of printing images comprising the steps of:

(a) executing monochromatic mode printing by repeating a unit scan operation using all the nozzles of the achromatic nozzle group but without using the single chromatic nozzle groups, the unit scan operation consisting of k main scans and (k−1) sub-scans of a first feed amount, wherein the unit scan operation in the monochromatic mode printing is performed such that all dot positions in a first achromatic unit band consisting of plural main scan lines without any gap therebetween are serviced by the achromatic nozzle group, and wherein a monochromatic mode sub-scan of a second feed amount is performed in each interval between each unit scan operations, (b) executing color mode printing by repeating the unit scan operation using a specific achromatic nozzle group and the plurality of single chromatic nozzle groups while a color mode sub-scan of a third feed amount less than the second feed amount is performed in each interval between each unit scan operations, the specific achromatic nozzle group being part of the achromatic nozzle group, wherein the step (a) comprises:

(a1) in a case that main scan line count Lr1 of a remaining monochromatic area is (i) smaller than main scan line count L1 of the first achromatic unit band, (ii) equal to or larger than main scan line count of (J−1) times of main scan line count L2, and (iii) smaller than main scan line count of J times of main scan line count L2, the main scan line count L2 being a main scan line count of a second achromatic unit band, the second achromatic unit band consisting of plural main scan lines without any gap therebetween for which the specific achromatic nozzle group services with a single unit scan operation, performing a sub-scan whose feed amount is equal to a sum of (J−1) times the third feed amount and (J−2) times a total feed amount of sub-scans performed in one unit scan operation;

performing the unit scan operation once, while forming dots in the monochromatic area using the achromatic nozzle group; and proceeding to the color mode printing.

8. The printing method according to claim 7, wherein the step (a) further comprises:

(a2) in a case that main scan line count Lr1 of the remaining monochromatic area is smaller than main scan line count L2, proceeding to the color mode printing.

9. A printing method comprising the steps of:

(a) executing color mode printing by repeating a unit scan operation using a specific achromatic nozzle group and a plurality of single chromatic nozzle groups, the unit scan operation consisting of main scans and intervening sub-scans of a first feed amount, the specific achromatic nozzle group being part of an achromatic nozzle group, wherein a color mode sub-scan of a second feed amount is performed in each interval between each unit scan operations, (b) executing monochromatic mode printing by repeating the unit scan operation using the achromatic nozzle group while a monochromatic mode sub-scan of a third feed amount more than the second feed amount is performed in each interval between each unit scan operations, wherein the step (a) comprises:

in a case that all main scan lines of the color unit lines come to be positioned within the monochromatic area when it is assumed that the color mode sub-scan and the unit scan operation are performed next, performing a sub-scan of a specific feed amount so that the uppermost main scan line of an achromatic unit band comes to an upper edge of the monochromatic area, the achromatic unit band consisting of plural main scan lines without any gap therebetween for which the achromatic nozzle group services with a single unit scan operation; and proceeding to the monochromatic mode printing.

10. A printing method comprising the steps of:

providing a print head having:

a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups; and printing images in a monochromatic area on a printing medium with the achromatic ink alone, and in a color area with the chromatic inks, the step of printing images comprising the steps of:

(a) executing color mode printing by repeating a unit scan operation using a specific achromatic nozzle group and the plurality of single chromatic nozzle groups, the unit scan operation consisting of k main scans and (k−1) sub-scans of a first feed amount, the specific achromatic nozzle group being part of the achromatic nozzle group, wherein a color mode sub-scan of a second feed amount is performed in each interval between each unit scan operations, (b) executing monochromatic mode printing by repeating the unit scan operation using all the nozzles of the achromatic nozzle group but without using the single chromatic nozzle groups while a monochromatic mode sub-scan of a third feed amount more than the second feed amount is performed in each interval between each unit scan operations, wherein the step (a) comprises:

(a1) in a case that when it is assumed that the color mode sub-scan and the unit scan operation are performed next, (i) a lowermost main scan line of specific achromatic unit lines comes to be positioned within the monochromatic area, the specific achromatic unit lines consisting of plural main scan lines for which the specific achromatic nozzle group services with a single unit scan operation, and also (ii) the uppermost main scan line of color unit lines comes to be positioned within the color area, the color unit lines consisting of plural main scan lines for which an uppermost single chromatic nozzle group services with a single unit scan operation, performing the color mode sub-scan; and performing the unit scan operation, while not forming dots in the monochromatic area by the specific achromatic nozzle group but forming dots in the color area using the single chromatic nozzle groups;

(a2) in a case that all main scan lines of the color unit lines come to be positioned within the monochromatic area when it is assumed that the color mode sub-scan and the unit scan operation are performed next, performing a sub-scan of a specific feed amount so that the uppermost main scan line of an achromatic unit band comes to an upper edge of the monochromatic area, the achromatic unit band consisting of plural main scan lines without any gap therebetween for which the achromatic nozzle group services with a single unit scan operation;

performing the unit scan operation once, while forming dots in the monochromatic area using the achromatic nozzle group; and proceeding to the monochromatic mode printing.

11. The printing method according to claim 10, wherein the plurality of single chromatic nozzle groups includes C nozzle rows each of which includes N nozzles arranged in the sub-scan direction at the nozzle pitch k×D, where C is an integer of at least 2 and N is an integer of at least 2, the achromatic nozzle group includes a nozzle row consisting of N×C nozzles arranged in the sub-scan direction at the nozzle pitch k×D, wherein the first feed amount is equal to D, the second feed amount is equal to N×k×D, and the third feed amount is equal to N×C×k×D.

12. The printing method according to claim 10, wherein the plurality of single chromatic nozzle groups includes C nozzle rows each of which includes N nozzles arranged in the sub-scan direction at the nozzle pitch k×D, where C is an integer of at least 2 and N is an integer of at least 2, the achromatic nozzle group includes a nozzle row consisting of N×C nozzles arranged in the sub-scan direction at the nozzle pitch k×D, wherein the first feed amount is equal to m×D (where m is an integer of 2 or greater that disjoints with k), the second feed amount is determined such that a sub-scan by the second feed amount will put a nozzle positioned at the very top of the nozzles of the plurality of single chromatic nozzle groups at a position of a main scan line immediately below a lower edge of a bundle of main scan lines without any gap therebetween for which recording is completed by the immediately prior unit scan operation; and the third feed amount is determined such that a sub-scan by the third feed amount will put an upper end nozzle of the achromatic nozzle group at a position of a main scan line immediately below a lower edge of the bundle of main scan lines recorded by the immediately prior unit scan operation without any gap therebetween.

13. A printing method comprising the steps of:

(a) executing color mode printing by repeating a unit scan operation using a specific achromatic nozzle group and a plurality of single chromatic nozzle groups, the unit scan operation consisting of main scans and intervening sub-scans of a first feed amount, the specific achromatic nozzle group being part of an achromatic nozzle group, wherein a color mode sub-scan of a second feed amount is performed in each interval between each unit scan operations, (b) executing monochromatic mode printing by repeating the unit scan operation using the achromatic nozzle group while a monochromatic mode sub-scan of a third feed amount more than the second feed amount is performed in each interval between each unit scan operations, wherein the step (a) comprises:

in a case that a lowermost main scan line of a color unit band comes to be positioned within the monochromatic area when it is assumed that the color mode sub-scan and the unit scan operation are performed next, the color unit band consisting of plural main scan lines without any gap therebetween for which the uppermost single chromatic nozzle group services with a single unit scan operation, performing a sub-scan of a specific feed amount so that the lowermost main scan line of the color unit band comes to a lower edge of the color area when it is assumed that the unit scan operation are performed;

performing a sub-scan of a specific feed amount so that the uppermost main scan line of an achromatic unit band comes to an upper edge of the monochromatic area, the achromatic unit band consisting of plural main scan lines without any gap therebetween for which the achromatic nozzle group services with a single unit scan operation; and proceeding to the monochromatic mode printing.

14. A printing method comprising the steps of:

providing a print head having:

a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups; and printing images in a monochromatic area on a printing medium with the achromatic ink alone, and in a color area with the chromatic inks, the step of printing images comprising the steps of:

(a) executing color mode printing by repeating a unit scan operation using a specific achromatic nozzle group and the plurality of single chromatic nozzle groups, the unit scan operation consisting of k main scans and (k−1) sub-scans of a first feed amount, the specific achromatic nozzle group being part of the achromatic nozzle group, wherein a color mode sub-scan of a second feed amount is performed in each interval between each unit scan operations, (b) executing monochromatic mode printing by repeating the unit scan operation using all the nozzles of the achromatic nozzle group but without using the single chromatic nozzle groups while a monochromatic mode sub-scan of a third feed amount more than the second feed amount is performed in each interval between each unit scan operations, wherein the step (a) comprises:

(a1) in a case that when it is assumed that the color mode sub-scan and the unit scan operation are performed next, (i) a lowermost main scan line of specific achromatic unit lines comes to be positioned within the monochromatic area, the specific achromatic unit lines consisting of plural main scan lines for which the specific achromatic nozzle group services with a single unit scan operation, and also (ii) the uppermost main scan line of color unit lines comes to be positioned within the color area, the color unit lines consisting of plural main scan lines for which an uppermost single chromatic nozzle group services with a single unit scan operation, performing the color mode sub-scan; and performing the unit scan operation, while not forming dots in the monochromatic area by the specific achromatic nozzle group but forming dots in the color area using the single chromatic nozzle groups;

(a2) in a case that a lowermost main scan line of a color unit band comes to be positioned within the monochromatic area when it is assumed that the color mode sub-scan and the unit scan operation are performed next, the color unit band consisting of plural main scan lines without any gap therebetween for which the uppermost single chromatic nozzle group services with a single unit scan operation, performing a sub-scan of a specific feed amount so that the lowermost main scan line of the color unit band comes to a lower edge of the color area when it is assumed that the unit scan operation are performed;

performing the unit scan operation once, while not forming dots in the monochromatic area by the specific achromatic nozzle group but forming dots in the color area using the single chromatic nozzle groups;

performing a sub-scan of a specific feed amount so that the uppermost main scan line of an achromatic unit band comes to an upper edge of the monochromatic area, the achromatic unit band consisting of plural main scan lines without any gap therebetween for which the achromatic nozzle group services with a single unit scan operation;

performing the unit scan operation once, while forming dots in the monochromatic area using the achromatic nozzle group; and proceeding to the monochromatic mode printing.

15. The printing method according to claim 14, wherein the plurality of single chromatic nozzle groups includes C nozzle rows each of which includes N nozzles arranged in the sub-scan direction at the nozzle pitch k×D, where C is an integer of at least 2 and N is an integer of at least 2, the achromatic nozzle group includes a nozzle row consisting of N×C nozzles arranged in the sub-scan direction at the nozzle pitch k×D, wherein the first feed amount is equal to D, the second feed amount is equal to N×k×D, and the third feed amount is equal to N×C×k×D.

16. The printing method according to claim 14, wherein the plurality of single chromatic nozzle groups includes C nozzle rows each of which includes N nozzles arranged in the sub-scan direction at the nozzle pitch k×D, where C is an integer of at least 2 and N is an integer of at least 2, the achromatic nozzle group includes a nozzle row consisting of N×C nozzles arranged in the sub-scan direction at the nozzle pitch k×D, wherein the first feed amount is equal to m×D (where m is an integer of 2 or greater that disjoints with k), the second feed amount is determined such that a sub-scan by the second feed amount will put a nozzle positioned at the very top of the nozzles of the plurality of single chromatic nozzle groups at a position of a main scan line immediately below a lower edge of a bundle of main scan lines without any gap therebetween for which recording is completed by the immediately prior unit scan operation; and the third feed amount is determined such that a sub-scan by the third feed amount will put an upper end nozzle of the achromatic nozzle group at a position of a main scan line immediately below a lower edge of the bundle of main scan lines recorded by the immediately prior unit scan operation without any gap therebetween.

17. A printing method comprising the steps of:

providing a print head having:

a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups; and printing images in a monochromatic area on a printing medium with the achromatic ink alone, and in a color area with the chromatic inks, the step of printing images comprising the steps of:

(a) executing color mode printing by repeating a unit scan operation using a specific achromatic nozzle group and the plurality of single chromatic nozzle groups, the unit scan operation consisting of k main scans and (k−1) sub-scans of a first feed amount, the specific achromatic nozzle group being part of the achromatic nozzle group, wherein a color mode sub-scan of a second feed amount is performed in each interval between each unit scan operations, (b) executing monochromatic mode printing by repeating the unit scan operation using all the nozzles of the achromatic nozzle group but without using the single chromatic nozzle groups while a monochromatic mode sub-scan of a third feed amount more than the second feed amount is performed in each interval between each unit scan operations, wherein the step (a) comprises:

(a1) in a case that (i) a lowermost main scan line of specific achromatic unit lines comes to be positioned within the monochromatic area when it is assumed that the color mode sub-scan and the unit scan operation are performed next, and (ii) main scan line count Lr2 of a remaining color area is equal to or larger than main scan line count L2 of a single chromatic unit band, the remaining color area being an area of the color area comprising main scan lines not yet been recorded, the single chromatic unit band consisting of plural main scan lines without any gap therebetween for which a one of the single chromatic nozzle groups services with a single unit scan operation, performing the color mode sub-scan; and performing the unit scan operation, while not forming dots in the monochromatic area by the specific achromatic nozzle group but forming dots in the color area using the single chromatic nozzle groups;

(a2) in a case that main scan line count Lr2 of the remaining color area is smaller than main scan line count L2 of the single chromatic unit band, performing a sub-scan of a specific feed amount so that the lowermost main scan line of a color unit band comes to a lower edge of the remaining color area;

performing the unit scan operation once, while not forming dots in the monochromatic area by the specific achromatic nozzle group but forming dots in the color area using the single chromatic nozzle groups;

performing a sub-scan of a specific feed amount so that the uppermost main scan line of a achromatic unit band comes to an upper edge of the monochromatic area, the achromatic unit band consisting of plural main scan lines without any gap therebetween for which the achromatic nozzle group services with a single unit scan operation;

performing the unit scan operation once, while forming dots in the monochromatic area using the achromatic nozzle group; and proceeding to the monochromatic mode printing.

18. A printing method comprising the steps of:

providing a print head having:

a plurality of single chromatic nozzle groups each consisting of plurality of nozzles that are arranged at nozzle pitch D where D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch D than each of the single chromatic nozzle groups; and printing images in a monochromatic area on a printing medium with the achromatic ink alone, and in a color area with the chromatic inks, the step of printing images comprising the steps of:

(a) executing monochromatic mode printing by repeating a main scan using all the nozzles of the achromatic nozzle group but without using the single chromatic nozzle groups, and wherein a monochromatic mode sub-scan of a first feed amount is performed in each interval between each main scans, and (b) executing color mode printing by repeating the main scan using a specific achromatic nozzle group and the plurality of single chromatic nozzle groups while a color mode sub-scan of a second feed amount less than the first feed amount is performed in each interval between each main scans, the specific achromatic nozzle group being part of the achromatic nozzle group, wherein the step (a) comprises:

(a1) in a case that (i) a lowermost nozzle of the achromatic nozzle group comes to be positioned over the color area when it is assumed that the monochromatic mode sub-scan is performed next, that (ii) a lowermost nozzle of the specific achromatic nozzle group comes to be positioned over the color area when it is assumed that a sub-scan of a feed amount J times (where J is an integer of two or greater) the second feed amount of the color mode sub-scan is performed, and that (iii) a lowermost nozzle of the specific achromatic nozzle group comes to be positioned over the monochromatic area when it is assumed that a sub-scan of a feed amount (J−1) times the second feed amount of the color mode sub-scan is performed, performing a sub-scan of a feed amount (J−1) times the second feed amount of the color mode sub-scan;

performing the main scan once, while forming dots in the monochromatic area using the achromatic nozzle group; and proceeding to the color mode printing.

19. The printing method according to claim 18, wherein the plurality of single chromatic nozzle groups includes C nozzle rows each of which includes N nozzles arranged in the sub-scan direction at the nozzle pitch D, where C is an integer of at least 2 and N is an integer of at least 2, the achromatic nozzle group includes a nozzle row consisting of N×C nozzles arranged in the sub-scan direction at the nozzle pitch D, wherein the first feed amount is equal to N×C×D, and the second feed amount is equal to N×D.

20. The printing method according to claim 18, wherein the step (a) further comprises:

(a2) in a case that a lowermost nozzle of the specific achromatic nozzle group comes to be positioned over the color area when it is assumed that the color mode sub-scan is performed next, proceeding to the color mode printing.

21. A printing method comprising the steps of:

providing a print head having:

a plurality of single chromatic nozzle groups each consisting of plurality of nozzles that are arranged at nozzle pitch D where D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch D than each of the single chromatic nozzle groups; and printing images in a monochromatic area on a printing medium with the achromatic ink alone, and in a color area with the chromatic inks, the step of printing images comprising the steps of:

(a) executing monochromatic mode printing by repeating a main scan using all the nozzles of the achromatic nozzle group but without using the single chromatic nozzle groups, and wherein a monochromatic mode sub-scan of a first feed amount is performed in each interval between each main scans, and (b) executing color mode printing by repeating the main scan using a specific achromatic nozzle group and the plurality of single chromatic nozzle groups while a color mode sub-scan of a second feed amount less than the first feed amount is performed in each interval between each main scans, the specific achromatic nozzle group being part of the achromatic nozzle group, wherein the step (a) comprises:

(a1) in a case that main scan line count Lr1 of a remaining monochromatic area is (i) smaller than a nozzle number N1 (where N1 is an integer of two or greater) of the achromatic nozzle group, (ii) equal to or larger than a number of (J−1) times (where J is an integer of two or greater) a nozzle number N2 (where N2 is an integer of two or greater) of the specific achromatic nozzle group, and (iii) smaller than a number of J times the nozzle number N2, performing a sub-scan of a feed amount (J−1) times the second feed amount of the color mode sub-scan;

performing the main scan once, while forming dots in the monochromatic area using the achromatic nozzle group; and proceeding to the color mode printing.

22. The printing method according to claim 21, wherein the step (a) further comprises:

(a2) in a case that main scan line count Lr1 of the remaining monochromatic area is smaller than the nozzle number N2, proceeding to the color mode printing.

23. A printing method comprising the steps of:

providing a print head having:

a plurality of single chromatic nozzle groups each consisting of plurality of nozzles that are arranged at nozzle pitch D where D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch D than each of the single chromatic nozzle groups; and printing images in a monochromatic area on a printing medium with the achromatic ink alone, and in a color area with the chromatic inks, the step of printing images comprising the steps of:

(a) executing color mode printing by repeating the main scan using a specific achromatic nozzle group and the plurality of single chromatic nozzle groups, and wherein a color mode sub-scan of a first feed amount is performed in each interval between each main scans, the specific achromatic nozzle group being part of the achromatic nozzle group, and (b) executing monochromatic mode printing by repeating a main scan using all the nozzles of the achromatic nozzle group but without using the single chromatic nozzle groups while a monochromatic mode sub-scan of a second feed amount more than the first feed amount is performed in each interval between each main scans, wherein the step (a) comprises:

(a1) in a case that when it is assumed that the color mode sub-scan is performed next, (i) a lowermost nozzle of specific achromatic nozzle group comes to be positioned over the monochromatic area, and also (ii) a nozzle positioned at the very top of the nozzles of the plurality of single chromatic nozzle groups comes to be positioned over the color area, performing the color mode sub-scan; and performing the main scan, while not forming dots in the monochromatic area by the specific achromatic nozzle group but forming dots in the color area using the single chromatic nozzle groups;

(a2) in a case that all nozzles of the plurality of single chromatic nozzle groups come to be positioned within the monochromatic area when it is assumed that the color mode sub-scan is performed next, performing a sub-scan of a specific feed amount so that an uppermost nozzle of the achromatic nozzle group comes over an upper edge of the monochromatic area,; and performing the main scan once, while forming dots in the monochromatic area using the achromatic nozzle group; and proceeding to the monochromatic mode printing.

24. The printing method according to claim 23, wherein the plurality of single chromatic nozzle groups includes C nozzle rows each of which includes N nozzles arranged in the sub-scan direction at the nozzle pitch D, where C is an integer of at least 2 and N is an integer of at least 2, the achromatic nozzle group includes a nozzle row consisting of N×C nozzles arranged in the sub-scan direction at the nozzle pitch D, wherein the first feed amount is equal to N×D, and the second feed amount is equal to N×C×D.

25. A printing method comprising the steps of:

providing a print head having:

a plurality of single chromatic nozzle groups each consisting of plurality of nozzles that are arranged at nozzle pitch D where D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch D than each of the single chromatic nozzle groups; and printing images in a monochromatic area on a printing medium with the achromatic ink alone, and in a color area with the chromatic inks, the step of printing images comprising the steps of:

(a) executing color mode printing by repeating the main scan using a specific achromatic nozzle group and the plurality of single chromatic nozzle groups, and wherein a color mode sub-scan of a first feed amount is performed in each interval between each main scans, the specific achromatic nozzle group being part of the achromatic nozzle group, and (b) executing monochromatic mode printing by repeating a main scan using all the nozzles of the achromatic nozzle group but without using the single chromatic nozzle groups while a monochromatic mode sub-scan of a second feed amount more than the first feed amount is performed in each interval between each main scans, wherein the step (a) comprises:

(a1) in a case that when it is assumed that the color mode sub-scan is performed next, (i) a lowermost nozzle of specific achromatic nozzle group comes to be positioned over the monochromatic area, and also (ii) a nozzle positioned at the very top of the nozzles of the plurality of single chromatic nozzle groups comes to be positioned over the color area, performing the color mode sub-scan; and performing the main scan, while not forming dots in the monochromatic area by the specific achromatic nozzle group but forming dots in the color area using the single chromatic nozzle groups;

(a2) in a case that a lowermost nozzle of an uppermost single chromatic nozzle group comes to be positioned within the monochromatic area when it is assumed that the color mode sub-scan is performed next, performing a sub-scan of a specific feed amount so that the lowermost nozzle of the uppermost single chromatic nozzle group comes to a lower edge of the color area;

performing the main scan once, while not forming dots in the monochromatic area by the specific achromatic nozzle group but forming dots in the color area using the single chromatic nozzle groups;

performing a sub-scan of a specific feed amount so that an uppermost nozzle of the achromatic nozzle group comes over an upper edge of the monochromatic area;

performing the main scan once, while forming dots in the monochromatic area using the achromatic nozzle group; and proceeding to the monochromatic mode printing.

26. The printing method according to claim 25, wherein the plurality of single chromatic nozzle groups includes C nozzle rows each of which includes N nozzles arranged in the sub-scan direction at the nozzle pitch D, where C is an integer of at least 2 and N is an integer of at least 2, the achromatic nozzle group includes a nozzle row consisting of N×C nozzles arranged in the sub-scan direction at the nozzle pitch D, wherein the first feed amount is equal to N×D, and the second feed amount is equal to N×C×D.

27. A printing method comprising the steps of:

providing a print head having:

a plurality of single chromatic nozzle groups each consisting of plurality of nozzles that are arranged at nozzle pitch D where D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch D than each of the single chromatic nozzle groups; and printing images in a monochromatic area on a printing medium with the achromatic ink alone, and in a color area with the chromatic inks, the step of printing images comprising the steps of: p2 (a) executing color mode printing by repeating the main scan using a specific achromatic nozzle group and the plurality of single chromatic nozzle groups, and wherein a color mode sub-scan of a first feed amount is performed in each interval between each main scans, the specific achromatic nozzle group being part of the achromatic nozzle group, and (b) executing monochromatic mode printing by repeating a main scan using all the nozzles of the achromatic nozzle group but without using the single chromatic nozzle groups while a monochromatic mode sub-scan of a second feed amount more than the first feed amount is performed in each interval between each main scans, wherein the step (a) comprises:

(a1) in a case that (i) a lowermost nozzle of specific achromatic nozzle group comes to be positioned over the monochromatic area when it is assumed that the color mode sub-scan is performed next, and (ii) main scan line count Lr2 of a remaining color area is equal to or larger than a nozzle number N2 of the single achromatic nozzle group, the remaining color area being an area of the color area comprising main scan lines not yet been recorded, performing the color mode sub-scan; and performing the main scan, while not forming dots in the monochromatic area by the specific achromatic nozzle group but forming dots in the color area using the single chromatic nozzle groups;

(a2) in a case that main scan line count Lr2 of the remaining color area is smaller than the nozzle number N2 of the single achromatic nozzle group, performing a sub-scan of a specific feed amount so that a lowermost nozzle of an uppermost single chromatic nozzle group comes over a lower edge of the remaining color area, performing the main scan once, while not forming dots in the monochromatic area by the specific achromatic nozzle group but forming dots in the color area using the single chromatic nozzle groups;

performing a sub-scan of a specific feed amount so that the uppermost nozzle of the achromatic nozzle group comes to an upper edge of the monochromatic area;

performing the main scan once, while forming dots in the monochromatic area using the achromatic nozzle group; and proceeding to the monochromatic mode printing.

28. A printing apparatus which prints images in a monochromatic area on a printing medium with an achromatic ink alone, and in a color area with chromatic inks, by ejecting ink drops from a nozzle to deposit the ink drops on the printing medium to form dots, comprising:

a printing head having:

a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks; and an achromatic nozzle group for ejecting achromatic ink, the achromatic nozzle group consisting of a greater number of nozzles that are arranged at nozzle pitch k×D than each of the single chromatic nozzle groups; and a main scan drive unit that moves at least one of the printing head and the printing medium to perform main scanning, a sub-scan drive unit that moves at least one of the printing head and the printing medium in a direction that intersects a main scanning direction to perform sub-scanning, and a control unit that controls each of these units, wherein the control unit has:

(a) a monochromatic mode unit that executes monochromatic mode printing by repeating a unit scan operation using all the nozzles of the achromatic nozzle group but without using the single chromatic nozzle groups, the unit scan operation consisting of k main scans and (k−1) sub-scans of a first feed amount, wherein the unit scan operation in the monochromatic mode printing is performed such that all dot positions in a first achromatic unit band consisting of plural main scan lines without any gap therebetween are serviced by the achromatic nozzle group, and wherein a monochromatic mode sub-scan of a second feed amount is performed in each interval between each unit scan operations, and (b) a color mode unit that executes color mode printing by repeating the unit scan operation using a specific achromatic nozzle group and the plurality of single chromatic nozzle groups while a color mode subscan of a third feed amount less than the second feed amount is performed in each interval between each unit scan operations, the specific achromatic nozzle group being part of the achromatic nozzle group, wherein the monochromatic mode unit comprising:

a shifting unit that performs a sub-scan whose feed amount is equal to a sum of (J−1) times the third feed amount and (J−2) times a total feed amount of sub-scans performed in one unit scan operation;

performs the unit scan operation once, while forming dots in the monochromatic area using the achromatic nozzle group; and proceeds to the color mode printing, in a case that (i) a lowermost main scan line of the first achromatic unit band comes to be positioned within the color area when it is assumed that the monochromatic mode sub-scan and the unit scan operation are performed next, that (ii) a lowermost main scan line of a second achromatic unit band comes to be positioned within the color area when it is assumed that a set of the color mode sub-scan and the unit scan operation is performed J times (where J is an integer of two or greater), and that (iii) a lowermost main scan line of the second achromatic unit band comes to be positioned within the monochromatic area when it is assumed that the set of the color mode sub-scan and the unit scan operation is performed (J−1) times, the second achromatic unit band consisting of plural main scan lines without any gap therebetween for which the specific achromatic nozzle group services with a single unit scan operation.

29. The printing apparatus according to claim 28, wherein the plurality of single chromatic nozzle groups includes C nozzle rows each of which includes N nozzles arranged in the sub-scan direction at the nozzle pitch k×D, where C is an integer of at least 2 and N is an integer of at least 2, the achromatic nozzle group includes a nozzle row consisting of N×C nozzles arranged in the sub-scan direction at the nozzle pitch k×D, wherein the first feed amount is equal to D, the second feed amount is equal to N×C×k×D, and the third feed amount is equal to N×k×D.

30. The printing apparatus according to claim 28, wherein the plurality of single chromatic nozzle groups includes C nozzle rows each of which includes N nozzles arranged in the sub-scan direction at the nozzle pitch k×D, where C is an integer of at least 2 and N is an integer of at least 2, the achromatic nozzle group includes a nozzle row consisting of N×C nozzles arranged in the sub-scan direction at the nozzle pitch k×D, wherein the first feed amount is equal to m×D (where m is an integer of 2 or greater that disjoints with k), the second feed amount is determined such that a sub-scan by the second feed amount will put an upper end nozzle of the achromatic nozzle group at a position of a main scan line immediately below a lower edge of the bundle of main scan lines recorded by the immediately prior unit scan operation without any gap therebetween, and the third feed amount is determined such that a sub-scan by the third feed amount will put a nozzle positioned at the very top of the nozzles of the plurality of single chromatic nozzle groups at a position of a main scan line immediately below a lower edge of a bundle of main scan lines without any gap therebetween for which recording is completed by the immediately prior unit scan operation.

31. The printing apparatus according to claim 28, wherein the shift unit proceeds to the color mode printing, in a case that a lowermost main scan line of the second achromatic unit band comes to be positioned within the color area when it is assumed that the color mode sub-scan and the unit scan operation are performed next.

32. A printing apparatus which prints images in a monochromatic area on a printing medium with an achromatic ink alone, and in a color area with chromatic inks, by ejecting ink drops from a nozzle to deposit the ink drops on the printing medium to form dots, comprising:

a printing head having:

a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks; and an achromatic nozzle group for ejecting achromatic ink, the achromatic nozzle group consisting of a greater number of nozzles that are arranged at nozzle pitch k×D than each of the single chromatic nozzle groups; and a main scan drive unit that moves at least one of the printing head and the printing medium to perform main scanning, a sub-scan drive unit that moves at least one of the printing head and the printing medium in a direction that intersects a main scanning direction to perform sub-scanning, and a control unit that controls each of these units, wherein the control unit has:

(a) a monochromatic mode unit that executes monochromatic mode printing by repeating a unit scan operation using all the nozzles of the achromatic nozzle group but without using the single chromatic nozzle groups, the unit scan operation consisting of k main scans and (k−1) sub-scans of a first feed amount, wherein the unit scan operation in the monochromatic mode printing is performed such that all dot positions in a first achromatic unit band consisting of plural main scan lines without any gap therebetween are serviced by the achromatic nozzle group, and wherein a monochromatic mode sub-scan of a second feed amount is performed in each interval between each unit scan operations, and (b) a color mode unit that executes color mode printing by repeating the unit scan operation using a specific achromatic nozzle group and the plurality of single chromatic nozzle groups while a color mode sub-scan of a third feed amount less than the second feed amount is performed in each interval between each unit scan operations, the specific achromatic nozzle group being part of the achromatic nozzle group, wherein the monochromatic mode unit comprising:

shifting unit that performs a sub-scan whose feed amount is equal to a sum of (J−1) times the third feed amount and (J−2) times a total feed amount of sub-scans performed in one unit scan operation;

performs the unit scan operation once, while forming dots in the monochromatic area using the achromatic nozzle group; and proceeds to the color mode printing, in a case that main scan line count Lr1 of a remaining monochromatic area is (i) smaller than main scan line count L1 of the first achromatic unit band, (ii) equal to or larger than main scan line count of (J−1) times of main scan line count L2, and (iii) smaller than main scan line count of J times of main scan line count L2, the main scan line count L2 being a main scan line count of a second achromatic unit band, the second achromatic unit band consisting of plural main scan lines without any gap therebetween for which the specific achromatic nozzle group services with a single unit scan operation.

33. The printing apparatus according to claim 32, wherein the shifting unit proceeds to the color mode printing, in a case that main scan line count Lr1 of the remaining monochromatic area is smaller than main scan line count L2.

34. A printing apparatus which prints images in a monochromatic area on a printing medium with an achromatic ink alone, and in a color area with chromatic inks, by ejecting ink drops from a nozzle to deposit the ink drops on the printing medium to form dots, comprising:

a printing head having:

a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks; and an achromatic nozzle group for ejecting achromatic ink, the achromatic nozzle group consisting of a greater number of nozzles that are arranged at nozzle pitch k×D than each of the single chromatic nozzle groups; and a main scan drive unit that moves at least one of the printing head and the printing medium to perform main scanning, a sub-scan drive unit that moves at least one of the printing head and the printing medium in a direction that intersects a main scanning direction to perform sub-scanning, and a control unit that controls each of these units, wherein the control unit has:

(a) a color mode unit that executes color mode printing by repeating a unit scan operation using a specific achromatic nozzle group and the plurality of single chromatic nozzle groups, the unit scan operation consisting of k main scans and (k−1) sub-scans of a first feed amount, the specific achromatic nozzle group being part of the achromatic nozzle group, wherein a color mode sub-scan of a second feed amount is performed in each interval between each unit scan operations, (b) a monochromatic mode unit that executes monochromatic mode printing by repeating the unit scan operation using all the nozzles of the achromatic nozzle group but without using the single chromatic nozzle groups while a monochromatic mode sub-scan of a third feed amount more than the second feed amount is performed in each interval between each unit scan operations, wherein the color mode unit comprising:

a first shifting unit that performs the color mode sub-scan; and performs the unit scan operation, while not forming dots in the monochromatic area by the specific achromatic nozzle group but forming dots in the color area using the single chromatic nozzle groups;

in a case that when it is assumed that the color mode sub-scan and the unit scan operation are performed next, (i) a lowermost main scan line of specific achromatic unit lines comes to be positioned within the monochromatic area, the specific achromatic unit lines consisting of plural main scan lines for which the specific achromatic nozzle group services with a single unit scan operation, and also (ii) the uppermost main scan line of color unit lines comes to be positioned within the color area, the color unit lines consisting of plural main scan lines for which an uppermost single chromatic nozzle group services with a single unit scan operation; and a second shifting unit that performs a sub-scan of a specific feed amount so that the uppermost main scan line of an achromatic unit band comes to an upper edge of the monochromatic area, the achromatic unit band consisting of plural main scan lines without any gap therebetween for which the achromatic nozzle group services with a single unit scan operation;

performs the unit scan operation once, while forming dots in the monochromatic area using the achromatic nozzle group; and proceeds to the monochromatic mode printing, in a case that all main scan lines of the color unit lines come to be positioned within the monochromatic area when it is assumed that the color mode sub-scan and the unit scan operation are performed next.

35. The printing apparatus according to claim 34, wherein the plurality of single chromatic nozzle groups includes C nozzle rows each of which includes N nozzles arranged in the sub-scan direction at the nozzle pitch k×D, where C is an integer of at least 2 and N is an integer of at least 2, the achromatic nozzle group includes a nozzle row consisting of N×C nozzles arranged in the sub-scan direction at the nozzle pitch k×D, wherein the first feed amount is equal to D, the second feed amount is equal to N×k×D, and the third feed amount is equal to N×C×k×D.

36. The printing apparatus according to claim 34, wherein the plurality of single chromatic nozzle groups includes C nozzle rows each of which includes N nozzles arranged in the sub-scan direction at the nozzle pitch k×D, where C is an integer of at least 2 and N is an integer of at least 2, the achromatic nozzle group includes a nozzle row consisting of N×C nozzles arranged in the sub-scan direction at the nozzle pitch k×D, wherein the first feed amount is equal to m×D (where m is an integer of 2 or greater that disjoints with k), the second feed amount is determined such that a sub-scan by the second feed amount will put a nozzle positioned at the very top of the nozzles of the plurality of single chromatic nozzle groups at a position of a main scan line immediately below a lower edge of a bundle of main scan lines without any gap therebetween for which recording is completed by the immediately prior unit scan operation; and the third feed amount is determined such that a sub-scan by the third feed amount will put an upper end nozzle of the achromatic nozzle group at a position of a main scan line immediately below a lower edge of the bundle of main scan lines recorded by the immediately prior unit scan operation without any gap therebetween.

37. A printing apparatus which prints images in a monochromatic area on a printing medium with an achromatic ink alone, and in a color area with chromatic inks, by ejecting ink drops from a nozzle to deposit the ink drops on the printing medium to form dots, comprising:

a printing head having:

a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks; and an achromatic nozzle group for ejecting achromatic ink, the achromatic nozzle group consisting of a greater number of nozzles that are arranged at nozzle pitch k×D than each of the single chromatic nozzle groups; and a main scan drive unit that moves at least one of the printing head and the printing medium to perform main scanning, a sub-scan drive unit that moves at least one of the printing head and the printing medium in a direction that intersects a main scanning direction to perform sub-scanning, and a control unit that controls each of these units, wherein the control unit has:

(a) a color mode unit that executes color mode printing by repeating a unit scan operation using a specific achromatic nozzle group and the plurality of single chromatic nozzle groups, the unit scan operation consisting of k main scans and (k−1) sub-scans of a first feed amount, the specific achromatic nozzle group being part of the achromatic nozzle group, wherein a color mode sub-scan of a second feed amount is performed in each interval between each unit scan operations, (b) a monochromatic mode unit that executes monochromatic mode printing by repeating the unit scan operation using all the nozzles of the achromatic nozzle group but without using the single chromatic nozzle groups while a monochromatic mode sub-scan of a third feed amount more than the second feed amount is performed in each interval between each unit scan operations, wherein the color mode unit comprising:

a first shifting unit that performs the color mode sub-scan; and performs the unit scan operation, while not forming dots in the monochromatic area by the specific achromatic nozzle group but forming dots in the color area using the single chromatic nozzle groups;

in a case that when it is assumed that the color mode sub-scan and the unit scan operation are performed next, (i) a lowermost main scan line of specific achromatic unit lines comes to be positioned within the monochromatic area, the specific achromatic unit lines consisting of plural main scan lines for which the specific achromatic nozzle group services with a single unit scan operation, and also (ii) the uppermost main scan line of color unit lines comes to be positioned within the color area, the color unit lines consisting of plural main scan lines for which an uppermost single chromatic nozzle group services with a single unit scan operation; and a second shifting unit that performs a sub-scan of a specific feed amount so that the lowermost main scan line of the color unit band comes to a lower edge of the color area when it is assumed that the unit scan operation are performed;

performs the unit scan operation once, while not forming dots in the monochromatic area by the specific achromatic nozzle group but forming dots in the color area using the single chromatic nozzle groups;

performs a sub-scan of a specific feed amount so that the uppermost main scan line of an achromatic unit band comes to an upper edge of the monochromatic area, the achromatic unit band consisting of plural main scan lines without any gap therebetween for which the achromatic nozzle group services with a single unit scan operation;

performs the unit scan operation once, while forming dots in the monochromatic area using the achromatic nozzle group; and proceeds to the monochromatic mode printing, in a case that a lowermost main scan line of a color unit band comes to be positioned within the monochromatic area when it is assumed that the color mode sub-scan and the unit scan operation are performed next, the color unit band consisting of plural main scan lines without any gap therebetween for which the uppermost single chromatic nozzle group services with a single unit scan operation.

38. The printing apparatus according to claim 37, wherein the plurality of single chromatic nozzle groups includes C nozzle rows each of which includes N nozzles arranged in the sub-scan direction at the nozzle pitch k×D, where C is an integer of at least 2 and N is an integer of at least 2, the achromatic nozzle group includes a nozzle row consisting of N×C nozzles arranged in the sub-scan direction at the nozzle pitch k×D, wherein the first feed amount is equal to D, the second feed amount is equal to N×k×D, and the third feed amount is equal to N×C×k×D.

39. The printing apparatus according to claim 37, wherein the plurality of single chromatic nozzle groups includes C nozzle rows each of which includes N nozzles arranged in the sub-scan direction at the nozzle pitch k×D, where C is an integer of at least 2 and N is an integer of at least 2, the achromatic nozzle group includes a nozzle row consisting of N×C nozzles arranged in the sub-scan direction at the nozzle pitch k×D, wherein the first feed amount is equal to m×D (where m is an integer of 2 or greater that disjoints with k), the second feed amount is determined such that a sub-scan by the second feed amount will put a nozzle positioned at the very top of the nozzles of the plurality of single chromatic nozzle groups at a position of a main scan line immediately below a lower edge of a bundle of main scan lines without any gap therebetween for which recording is completed by the immediately prior unit scan operation; and the third feed amount is determined such that a sub-scan by the third feed amount will put an upper end nozzle of the achromatic nozzle group at a position of a main scan line immediately below a lower edge of the bundle of main scan lines recorded by the immediately prior unit scan operation without any gap therebetween.

40. A printing apparatus which prints images in a monochromatic area on a printing medium with an achromatic ink alone, and in a color area with chromatic inks, by ejecting ink drops from a nozzle to deposit the ink drops on the printing medium to form dots, comprising:

a printing head having:

a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks; and an achromatic nozzle group for ejecting achromatic ink, the achromatic nozzle group consisting of a greater number of nozzles that are arranged at nozzle pitch k×D than each of the single chromatic nozzle groups; and a main scan drive unit that moves at least one of the printing head and the printing medium to perform main scanning, a sub-scan drive unit that moves at least one of the printing head and the printing medium in a direction that intersects a main scanning direction to perform sub-scanning, and a control unit that controls each of these units, wherein the control unit has:

(a) a color mode unit that executes color mode printing by repeating a unit scan operation using a specific achromatic nozzle group and the plurality of single chromatic nozzle groups, the unit scan operation consisting of k main scans and (k−1) sub-scans of a first feed amount, the specific achromatic nozzle group being part of the achromatic nozzle group, wherein a color mode sub-scan of a second feed amount is performed in each interval between each unit scan operations, (b) a monochromatic mode unit that executes monochromatic mode printing by repeating the unit scan operation using all the nozzles of the achromatic nozzle group but without using the single chromatic nozzle groups while a monochromatic mode sub-scan of a third feed amount more than the second feed amount is performed in each interval between each unit scan operations, wherein the color mode unit comprising:

a first shifting unit that performs the color mode sub-scan; and performs the unit scan operation, while not forming dots in the monochromatic area by the specific achromatic nozzle group but forming dots in the color area using the single chromatic nozzle groups;

in a case that (i) a lowermost main scan line of specific achromatic unit lines comes to be positioned within the monochromatic area when it is assumed that the color mode sub-scan and the unit scan operation are performed next, and (ii) main scan line count Lr2 of a remaining color area is equal to or larger than main scan line count L2 of a single chromatic unit band, the remaining color area being an area of the color area comprising main scan lines not yet been recorded, the single chromatic unit band consisting of plural main scan lines without any gap therebetween for which a one of the single chromatic nozzle groups services with a single unit scan operation; and a second shifting unit that performs a sub-scan of a specific feed amount so that the lowermost main scan line of a color unit band comes to a lower edge of the remaining color area;

performs the unit scan operation once, while not forming dots in the monochromatic area by the specific achromatic nozzle group but forming dots in the color area using the single chromatic nozzle groups;

performs a sub-scan of a specific feed amount so that the uppermost main scan line of a achromatic unit band comes to an upper edge of the monochromatic area, the achromatic unit band consisting of plural main scan lines without any gap therebetween for which the achromatic nozzle group services with a single unit scan operation;

performs the unit scan operation once, while forming dots in the monochromatic area using the achromatic nozzle group; and proceeds to the monochromatic mode printing, in a case that main scan line count Lr2 of the remaining color area is smaller than main scan line count L2 of the single chromatic unit band.

41. A printing apparatus which prints images in a monochromatic area on a printing medium with an achromatic ink alone, and in a color area with chromatic inks, by ejecting ink drops from a nozzle to deposit the ink drops on the printing medium to form dots, comprising:

a printing head having:

a plurality of single chromatic nozzle groups each consisting of plurality of nozzles that are arranged at nozzle pitch D where D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch D than each of the single chromatic nozzle groups; and a main scan drive unit that moves at least one of the printing head and the printing medium to perform main scanning, a sub-scan drive unit that moves at least one of the printing head and the printing medium in a direction that intersects a main scanning direction to perform sub-scanning, and a control unit that controls each of these units, wherein the control unit has:

(a) a monochromatic mode unit that executes monochromatic mode printing by repeating a main scan using all the nozzles of the achromatic nozzle group but without using the single chromatic nozzle groups, and wherein a monochromatic mode sub-scan of a first feed amount is performed in each interval between each main scans, and (b) a color mode unit that executes color mode printing by repeating the main scan using a specific achromatic nozzle group and the plurality of single chromatic nozzle groups while a color mode sub-scan of a second feed amount less than the first feed amount is performed in each interval between each main scans, the specific achromatic nozzle group being part of the achromatic nozzle group, wherein the monochromatic mode unit comprising:

a shifting unit that performs a sub-scan of a feed amount (J−1) times the second feed amount of the color mode sub-scan;

performs the main scan once, while forming dots in the monochromatic area using the achromatic nozzle group; and proceeds to the color mode printing, in a case that (i) a lowermost nozzle of the achromatic nozzle group comes to be positioned over the color area when it is assumed that the monochromatic mode sub-scan is performed next, that (ii) a lowermost nozzle of the specific achromatic nozzle group comes to be positioned over the color area when it is assumed that a sub-scan of a feed amount J times (where J is an integer of two or greater) the second feed amount of the color mode sub-scan is performed, and that (iii) a lowermost nozzle of the specific achromatic nozzle group comes to be positioned over the monochromatic area when it is assumed that a sub-scan of a feed amount (J−1) times the second feed amount of the color mode sub-scan is performed.

42. The printing apparatus according to claim 41, wherein the plurality of single chromatic nozzle groups includes C nozzle rows each of which includes N nozzles arranged in the sub-scan direction at the nozzle pitch D, where C is an integer of at least 2 and N is an integer of at least 2, the achromatic nozzle group includes a nozzle row consisting of N×C nozzles arranged in the sub-scan direction at the nozzle pitch D, wherein the first feed amount is equal to N×C×D, and the second feed amount is equal to N×D.

43. The printing apparatus according to claim 41, wherein the shift unit proceeds to the color mode printing, in a case that a lowermost nozzle of the specific achromatic nozzle group comes to be positioned over the color area when it is assumed that the color mode sub-scan is performed next.

44. A printing apparatus which prints images in a monochromatic area on a printing medium with an achromatic ink alone, and in a color area with chromatic inks, by ejecting ink drops from a nozzle to deposit the ink drops on the printing medium to form dots, comprising:

a printing head having:

a plurality of single chromatic nozzle groups each consisting of plurality of nozzles that are arranged at nozzle pitch D where D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch D than each of the single chromatic nozzle groups; and a main scan drive unit that moves at least one of the printing head and the printing medium to perform main scanning, a sub-scan drive unit that moves at least one of the printing head and the printing medium in a direction that intersects a main scanning direction to perform sub-scanning, and a control unit that controls each of these units, wherein the control unit has:

(a) a monochromatic mode unit that executes monochromatic mode printing by repeating a main scan using all the nozzles of the achromatic nozzle group but without using the single chromatic nozzle groups, and wherein a monochromatic mode sub-scan of a first feed amount is performed in each interval between each main scans, and (b) a color mode unit that executes color mode printing by repeating the main scan using a specific achromatic nozzle group and the plurality of single chromatic nozzle groups while a color mode sub-scan of a second feed amount less than the first feed amount is performed in each interval between each main scans, the specific achromatic nozzle group being part of the achromatic nozzle group, wherein the monochromatic mode unit comprising:

a shifting unit that performs a sub-scan of a feed amount (J−1) times the second feed amount of the color mode sub-scan;

performs the main scan once, while forming dots in the monochromatic area using the achromatic nozzle group; and proceeds to the color mode printing, in a case that main scan line count Lr1 of a remaining monochromatic area is (i) smaller than a nozzle number N1 (where N1 is an integer of two or greater) of the achromatic nozzle group, (ii) equal to or larger than a number of (J−1) times (where J is an integer of two or greater) a nozzle number N2 (where N2 is an integer of two or greater) of the specific achromatic nozzle group, and (iii) smaller than a number of J times the nozzle number N2.

45. The printing apparatus according to claim 44, wherein the shift unit proceeds to the color mode printing, in a case that main scan line count Lr1 of the remaining monochromatic area is smaller than the nozzle number N2.

46. A printing apparatus which prints images in a monochromatic area on a printing medium with an achromatic ink alone, and in a color area with chromatic inks, by ejecting ink drops from a nozzle to deposit the ink drops on the printing medium to form dots, comprising:

a printing head having:

a plurality of single chromatic nozzle groups each consisting of plurality of nozzles that are arranged at nozzle pitch D where D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch D than each of the single chromatic nozzle groups; and a main scan drive unit that moves at least one of the printing head and the printing medium to perform main scanning, a sub-scan drive unit that moves at least one of the printing head and the printing medium in a direction that intersects a main scanning direction to perform sub-scanning, and a control unit that controls each of these units, wherein the control unit has:

(a) a color mode unit that executes color mode printing by repeating the main scan using a specific achromatic nozzle group and the plurality of single chromatic nozzle groups, and wherein a color mode sub-scan of a first feed amount is performed in each interval between each main scans, the specific achromatic nozzle group being part of the achromatic nozzle group, and (b) a monochromatic mode unit that executes monochromatic mode printing by repeating a main scan using all the nozzles of the achromatic nozzle group but without using the single chromatic nozzle groups while a monochromatic mode sub-scan of a second feed amount more than the first feed amount is performed in each interval between each main scans, wherein the color mode unit comprising:

a first shifting unit that performs the color mode sub-scan; and performs the main scan, while not forming dots in the monochromatic area by the specific achromatic nozzle group but forming dots in the color area using the single chromatic nozzle groups, in a case that when it is assumed that the color mode sub-scan is performed next, (i) a lowermost nozzle of specific achromatic nozzle group comes to be positioned over the monochromatic area, and also (ii) a nozzle positioned at the very top of the nozzles of the plurality of single chromatic nozzle groups comes to be positioned over the color area; and a second shifting unit that performs a sub-scan of a specific feed amount so that an uppermost nozzle of the achromatic nozzle group comes over an upper edge of the monochromatic area,; and performs the main scan once, while forming dots in the monochromatic area using the achromatic nozzle group; and proceeds to the monochromatic mode printing, in a case that all nozzles of the plurality of single chromatic nozzle groups come to be positioned within the monochromatic area when it is assumed that the color mode sub-scan is performed next.

47. The printing apparatus according to claim 46, wherein the plurality of single chromatic nozzle groups includes C nozzle rows each of which includes N nozzles arranged in the sub-scan direction at the nozzle pitch D, where C is an integer of at least 2 and N is an integer of at least 2, the achromatic nozzle group includes a nozzle row consisting of N×C nozzles arranged in the sub-scan direction at the nozzle pitch D, wherein the first feed amount is equal to N×D, and the second feed amount is equal to N×C×D.

48. A printing apparatus which prints images in a monochromatic area on a printing medium with an achromatic ink alone, and in a color area with chromatic inks, by ejecting ink drops from a nozzle to deposit the ink drops on the printing medium to form dots, comprising:

a printing head having:

a plurality of single chromatic nozzle groups each consisting of plurality of nozzles that are arranged at nozzle pitch D where D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch D than each of the single chromatic nozzle groups; and a main scan drive unit that moves at least one of the printing head and the printing medium to perform main scanning, a sub-scan drive unit that moves at least one of the printing head and the printing medium in a direction that intersects a main scanning direction to perform sub-scanning, and a control unit that controls each of these units, wherein the control unit has:

(a) a color mode unit that executes color mode printing by repeating the main scan using a specific achromatic nozzle group and the plurality of single chromatic nozzle groups, and wherein a color mode sub-scan of a first feed amount is performed in each interval between each main scans, the specific achromatic nozzle group being part of the achromatic nozzle group, and (b) a monochromatic mode unit that executes monochromatic mode printing by repeating a main scan using all the nozzles of the achromatic nozzle group but without using the single chromatic nozzle groups while a monochromatic mode sub-scan of a second feed amount more than the first feed amount is performed in each interval between each main scans, wherein the color mode unit comprising:

a first shifting unit that performs the color mode sub-scan; and performs the main scan, while not forming dots in the monochromatic area by the specific achromatic nozzle group but forming dots in the color area using the single chromatic nozzle groups, in a case that when it is assumed that the color mode sub-scan is performed next, (i) a lowermost nozzle of specific achromatic nozzle group comes to be positioned over the monochromatic area, and also (ii) a nozzle positioned at the very top of the nozzles of the plurality of single chromatic nozzle groups comes to be positioned over the color area; and a second shifting unit that performs a sub-scan of a specific feed amount so that the lowermost nozzle of the uppermost single chromatic nozzle group comes to a lower edge of the color area;

performs the main scan once, while not forming dots in the monochromatic area by the specific achromatic nozzle group but forming dots in the color area using the single chromatic nozzle groups;

performs a sub-scan of a specific feed amount so that an uppermost nozzle of the achromatic nozzle group comes over an upper edge of the monochromatic area;

performs the main scan once, while forming dots in the monochromatic area using the achromatic nozzle group; and proceeds to the monochromatic mode printing, in a case that a lowermost nozzle of an uppermost single chromatic nozzle group comes to be positioned within the monochromatic area when it is assumed that the color mode sub-scan is performed next.

49. The printing apparatus according to claim 48, wherein the plurality of single chromatic nozzle groups includes C nozzle rows each of which includes N nozzles arranged in the sub-scan direction at the nozzle pitch D, where C is an integer of at least 2 and N is an integer of at least 2, the achromatic nozzle group includes a nozzle row consisting of N×C nozzles arranged in the sub-scan direction at the nozzle pitch D, wherein the first feed amount is equal to N×D, and the second feed amount is equal to N×C×D.

50. A printing apparatus which prints images in a monochromatic area on a printing medium with an achromatic ink alone, and in a color area with chromatic inks, by ejecting ink drops from a nozzle to deposit the ink drops on the printing medium to form dots, comprising:

a printing head having:

a plurality of single chromatic nozzle groups each consisting of plurality of nozzles that are arranged at nozzle pitch D where D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch D than each of the single chromatic nozzle groups; and a main scan drive unit that moves at least one of the printing head and the printing medium to perform main scanning, a sub-scan drive unit that moves at least one of the printing head and the printing medium in a direction that intersects a main scanning direction to perform sub-scanning, and a control unit that controls each of these units, wherein the control unit has:

(a) a color mode unit that executes color mode printing by repeating the main scan using a specific achromatic nozzle group and the plurality of single chromatic nozzle groups, and wherein a color mode sub-scan of a first feed amount is performed in each interval between each main scans, the specific achromatic nozzle group being part of the achromatic nozzle group, and (b) a monochromatic mode unit that executes monochromatic mode printing by repeating a main scan using all the nozzles of the achromatic nozzle group but without using the single chromatic nozzle groups while a monochromatic mode sub-scan of a second feed amount more than the first feed amount is performed in each interval between each main scans, wherein the color mode unit comprising:

a first shifting unit that performs the color mode sub-scan; and performs the main scan, while not forming dots in the monochromatic area by the specific achromatic nozzle group but forming dots in the color area using the single chromatic nozzle groups, in a case that (i) a lowermost nozzle of specific achromatic nozzle group comes to be positioned over the monochromatic area when it is assumed that the color mode sub-scan is performed next, and (ii) main scan line count Lr2 of a remaining color area is equal to or larger than a nozzle number N2 of the single achromatic nozzle group, the remaining color area being an area of the color area comprising main scan lines not yet been recorded; and a second shifting unit that performs a sub-scan of a specific feed amount so that a lowermost nozzle of an uppermost single chromatic nozzle group comes over a lower edge of the remaining color area, performs the main scan once, while not forming dots in the monochromatic area by the specific achromatic nozzle group but forming dots in the color area using the single chromatic nozzle groups;

performs a sub-scan of a specific feed amount so that the uppermost nozzle of the achromatic nozzle group comes to an upper edge of the monochromatic area;

performs the main scan once, while forming dots in the monochromatic area using the achromatic nozzle group; and proceeds to the monochromatic mode printing, in a case that main scan line count Lr2 of the remaining color area is smaller than the nozzle number N2 of the single achromatic nozzle group.

51. A computer program product for printing images in a monochromatic area on a printing medium with the achromatic ink alone, and in a color area with the chromatic inks, using a computer, the computer being connected with a printing device having a printing head equipped with a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups, the computer program product comprising:

a computer readable medium; and a computer program stored on the computer readable medium, the computer program comprising:

(a) a monochromatic mode program for causing the computer to execute monochromatic mode printing by repeating a unit scan operation using all the nozzles of the achromatic nozzle group but without using the single chromatic nozzle groups, the unit scan operation consisting of k main scans and (k−1) sub-scans of a first feed amount, wherein the unit scan operation in the monochromatic mode printing is performed such that all dot positions in an achromatic unit band consisting of plural main scan lines without any gap therebetween are serviced by the achromatic nozzle group, and wherein a monochromatic mode sub-scan of a second feed amount is performed in each interval between each unit scan operations, and (b) a color mode program for causing the computer to execute color mode printing by repeating the unit scan operation using a specific achromatic nozzle group and the plurality of single chromatic nozzle groups while a color mode sub-scan of a third feed amount less than the second feed amount is performed in each interval between each unit scan operations, the specific achromatic nozzle group being part of the achromatic nozzle group, wherein the monochromatic mode program comprises:

a sub-program for causing the computer to perform a sub-scan whose feed amount is equal to a sum of (J−1) times the third feed amount and (J−2) times a total feed amount of sub-scans performed in one unit scan operation;

to perform the unit scan operation once, while forming dots in the monochromatic area using the achromatic nozzle group; and to proceed to the color mode printing, in a case that (i) a lowermost main scan line of the first achromatic unit band comes to be positioned within the color area when it is assumed that the monochromatic mode sub-scan and the unit scan operation are performed next, that (ii) a lowermost main scan line of a second achromatic unit band comes to be positioned within the color area when it is assumed that a set of the color mode sub-scan and the unit scan operation is performed J times (where J is an integer of two or greater), and that (iii) a lowermost main scan line of the second achromatic unit band comes to be positioned within the monochromatic area when it is assumed that the set of the color mode sub-scan and the unit scan operation is performed (J−1) times, the second achromatic unit band consisting of plural main scan lines without any gap therebetween for which the specific achromatic nozzle group services with a single unit scan operation.

52. A computer program product for printing images in a monochromatic area on a printing medium with the achromatic ink alone, and in a color area with the chromatic inks, using a computer, the computer being connected with a printing device having a printing head equipped with a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups, the computer program product comprising:

a computer readable medium; and a computer program stored on the computer readable medium, the computer program comprising:

(a) a monochromatic mode program for causing the computer to execute monochromatic mode printing by repeating a unit scan operation using all the nozzles of the achromatic nozzle group but without using the single chromatic nozzle groups, the unit scan operation consisting of k main scans and (k−1) sub-scans of a first feed amount, wherein the unit scan operation in the monochromatic mode printing is performed such that all dot positions in an achromatic unit band consisting of plural main scan lines without any gap therebetween are serviced by the achromatic nozzle group, and wherein a monochromatic mode sub-scan of a second feed amount is performed in each interval between each unit scan operations, and (b) a color mode program for causing the computer to execute color mode printing by repeating the unit scan operation using a specific achromatic nozzle group and the plurality of single chromatic nozzle groups while a color mode sub-scan of a third feed amount less than the second feed amount is performed in each interval between each unit scan operations, the specific achromatic nozzle group being part of the achromatic nozzle group, wherein the monochromatic mode program comprises:

a sub-program for causing the computer to perform a sub-scan whose feed amount is equal to a sum of (J−1) times the third feed amount and (J−2) times a total feed amount of sub-scans performed in one unit scan operation;

to perform the unit scan operation once, while forming dots in the monochromatic area using the achromatic nozzle group; and to proceed to the color mode printing, in a case that main scan line count Lr1 of a remaining monochromatic area is (i) smaller than main scan line count L1 of the first achromatic unit band, (ii) equal to or larger than main scan line count of (J−1) times of main scan line count L2, and (iii) smaller than main scan line count of J times of main scan line count L2, the main scan line count L2 being a main scan line count of a second achromatic unit band, the second achromatic unit band consisting of plural main scan lines without any gap therebetween for which the specific achromatic nozzle group services with a single unit scan operation.

53. A computer program product for printing images in a monochromatic area on a printing medium with the achromatic ink alone, and in a color area with the chromatic inks, using a computer, the computer being connected with a printing device having a printing head equipped with a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups, the computer program product comprising:

a computer readable medium; and a computer program stored on the computer readable medium, the computer program comprising:

(a) a color mode program for causing the computer to execute color mode printing by repeating a unit scan operation using a specific achromatic nozzle group and the plurality of single chromatic nozzle groups, the unit scan operation consisting of k main scans and (k−1) sub-scans of a first feed amount, the specific achromatic nozzle group being part of the achromatic nozzle group, wherein a color mode sub-scan of a second feed amount is performed in each interval between each unit scan operations, (b) a monochromatic mode program for causing the computer to execute monochromatic mode printing by repeating the unit scan operation using all the nozzles of the achromatic nozzle group but without using the single chromatic nozzle groups while a monochromatic mode sub-scan of a third feed amount more than the second feed amount is performed in each interval between each unit scan operations, wherein the color mode program comprises:

a first sub-program for causing the computer to perform the color mode sub-scan; and perform the unit scan operation, while not forming dots in the monochromatic area by the specific achromatic nozzle group but forming dots in the color area using the single chromatic nozzle groups, in a case that when it is assumed that the color mode sub-scan and the unit scan operation are performed next, (i) a lowermost main scan line of specific achromatic unit lines comes to be positioned within the monochromatic area, the specific achromatic unit lines consisting of plural main scan lines for which the specific achromatic nozzle group services with a single unit scan operation, and also (ii) the uppermost main scan line of color unit lines comes to be positioned within the color area, the color unit lines consisting of plural main scan lines for which an uppermost single chromatic nozzle group services with a single unit scan operation; and a second sub-program for causing the computer to perform a sub-scan of a specific feed amount so that the uppermost main scan line of an achromatic unit band comes to an upper edge of the monochromatic area, the achromatic unit band consisting of plural main scan lines without any gap therebetween for which the achromatic nozzle group services with a single unit scan operation;

to perform the unit scan operation once, while forming dots in the monochromatic area using the achromatic nozzle group; and to proceed to the monochromatic mode printing, in a case that all main scan lines of the color unit lines come to be positioned within the monochromatic area when it is assumed that the color mode sub-scan and the unit scan operation are performed next.

54. A computer program product for printing images in a monochromatic area on a printing medium with the achromatic ink alone, and in a color area with the chromatic inks, using a computer, the computer being connected with a printing device having a printing head equipped with a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups, the computer program product comprising:

a computer readable medium; and a computer program stored on the computer readable medium, the computer program comprising:

(a) a color mode program for causing the computer to execute color mode printing by repeating a unit scan operation using a specific achromatic nozzle group and the plurality of single chromatic nozzle groups, the unit scan operation consisting of k main scans and (k−1) sub-scans of a first feed amount, the specific achromatic nozzle group being part of the achromatic nozzle group, wherein a color mode sub-scan of a second feed amount is performed in each interval between each unit scan operations, (b) a monochromatic mode program for causing the computer to execute monochromatic mode printing by repeating the unit scan operation using all the nozzles of the achromatic nozzle group but without using the single chromatic nozzle groups while a monochromatic mode sub-scan of a third feed amount more than the second feed amount is performed in each interval between each unit scan operations, wherein the color mode program comprises:

a first sub-program for causing the computer to perform the color mode sub-scan; and to perform the unit scan operation, while not forming dots in the monochromatic area by the specific achromatic nozzle group but forming dots in the color area using the single chromatic nozzle groups, in a case that when it is assumed that the color mode sub-scan and the unit scan operation are performed next, (i) a lowermost main scan line of specific achromatic unit lines comes to be positioned within the monochromatic area, the specific achromatic unit lines consisting of plural main scan lines for which the specific achromatic nozzle group services with a single unit scan operation, and also (ii) the uppermost main scan line of color unit lines comes to be positioned within the color area, the color unit lines consisting of plural main scan lines for which an uppermost single chromatic nozzle group services with a single unit scan operation; and a second sub-program for causing the computer to perform a sub-scan of a specific feed amount so that the lowermost main scan line of the color unit band comes to a lower edge of the color area when it is assumed that the unit scan operation are performed;

to perform the unit scan operation once, while not forming dots in the monochromatic area by the specific achromatic nozzle group but forming dots in the color area using the single chromatic nozzle groups;

to perform a sub-scan of a specific feed amount so that the uppermost main scan line of an achromatic unit band comes to an upper edge of the monochromatic area, the achromatic unit band consisting of plural main scan lines without any gap therebetween for which the achromatic nozzle group services with a single unit scan operation;

to perform the unit scan operation once, while forming dots in the monochromatic area using the achromatic nozzle group; and to proceed to the monochromatic mode printing, in a case that a lowermost main scan line of a color unit band comes to be positioned within the monochromatic area when it is assumed that the color mode sub-scan and the unit scan operation are performed next, the color unit band consisting of plural main scan lines without any gap therebetween for which the uppermost single chromatic nozzle group services with a single unit scan operation.

55. A computer program product for printing images in a monochromatic area on a printing medium with the achromatic ink alone, and in a color area with the chromatic inks, using a computer, the computer being connected with a printing device having a printing head equipped with a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups, the computer program product comprising:

a computer readable medium; and a computer program stored on the computer readable medium, the computer program comprising:

(a) a color mode program for causing the computer to execute color mode printing by repeating a unit scan operation using a specific achromatic nozzle group and the plurality of single chromatic nozzle groups, the unit scan operation consisting of k main scans and (k−1) sub-scans of a first feed amount, the specific achromatic nozzle group being part of the achromatic nozzle group, wherein a color mode sub-scan of a second feed amount is performed in each interval between each unit scan operations, (b) a monochromatic mode program for causing the computer to execute monochromatic mode printing by repeating the unit scan operation using all the nozzles of the achromatic nozzle group but without using the single chromatic nozzle groups while a monochromatic mode sub-scan of a third feed amount more than the second feed amount is performed in each interval between each unit scan operations, wherein the color mode program comprises:

a first sub-program for causing the computer to perform the color mode sub-scan; and to perform the unit scan operation, while not forming dots in the monochromatic area by the specific achromatic nozzle group but forming dots in the color area using the single chromatic nozzle groups, in a case that (i) a lowermost main scan line of specific achromatic unit lines comes to be positioned within the monochromatic area when it is assumed that the color mode sub-scan and the unit scan operation are performed next, and (ii) main scan line count Lr2 of a remaining color area is equal to or larger than main scan line count L2 of a single chromatic unit band, the remaining color area being an area of the color area comprising main scan lines not yet been recorded, the single chromatic unit band consisting of plural main scan lines without any gap therebetween for which a one of the single chromatic nozzle groups services with a single unit scan operation; and a second sub-program for causing the computer to perform a sub-scan of a specific feed amount so that the lowermost main scan line of a color unit band comes to a lower edge of the remaining color area;

to perform the unit scan operation once, while not forming dots in the monochromatic area by the specific achromatic nozzle group but forming dots in the color area using the single chromatic nozzle groups;

to perform a sub-scan of a specific feed amount so that the uppermost main scan line of a achromatic unit band comes to an upper edge of the monochromatic area, the achromatic unit band consisting of plural main scan lines without any gap therebetween for which the achromatic nozzle group services with a single unit scan operation;

to perform the unit scan operation once, while forming dots in the monochromatic area using the achromatic nozzle group; and to proceed to the monochromatic mode printing, in a case that main scan line count Lr2 of the remaining color area is smaller than main scan line count L2 of the single chromatic unit band.

56. A computer program product for printing images in a monochromatic area on a printing medium with the achromatic ink alone, and in a color area with the chromatic inks, using a computer, the computer being connected with a printing device having a printing head equipped with a plurality of single chromatic nozzle groups each consisting of plurality of nozzles that are arranged at nozzle pitch D where D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch D than each of the single chromatic nozzle groups, the computer program product comprising:

a computer readable medium; and a computer program stored on the computer readable medium, the computer program comprising:

(a) a monochromatic mode program for causing the computer to execute monochromatic mode printing by repeating a main scan using all the nozzles of the achromatic nozzle group but without using the single chromatic nozzle groups, and wherein a monochromatic mode sub-scan of a first feed amount is performed in each interval between each main scans, and (b) a color mode program for causing the computer to execute color mode printing by repeating the main scan using a specific achromatic nozzle group and the plurality of single chromatic nozzle groups while a color mode sub-scan of a second feed amount less than the first feed amount is performed in each interval between each main scans, the specific achromatic nozzle group being part of the achromatic nozzle group, wherein the monochromatic mode program comprises:

a sub-program for causing the computer to perform a sub-scan of a feed amount (J−1) times the second feed amount of the color mode sub-scan;

to perform the main scan once, while forming dots in the monochromatic area using the achromatic nozzle group; and to proceed to the color mode printing, in a case that (i) a lowermost nozzle of the achromatic nozzle group comes to be positioned over the color area when it is assumed that the monochromatic mode sub-scan is performed next, that (ii) a lowermost nozzle of the specific achromatic nozzle group comes to be positioned over the color area when it is assumed that a sub-scan of a feed amount J times (where J is an integer of two or greater) the second feed amount of the color mode sub-scan is performed, and that (iii) a lowermost nozzle of the specific achromatic nozzle group comes to be positioned over the monochromatic area when it is assumed that a sub-scan of a feed amount (J−1) times the second feed amount of the color mode sub-scan is performed.

57. A computer program product for printing images in a monochromatic area on a printing medium with the achromatic ink alone, and in a color area with the chromatic inks, using a computer, the computer being connected with a printing device having a printing head equipped with a plurality of single chromatic nozzle groups each consisting of plurality of nozzles that are arranged at nozzle pitch D where D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch D than each of the single chromatic nozzle groups, the computer program product comprising:

a computer readable medium; and a computer program stored on the computer readable medium, the computer program comprising:

(a) a monochromatic mode program for causing the computer to execute monochromatic mode printing by repeating a main scan using all the nozzles of the achromatic nozzle group but without using the single chromatic nozzle groups, and wherein a monochromatic mode sub-scan of a first feed amount is performed in each interval between each main scans, and (b) a color mode program for causing the computer to execute color mode printing by repeating the main scan using a specific achromatic nozzle group and the plurality of single chromatic nozzle groups while a color mode sub-scan of a second feed amount less than the first feed amount is performed in each interval between each main scans, the specific achromatic nozzle group being part of the achromatic nozzle group, wherein the monochromatic mode program comprises:

a sub-program for causing the computer to perform a sub-scan of a feed amount (J−1) times the second feed amount of the color mode sub-scan;

to perform the main scan once, while forming dots in the monochromatic area using the achromatic nozzle group; and to proceed to the color mode printing, in a case that main scan line count Lr1 of a remaining monochromatic area is (i) smaller than a nozzle number N1 (where N1 is an integer of two or greater) of the achromatic nozzle group, (ii) equal to or larger than a number of (J−1) times (where J is an integer of two or greater) a nozzle number N2 (where N2 is an integer of two or greater) of the specific achromatic nozzle group, and (iii) smaller than a number of J times the nozzle number N2.

58. A computer program product for printing images in a monochromatic area on a printing medium with the achromatic ink alone, and in a color area with the chromatic inks, using a computer, the computer being connected with a printing device having a printing head equipped with a plurality of single chromatic nozzle groups each consisting of plurality of nozzles that are arranged at nozzle pitch D where D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch D than each of the single chromatic nozzle groups, the computer program product comprising:

a computer readable medium; and a computer program stored on the computer readable medium, the computer program comprising:

(a) a color mode program for causing the computer to execute color mode printing by repeating the main scan using a specific achromatic nozzle group and the plurality of single chromatic nozzle groups, and wherein a color mode sub-scan of a first feed amount is performed in each interval between each main scans, the specific achromatic nozzle group being part of the achromatic nozzle group, and (b) a monochromatic mode program for causing the computer to execute monochromatic mode printing by repeating a main scan using all the nozzles of the achromatic nozzle group but without using the single chromatic nozzle groups while a monochromatic mode sub-scan of a second feed amount more than the first feed amount is performed in each interval between each main scans, wherein the color mode program comprises:

a first sub-program for causing the computer to perform the color mode sub-scan; and to perform the main scan, while not forming dots in the monochromatic area by the specific achromatic nozzle group but forming dots in the color area using the single chromatic nozzle groups, in a case that when it is assumed that the color mode sub-scan is performed next, (i) a lowermost nozzle of specific achromatic nozzle group comes to be positioned over the monochromatic area, and also (ii) a nozzle positioned at the very top of the nozzles of the plurality of single chromatic nozzle groups comes to be positioned over the color area; and a second sub-program for causing the computer to perform a sub-scan of a specific feed amount so that an uppermost nozzle of the achromatic nozzle group comes over an upper edge of the monochromatic area,; and to perform the main scan once, while forming dots in the monochromatic area using the achromatic nozzle group; and to proceed to the monochromatic mode printing, in a case that all nozzles of the plurality of single chromatic nozzle groups come to be positioned within the monochromatic area when it is assumed that the color mode sub-scan is performed next.

59. A computer program product for printing images in a monochromatic area on a printing medium with the achromatic ink alone, and in a color area with the chromatic inks, using a computer, the computer being connected with a printing device having a printing head equipped with a plurality of single chromatic nozzle groups each consisting of plurality of nozzles that are arranged at nozzle pitch D where D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch D than each of the single chromatic nozzle groups, the computer program product comprising:

a computer readable medium; and a computer program stored on the computer readable medium, the computer program comprising:

(a) a color mode program for causing the computer to execute color mode printing by repeating the main scan using a specific achromatic nozzle group and the plurality of single chromatic nozzle groups, and wherein a color mode sub-scan of a first feed amount is performed in each interval between each main scans, the specific achromatic nozzle group being part of the achromatic nozzle group, and (b) a monochromatic mode program for causing the computer to execute monochromatic mode printing by repeating a main scan using all the nozzles of the achromatic nozzle group but without using the single chromatic nozzle groups while a monochromatic mode sub-scan of a second feed amount more than the first feed amount is performed in each interval between each main scans, wherein the color mode program comprises:

a first sub-program for causing the computer to perform the color mode sub-scan; and to perform the main scan, while not forming dots in the monochromatic area by the specific achromatic nozzle group but forming dots in the color area using the single chromatic nozzle groups, in a case that when it is assumed that the color mode sub-scan is performed next, (i) a lowermost nozzle of specific achromatic nozzle group comes to be positioned over the monochromatic area, and also (ii) a nozzle positioned at the very top of the nozzles of the plurality of single chromatic nozzle groups comes to be positioned over the color area; and a second sub-program for causing the computer to perform a sub-scan of a specific feed amount so that the lowermost nozzle of the uppermost single chromatic nozzle group comes to a lower edge of the color area;

to perform the main scan once, while not forming dots in the monochromatic area by the specific achromatic nozzle group but forming dots in the color area using the single chromatic nozzle groups;

to perform a sub-scan of a specific feed amount so that an uppermost nozzle of the achromatic nozzle group comes over an upper edge of the monochromatic area;

to perform the main scan once, while forming dots in the monochromatic area using the achromatic nozzle group; and to proceed to the monochromatic mode printing, in a case that a lowermost nozzle of an uppermost single chromatic nozzle group comes to be positioned within the monochromatic area when it is assumed that the color mode sub-scan is performed next.

60. A computer program product for printing images in a monochromatic area on a printing medium with the achromatic ink alone, and in a color area with the chromatic inks, using a computer, the computer being connected with a printing device having a printing head equipped with a plurality of single chromatic nozzle groups each consisting of plurality of nozzles that are arranged at nozzle pitch D where D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch D than each of the single chromatic nozzle groups, the computer program product comprising:

a computer readable medium; and a computer program stored on the computer readable medium, the computer program comprising:

(a) a color mode program for causing the computer to execute color mode printing by repeating the main scan using a specific achromatic nozzle group and the plurality of single chromatic nozzle groups, and wherein a color mode sub-scan of a first feed amount is performed in each interval between each main scans, the specific achromatic nozzle group being part of the achromatic nozzle group, and (b) a monochromatic mode program for causing the computer to execute monochromatic mode printing by repeating a main scan using all the nozzles of the achromatic nozzle group but without using the single chromatic nozzle groups while a monochromatic mode sub-scan of a second feed amount more than the first feed amount is performed in each interval between each main scans, wherein the color mode program comprises:

a first sub-program for causing the computer to perform the color mode sub-scan; and to perform the main scan, while not forming dots in the monochromatic area by the specific achromatic nozzle group but forming dots in the color area using the single chromatic nozzle groups, in a case that (i) a lowermost nozzle of specific achromatic nozzle group comes to be positioned over the monochromatic area when it is assumed that the color mode sub-scan is performed next, and (ii) main scan line count Lr2 of a remaining color area is equal to or larger than a nozzle number N2 of the single achromatic nozzle group, the remaining color area being an area of the color area comprising main scan lines not yet been recorded; and a second sub-program for causing the computer to perform a sub-scan of a specific feed amount so that a lowermost nozzle of an uppermost single chromatic nozzle group comes over a lower edge of the remaining color area, to perform the main scan once, while not forming dots in the monochromatic area by the specific achromatic nozzle group but forming dots in the color area using the single chromatic nozzle groups;

to perform a sub-scan of a specific feed amount so that the uppermost nozzle of the achromatic nozzle group comes to an upper edge of the monochromatic area;

to perform the main scan once, while forming dots in the monochromatic area using the achromatic nozzle group; and to proceed to the monochromatic mode printing, in a case that main scan line count Lr2 of the remaining color area is smaller than the nozzle number N2 of the single achromatic nozzle group.

* * * * *